US011819868B2

(12) United States Patent
Jurmu et al.

(10) Patent No.: US 11,819,868 B2
(45) **Date of Patent: *Nov. 21, 2023**

(54) MATERIAL SPRAY GUN

(71) Applicant: Graco Minnesota Inc., Minneapolis, MN (US)

(72) Inventors: Jeremy P. Jurmu, Buffalo, MN (US); Douglas S. Ryder, Buffalo, MN (US); Quincy A. Kesti, Lehi, UT (US); Robert J. Gundersen, Otsego, MN (US); Jeromy D. Horning, Albertville, MN (US); Steve J. Wrobel, Rogers, MN (US); Chad R. Taszarek, Albertville, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/877,405

(22) Filed: Jul. 29, 2022

(65) Prior Publication Data

US 2022/0362790 A1 Nov. 17, 2022

Related U.S. Application Data

(62) Division of application No. 16/560,382, filed on Sep. 4, 2019, now Pat. No. 11,406,995.

(Continued)

(51) Int. Cl.
*B05B 7/12* (2006.01)
*B05B 7/04* (2006.01)

(52) U.S. Cl.
CPC ..... *B05B 7/1209* (2013.01); *B05B 7/0416* (2013.01)

(58) Field of Classification Search
CPC ..... B05B 7/02; B05B 7/0416; B05B 7/12; B05B 7/1209; B05B 7/1245

(Continued)

(56) References Cited

U.S. PATENT DOCUMENTS 2,789,756 A 4/1957 Allen
2,820,672 A 1/1958 Lee et al.

(Continued)

FOREIGN PATENT DOCUMENTS

CN 2112454 U 8/1992
CN 201558765 U 8/2010

(Continued)

OTHER PUBLICATIONS

Extended European Search Report for EP Application No. 19205823.8, dated Jun. 17, 2020, pp. 8.

(Continued)

*Primary Examiner* — Jason J Boeckmann
(74) *Attorney, Agent, or Firm* — Kinney & Lange, P.A.

(57) ABSTRACT

A spray gun includes a gun body and valves configured to control flow of material and air through the gun body. A trigger is mounted to the gun body and is disposed relative to the valves such that the trigger actuates the valves in sequence to begin air flow and material flow. A sensor senses when the trigger is in an actuated state and the sensor causes a pump to begin pumping material to the spray gun. Release of the trigger causes the trigger to leave the actuated state. A detent mechanism holes the trigger in a detent state intermediate the actuated state and a resting state. The sensor does not sense the trigger with the trigger in the detent state. The trigger maintains the valves open with the trigger in the detent state.

11 Claims, 23 Drawing Sheets

Related U.S. Application Data

(60) Provisional application No. 62/814,939, filed on Mar. 7, 2019, provisional application No. 62/797,047, filed on Jan. 25, 2019.

(58) Field of Classification Search
USPC ..... 239/525, 526; 251/89, 101, 102, 106
See application file for complete search history.

(56) References Cited

U.S. PATENT DOCUMENTS

| | | | | |
|---|---|---|---|---|
| 3,780,953 | A | 12/1973 | Malec | |
| 3,841,555 | A | 10/1974 | Lilja | |
| 3,844,487 | A | 10/1974 | Malec | |
| 3,893,621 | A | 7/1975 | Johnson | |
| 4,166,579 | A | 9/1979 | Beise et al. | |
| 4,925,101 | A | 5/1990 | Konieczynski et al. | |
| 5,156,340 | A | 10/1992 | Lopes | |
| 5,228,842 | A | 7/1993 | Guebeli et al. | |
| 5,263,789 | A | 11/1993 | Torntore et al. | |
| 5,318,314 | A | 6/1994 | Cyphers et al. | |
| 5,375,766 | A | 12/1994 | Sweeney | |
| 5,435,697 | A | 7/1995 | Guebeli et al. | |
| 5,441,297 | A | 8/1995 | Krohn et al. | |
| 5,538,402 | A | 7/1996 | McKenney | |
| 5,570,839 | A | 11/1996 | Kukesh | |
| 5,618,001 | A | 4/1997 | Del et al. | |
| 5,718,534 | A | 2/1998 | Neuling | |
| 5,803,313 | A | 9/1998 | Flatt et al. | |
| 6,415,958 | B1 * | 7/2002 | Donley | B05B 12/002 222/146.5 |
| 6,484,782 | B1 | 11/2002 | Lewis et al. | |
| 6,651,910 | B2 | 11/2003 | Elliott-Moore | |
| 6,889,582 | B2 * | 5/2005 | Wilhelm | B25B 23/0035 81/177.85 |
| 7,114,664 | B2 | 10/2006 | Gundersen et al. | |
| 7,604,246 | B2 | 10/2009 | Sodemann et al. | |
| 7,926,740 | B2 | 4/2011 | Parris et al. | |
| 8,113,795 | B1 | 2/2012 | Vanell | |
| 8,512,642 | B2 | 8/2013 | Fujio | |
| 8,651,397 | B2 | 2/2014 | Gaddis et al. | |
| 9,327,308 | B2 | 5/2016 | Choiniere et al. | |
| 2006/0102745 | A1 | 5/2006 | Dexter | |
| 2010/0014908 | A1 | 1/2010 | Campbell et al. | |
| 2010/0206964 | A1 | 8/2010 | Li et al. | |
| 2011/0079321 | A1 | 4/2011 | Mattson | |
| 2014/0263699 | A1 | 9/2014 | Hedger et al. | |
| 2015/0060579 | A1 | 3/2015 | Myers et al. | |
| 2015/0197261 | A1 | 7/2015 | Moore et al. | |
| 2016/0114823 | A1 | 4/2016 | Moore et al. | |
| 2016/0129460 | A1 | 5/2016 | Moore et al. | |
| 2016/0375453 | A1 * | 12/2016 | Tullney | B05B 9/01 239/1 |
| 2017/0252771 | A1 | 9/2017 | Young | |
| 2018/0050361 | A1 | 2/2018 | Gehrung | |
| 2018/0111146 | A1 | 4/2018 | Strong | |

FOREIGN PATENT DOCUMENTS

| | | | |
|---|---|---|---|
| CN | 102580878 | A | 7/2012 |
| CN | 102941177 | A | 2/2013 |
| CN | 203508251 | U | 4/2014 |
| CN | 104084331 | A | 10/2014 |
| CN | 204093624 | U | 1/2015 |
| CN | 104437924 | A | 3/2015 |
| CN | 104941836 | A | 9/2015 |
| CN | 104941842 | A | 9/2015 |
| CN | 105312174 | A | 2/2016 |
| CN | 105377447 | A | 3/2016 |
| CN | 105413978 | A | 3/2016 |
| CN | 105880064 | A | 8/2016 |
| CN | 205926087 | U | 2/2017 |
| CN | 106890739 | A | 6/2017 |
| CN | 206315942 | U | 7/2017 |
| CN | 106996182 | A | 8/2017 |
| CN | 206382150 | U | 8/2017 |
| CN | 107377254 | A | 11/2017 |
| CN | 107923388 | A | 4/2018 |
| CN | 211801729 | U | 10/2020 |
| WO | 2016095988 | A1 | 6/2016 |
| WO | 2017025138 | A1 | 2/2017 |

OTHER PUBLICATIONS

Extended European Search Report for EP Application No. 19205829.5, dated Jun. 26, 2020, pp. 11.
First Chinese Office Action for CN Application No. 2019111003400, dated Mar. 10, 2021, pp. 27.
First Chinese Office Action for CN Application No. 2019111270505, dated Feb. 26, 2021, pp. 12.
Second Chinese Office Action for CN Application No. 2019111003400, dated Sep. 26, 2021, pp. 22.
Second Chinese Office Action for CN Application No. 201911127050.5, dated Jan. 20, 2022, pp. 15.
Communication Pursuant to Article 94(3) EPC for EP Application No. 19205823.8, dated Jun. 7, 2021, pp. 5, 5.
First Chinese Office Action for CN Application No. 202210694462.2, dated Apr. 12, 2023, pp. 32.

* cited by examiner

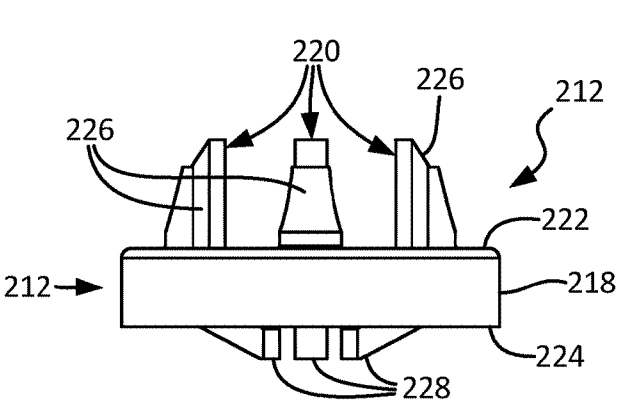
Fig. 16A
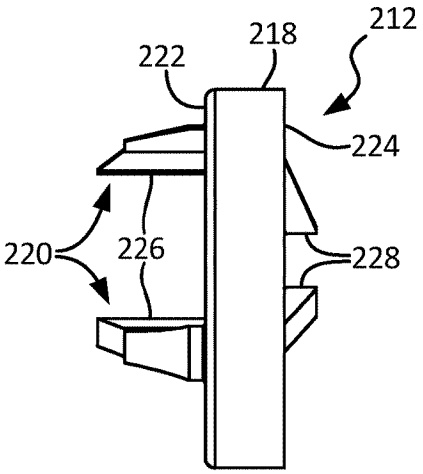
Fig. 16B
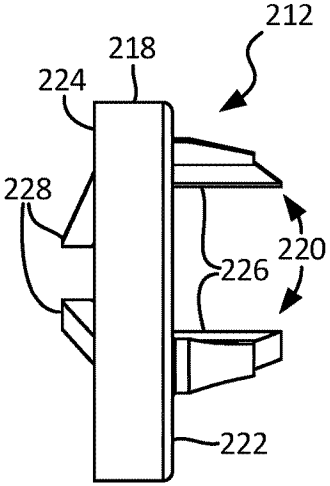
Fig. 16C
Fig. 16D
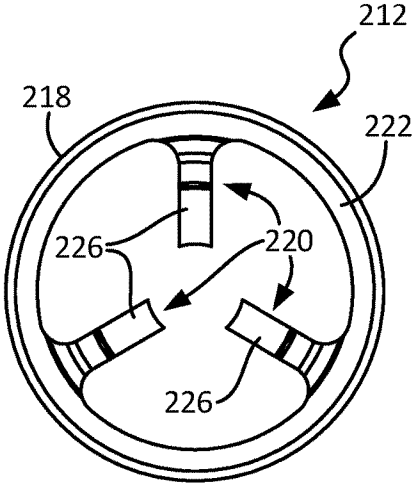
Fig. 16E

MATERIAL SPRAY GUN

CROSS-REFERENCE TO RELATED APPLICATION(S)

This application is a divisional of U.S. application Ser. No. 16/560,382 filed Sep. 4, 2019 for "MATERIAL SPRAY GUN," which claims the benefit of U.S. Provisional Application No. 62/797,047 filed Jan. 25, 2019 for "MATERIAL SPRAYER" and of U.S. Provisional Application No. 62/814,939 filed Mar. 7, 2019 for "MATERIAL SPRAYER," the disclosures of which are hereby incorporated by reference in their entireties.

BACKGROUND

The present disclosure relates generally to sprayers. More specifically, this disclosure relates to material sprayers.

Material sprayers are used to spray fluid to build up and/or cover surfaces such as walls and ceilings, with the fluid drying in place to form a solid material. The sprayed fluids are typically viscous and can include plaster, aggregate (e.g., polystyrene or vermiculite), wall and ceiling texture materials, joint compounds, surfacing materials, acrylic materials, textured elastomeric materials, and coating materials (e.g., anti-skid floor coating materials). Material for the sprayer is typically supplied in bags or buckets, mixed with water if necessary, fed into the sprayer, placed under pressure by a pump of the sprayer, and then sprayed from a gun or other spray outlet.

SUMMARY

According to one aspect of the disclosure, a material sprayer includes a hopper module and a power module. The hopper includes a hopper module and a power module. The hopper module includes a hopper frame and a hopper supported by the hopper frame. The power module is mountable and dismountable from the hopper frame. The power module includes a drive and a pump connected to and configured to be powered by the drive. The pump includes a pump inlet configured to interface with the hopper with the power module mounted on the hopper frame such that the pump can draw material from the hopper.

According to another aspect of the disclosure, a hopper module is for holding a supply of spray material and is configured to support any one of a plurality of power modules each having a pump of a plurality of pumps where each one of the plurality of pumps has a different pump size. The hopper module includes a hopper frame having a mounting portion configured to support any one of the plurality of power modules; a hopper supported by the hopper frame and configured to store the supply of spray material; wherein the hopper frame is extendable between the mounting portion and an outlet of the hopper to accommodate the plurality of pumps having different pump sizes.

According to yet another aspect of the disclosure, a power module is for mounting on a hopper module, the hopper module including a hopper frame having a mounting portion and extendable to accommodate power modules of varying lengths and a hopper supported by the hopper frame. The power module includes a power module frame; a plurality of power module wheels attached to the power module frame; a drive disposed on the power module frame; and a pump extending from the drive, the pump including a pump inlet configured to interface with an outlet of the hopper such that the pump can draw material from the hopper. The power module is mountable and dismountable from the hopper frame. The plurality of power module wheels support the power module on a ground surface when the power module is dismounted from the hopper frame and the plurality of power module wheels are spaced from and not in contact with the ground surface when the power module is mounted on the hopper frame.

According to yet another aspect of the disclosure, a method includes mounting a first power module having a first pump of a first length on a horizontal portion of a hopper frame of a hopper module such that the first power module is fully supported relative to a ground surface by a movable frame portion of the horizontal portion; attaching the first pump to a hopper of the hopper module such that a first pump inlet of the first pump is fluidly connected to the hopper module to receive spray material from the hopper module; detaching the first pump from the hopper; dismounting the first power module from the hopper module by pulling the first power module away from the hopper and off of the movable frame position; adjusting a length of the horizontal portion of the hopper frame by shifting a position of the movable frame portion relative to a fixed frame portion of the horizontal portion; and mounting a second power module having a second pump of a second length on the movable frame portion such that the second power module is fully supported relative to the ground surface by the hopper frame.

According to yet another aspect of the disclosure, a spray gun for a material sprayer configured to spray material output by a pump to the spray gun includes a gun body having a material pathway extending through the gun body to provide material to a spray nozzle and an air pathway extending through the gun body to provide air to the spray nozzle; a material flow valve disposed at least partially in the gun body and configured to control flow of material through the material pathway to the nozzle; a trigger pivotably mounted to the gun body and configured to actuate the material flow valve between a first open state and a first closed state and to actuated the air flow valve between a second open state and a second closed state; and a sensor associated with the trigger and configured to sense the trigger being in an actuated state. The trigger is disposed relative to the material flow valve and the sensor such that shifting the trigger in a first direction through a first pull range from a non-actuated state to a first intermediate state causes the material flow valve to shift to the first open state and such that shifting the trigger in the first direction through a second pull range from the first intermediate state to the actuated state causes the sensor to cause activation of the pump based on the sensor sensing the trigger being in the actuated state. Release of the trigger through a second direction, opposite the first direction, causes the trigger to shift from the actuated state to the first intermediate state, where the material flow valve is open and the sensor stops sensing the trigger and causes deactivation of the pump, prior to the trigger shifting to the non-actuated state where the material flow valve is in the first closed state.

According to yet another aspect of the disclosure, a spray gun for a material sprayer configured to spray material output by a pump to the spray gun includes a gun body having a material pathway extending through the gun body to provide material to a spray nozzle and an air pathway extending through the gun body to provide air to the spray nozzle; a trigger pivotably mounted to the gun body and configured to actuate a valve controlling flow of material through the material pathway between a first open state and a first closed state, wherein the trigger is configured to shift in a first direction from a non-actuated state to a first intermediate state, the valve being in the first open state with the trigger in the first intermediate state, and then to an actuated state, and wherein the trigger is configured to shift in a second direction, opposite the first direction, from the actuated state, to the first intermediate state, and then to the non-actuated state; a sensor associated with the trigger and configured to sense the trigger being in the actuated state, wherein the sensor is configured to cause activation of the pump based on the sensor sensing the trigger in the actuated state; and a detent mechanism configured to arrest movement of the trigger in the second direction at a detent position intermediate the actuated state and the non-actuated state on release of the trigger from the actuated state such that release of the trigger from the actuated state does not cause the trigger to automatically return to the non-actuated state.

According to yet another aspect of the disclosure, a method includes pulling a trigger of a material spray gun in a first direction through a first pull range from a non-actuated position thereby opening a material flow valve of the material spray gun; pulling the trigger in the first direction through a second pull range in addition to the first pull range and to an actuated position; generating, by a sensor, a spray activation signal based on the sensor sensing the trigger being in the actuated position; and activating a pump based on the spray activation signal, the pump driving material to the material spray gun.

According to yet another aspect of the disclosure, a pump includes a cylinder; a piston configured to reciprocate within the cylinder along a pump axis; a check valve disposed at an upstream end of the pump, the check valve including a ball guide. The ball guide includes an outer ring; and a plurality of radially inwardly projecting guides.

BRIEF DESCRIPTION OF THE DRAWINGS

FIG. 16A is a first side elevation view of a ball guide.

FIG. 16B is a second side elevation view of a ball guide.

FIG. 16C is a top elevation view of a ball guide.

FIG. 16D is a third side elevation view of a ball guide.

FIG. 16E is a bottom elevation view of a ball guide.

DETAILED DESCRIPTION

Figure 1:
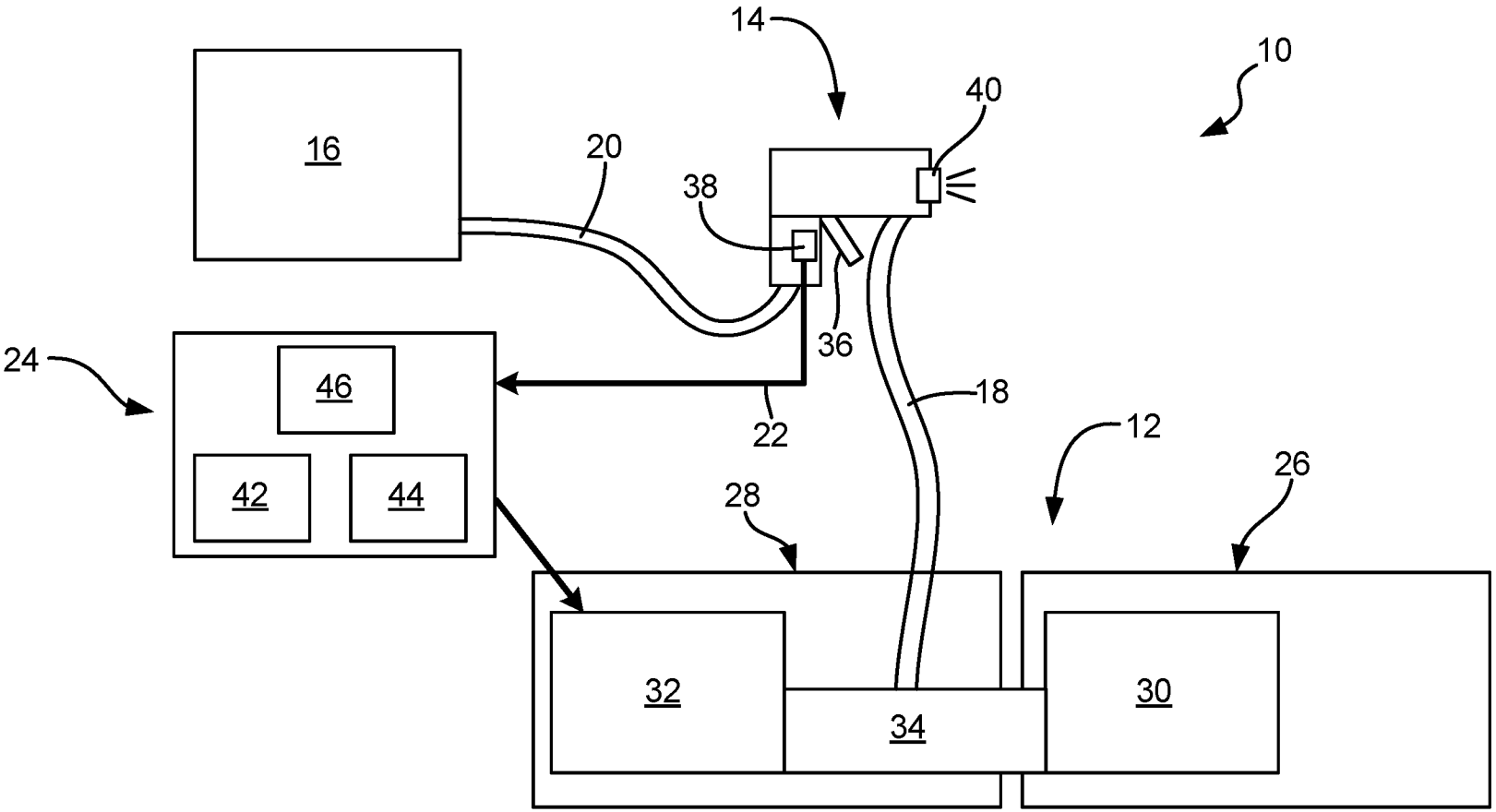
FIG. 1 is a schematic block diagram of a spray system.

FIG. 1 is a schematic block diagram of spray system 10. Spray system 10 includes spray module 12, spray gun 14, air source 16, spray hose 18, air hose 20, signal line 22, and control module 24. Spray module 12 includes hopper module 26 and power module 28. Hopper module 26 includes hopper 30. Power module 28 includes drive 32 and pump 34. Spray gun 14 includes trigger 36, sensor 38, and nozzle 40. Control module 24 includes control circuitry 42, memory 44, and user interface 46.

Spray system 10 is configured to spray fluid to build up a coating and/or cover surfaces, such as walls and ceilings, with the fluid drying in place to form a solid material. The sprayed materials are typically viscous and can include plaster, aggregate (e.g., polystyrene or vermiculite), wall and ceiling texture materials, joint compounds, surfacing materials, acrylic materials, textured elastomeric materials, and coating materials (e.g., anti-skid floor coating materials).

Hopper module 26 is rigidly connected to power module 28. Hopper module 26 is configured to support power module 28 with power module 28 mounted on hopper module 26. Power module 28 can be dismounted from hopper module 26 and connected to a different hopper module 26 to spray material from that other hopper module 26.

Hopper 30 is configured to store a supply of material from spraying. Hopper 30 is supported by a frame of hopper module 26. Power module 28 is configured to draw the material out of hopper 30 and drive the material under pressure to spray gun 14. Drive 32 is supported by a frame of power module 28. Pump 34 is operatively connected to drive 32 and is both fluidly and mechanically connected to hopper 30. Pump 34 can be dismounted from hopper when power module 28 is dismounted from hopper module 26.

Spray hose 18 extends from pump 34 to spray gun 14. Spray hose 18 conveys the spray material from spray module 12 to spray gun 14. Spray gun 14 is configured to eject the material as a spray out of nozzle 40. Air hose 20 extends from compressed air source 16 to spray gun 14. Air hose 20 conveys compressed air from compressed air source 16 to spray gun 14. The compressed air mixes with the material in spray gun 14 and is ejected with the material through nozzle 40 to generate the material spray. Compressed air source 16 can be a tank of compressed air, an air compressor such as a piston compressor, a blower, or of any other type suitable for generating a flow of compressed air for spraying.

Sensor 38 is mounted to spray gun 14 and is configured to sense actuation of trigger 36 of spray gun 14. Sensor 38 generates a spray signal based on sensor 38 sensing that trigger 36 of spray gun 14 has been actuated to an actuated state, as discussed in more detail herein. Sensor 38 sends the spray signal to control module 24 to cause control module 24 to activate drive 32, thereby causing drive 32 to power pump 34. Signal line 22 extends from spray gun 14 to control module 24 and is configured to provide a communicative link between sensor 38 and control module 24. It is understood that signal line 22 can be a wired or wireless connection. Sensor 38 can be of any type suitable for sensing actuation of spray gun 14. For example, sensor 38 can include a Reed-switch, a linear transducer, or any other type of sensor suitable for sensing actuation of trigger 36 of spray gun 14. While sensor 38 is described as generated the spray signal based on trigger 36 being in an activated state, such that the spray signal is a start spray signal, it is understood that signal 38 can, in some examples, be configured to generate the spray signal based on trigger 36 not being in the activated state, such that the spray signal is a stop spray signal. The stop spray signal can cause control module 24 to decrease power to drive 36 and/or deactivate drive 36 such that pump 38 does not drive material to spray gun 14.

Control module 24 is configured to control spraying by spray system 10. Control module 24 can activate drive 32 based on control module 24 receiving the start spray signal from sensor 38. Activating drive 32 causes drive 32 to power pump 34. Pump 34 pumps the material from hopper 30 through spray hose 18 to spray gun. Control module 24 can deactivate drive 32 based on sensor 38 generating the stop spray signal and/or based on sensor 38 no longer sending the start spray signal. For example, sensor 38 can generate the stop spray signal based on sensor 38 no longer sensing trigger 36 in the actuated state. In some examples, sensor 38 is configured to continuously generate the start spray signal based on trigger 36 being in the actuated state. Control module 24 can deactivate drive 32 based on control module 24 not receiving the start spray signal.

Control module 24 can be of any configuration suitable for controlling operation of components of spray system 10, gathering data, processing data, etc. Control module 24 can include control circuitry 42 and memory 44. In some examples, control module 24 can be implemented as a plurality of discrete circuity subassemblies. In some examples, control module 24 can be integrated into power module 28. In some examples, memory 44 can be encoded with instructions that, when executed by control circuitry 42, cause control circuitry 42 to control spraying by spray system 10.

Control circuitry 42 is configured to implement functionality and/or process instructions. Control circuitry 42 can include one or more processors, configured to implement functionality and/or process instructions. For example, control circuitry 42 can be capable of processing instructions stored in memory 44. Examples of control circuitry 42 can include any one or more of a microprocessor, a controller, a digital signal processor (DSP), an application specific integrated circuit (ASIC), a field-programmable gate array (FPGA), or other equivalent discrete or integrated logic circuitry.

Memory 44, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, memory 44 is a temporary memory, meaning that a primary purpose of memory 44 is not long-term storage. Memory 44, in some examples, is described as volatile memory, meaning that memory 44 does not maintain stored contents when power to spray system 10 is turned off. Examples of volatile memories can include random access memories (RAM), dynamic random access memories (DRAM), static random access memories (SRAM), and other forms of volatile memories. In some examples, memory 44 is used to store program instructions for execution by control circuitry 42. Memory 44, in one example, is used by software or applications running on control circuitry 42 to temporarily store information during program execution.

Memory 44, in some examples, also includes one or more computer-readable storage media. Memory 44 can be configured to store larger amounts of information than volatile memory. Memory 44 can further be configured for long-term storage of information. In some examples, memory 44 includes non-volatile storage elements. For example, spray system 10 can include non-volatile storage elements such as flash memories or forms of electrically programmable memories (EPROM) or electrically erasable and programmable (EEPROM) memories.

User interface 46 can be any graphical and/or mechanical interface that enables user interaction with control module 24. For example, user interface 46 can implement a graphical user interface displayed at a display device of user interface 46 for presenting information to and/or receiving input from a user. User interface 46 can include graphical navigation and control elements, such as graphical buttons or other graphical control elements presented at the display device. User interface 46, in some examples, includes physical navigation and control elements, such as physically-actuated buttons or other physical navigation and control elements. In general, user interface 46 can include any input and/or output devices and control elements that can enable user interaction with control module 24. In some examples, user interface 46 can be remote from and communicatively linked, via wired or wireless connections, to other components of control module 24.

During operation, spray module 12 provides material to spray gun 14 for application on a surface. Compressed air source 16 provides compressed air to spray gun 14. The material and compressed air are mixed in spray gun 14 and ejected from nozzle 40 as a material spray.

The user activates spray gun 14 by actuating trigger 36 of spray gun 14 to an actuated position. For example, the user can pull trigger 36 from a non-actuated position to the actuated position. As discussed in more detail herein, actuating trigger 36 to an actuated position opens both an air flowpath through spray gun 14 to nozzle 40 and a material flowpath through spray gun 14 to nozzle 40. Sensor 38 senses trigger 36 in the actuated position and generates the spray signal based on the sensed position of trigger 36. Control module 24 causes drive 32 to activate based on control module 24 receiving the spray signal from sensor 38.

Drive 32 powers pump 34. Pump 34 draws material from hopper 30 and pumps the material through spray hose 18 to spray gun 14. The material combines with air from compressed air source 16 and is ejected through nozzle 40 as a material spray.

The user releases trigger 36 to stop spraying. Sensor 38 senses that trigger 36 is no longer in the actuated position. Control module 24 causes drive 32 to deactivate based on sensor 38 sensing that trigger 36 is no longer in the actuated position. For example, control module 24 can deactivate drive 32 based on control module 24 no longer receiving the start spray signal from sensor 38 and/or based on control module 24 receiving a stop spray signal from sensor 38.

With drive 32 deactivated, drive 32 no longer powers pump 34. As such, pump 34 does not pump the material to spray gun 14. However, the components of pump 34 can have sufficient inertia to continue through at least a portion of a pump stroke when drive 32 is deactivated. This can cause pressure to build in spray hose 18. To prevent undesired pressure build-up, the material valve of spray gun 14, which controls the flow of the material to nozzle 40, can be maintained in an open state even when trigger 36 is released. For example, trigger 36 can be prevented from shifting directly to the non-actuated position, where both the material valve and air valve in spray gun 14 are closed, from the actuated position.

Trigger 36 can be held in an intermediate, detent position between the actuated position and the non-actuated position, as discussed in more detail further herein. In the detent position, trigger 36 is partially, but not fully, actuated such that trigger 36 maintains both the material valve and the air valve in respective open states. However, trigger 36 is far enough from the actuated position that sensor 38 does not generate the start spray signal when trigger 36 is in the detent state. As such, with trigger 36 in the detent state compressed air continues to flow through spray gun 14 and out of nozzle 40 even while drive 32 is deactivated. The material valve remains open with trigger 36 in the detent state to allow material to continue to flow into spray gun 14 from spray hose 18, such as due to the inertia of the components of pump 34. The compressed air blows any excess material out through nozzle 40 of spray gun 14, preventing undesired material buildup in spray gun 14. Trigger 36 can be released from the detent state by actuating a detent mechanism, as discussed further herein. Releasing trigger 36 from the detent state allows trigger 36 to return to the non-actuated state, thereby closing both the material valve and the air valve and stopping the flows of both material and air out of nozzle 40.

Figure 2:
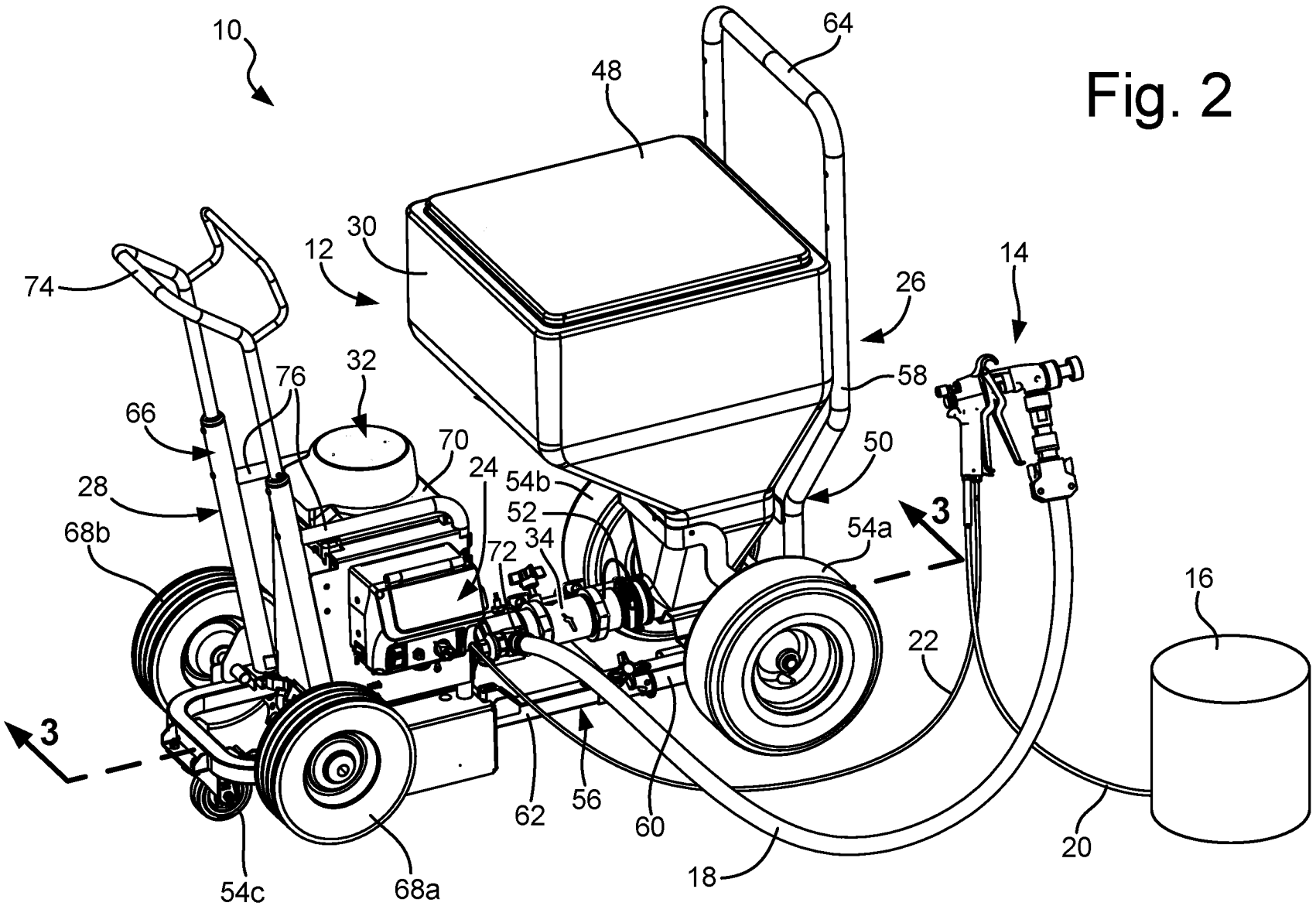
FIG. 2 is an isometric view of a spray system.

FIG. 2 is an isometric view of spray system 10. Spray system 10 includes spray module 12, spray gun 14, air source 16, spray hose 18, air hose 20, signal line 22, and control module 24. Spray module 12 includes hopper module 26 and power module 28. Hopper module 26 includes hopper 30, lid 48, hopper frame 50, coupling 52, and wheels 54*a*-54*c*. Hopper frame 50 includes horizontal portion 56 and vertical portion 58. Horizontal portion 56 includes fixed frame portion 60 and movable frame portion 62. Vertical portion 58 includes hopper module handle 64. Power module 28 includes drive 32, pump 34, power frame 66, and wheels 68*a*, 68*b*. Drive housing 70 of drive 32 is shown. Pump outlet 72 of pump 34 is shown. Power frame 66 includes power module handle 74 and brackets 76.

Spray system 10 is configured to spray thick material, such as fluid containing aggregate, on walls and other surfaces. Spray module 12 is configured to store a supply of material, pressurize the material, and output the pressurized material to spray gun 14 for spraying. Power module 28 is separable from the hopper module 26. In the configuration shown in FIG. 2, power module 28 is rigidly connected to hopper module 26.

Spray gun 14 is fluidly connected to spray system 10 by spray hose 18 that extends to spray gun 14 from pump outlet 72 of pump 34. Spray gun 14 is also fluidly connected to compressed air source 16 by air hose 20 that extends to spray gun 14 from compressed air source 16. Compressed air source 16 can be any type of source of compressed air, including a tank of compressed air, a piston compressor, or a blower, amongst other types of sources of compressed air.

Hopper frame 50 supports the various components of hopper module 26. Hopper frame 50 can be a rigid metal tubular structure on which some or all of the components of the hopper module 26 are connected and/or are supported. In the example shown, hopper frame 50 includes vertical portion 58 and horizontal portion 56. Hopper module handle 64 is disposed at a distal end of vertical portion 58 opposite an end of vertical portion 58 connected to horizontal portion 56. A user can grip hopper module handle 64 to push and/or pull and otherwise maneuver hopper module 26 and power module 28 to the extent power module 28 is connected to hopper module 26. Movable frame portion 62 is mounted to fixed frame portion 60. The position of movable frame portion 62 relative to fixed frame portion 60 can be changed to alter a length of horizontal portion 56 such that hopper module 26 can accommodate power modules 28 of varying sizes.

Wheels 54*a*-54*c* are attached to hopper frame 50 and support hopper module 26 relative to a ground surface. Wheels 54*a*, 54*b* are located at one end of hopper frame 50, located on respective lateral sides of hopper frame 50, while wheel 54*c* is located at the opposite end of hopper frame 50 from wheels 54*a*, 54*b*. Wheel 54*c* is further located in the lateral middle of hopper frame 50. In some examples, wheels 54*a*, 54*b* are inflated tires while wheel 54*c* is a non-inflated caster. It is understood, however, that wheels 54*a*-54*c* can be of any type suitable for supporting hopper module 26, and components of power module 28 when power module 28 is mounted to hopper module 26, relative to the ground surface. Wheels 54*a*, 54*b* can have larger diameters than wheel 54*c* and larger diameters than wheels 68*a*, 68*b*.

Hopper 30 is disposed on and supported by hopper frame 50. Lid 48 is located on the top of hopper 30 to enclose and seal the interior space within hopper 30. Lid 48 can help prevent contamination of the material stored in hopper 30 from the environment and/or prevent drying of the material within hopper 30 over long periods. Gravity urges material within hopper 30 to a hopper outlet located proximate a bottom of hopper 30. The material is drawn out from the bottom outlet of the hopper 30 by pump 34.

Power frame 66 supports the various components of power module 28. When power module 28 is mounted to hopper module 26, power frame 66 rests on, and is supported by, hopper frame 50. Power frame 66 can be a rigid metal tubular structure on which some or all of the components of the power module 28 are connected to and/or supported by. Power frame 66 supports the components of the power module 28, such that power frame 66 resting on hopper frame 50 means that the entirety of power module 28 rests on and is supported by hopper frame 50. Power module 28 includes wheels 68*a*, 68*b*. Wheels 68*a*, 68*b* are located on opposite lateral sides of power frame 66. In the example shown, wheels 68*a*, 68*b* are inflated rubber tires, but it is understood that wheels 68*a*, 68*b* can be of any type suitable for supporting power module 28 relative a surface and for traversing power module 28 relative to that ground surface. Power module handle 74 extends from a top end of a vertical portion of power frame 66. A user can grip power module handle 74 to push and/or pull and otherwise maneuver power module 28 with power module 28 dismounted from hopper module 26. Power module handle 74 is adjustably mounted to power frame 66 such that the user can adjust the relative height of power module handle 74.

Drive 32 is disposed on and supported by power frame 66. Brackets 76 extend from opposing arms forming power frame 66 and around drive housing 70. Brackets 76 are disposed on opposite lateral sides of drive housing 70 to secure drive 32 on power frame 66. Drive housing 70 is supported by power frame 66. As further explained herein, drive housing 70 encloses various components of drive 32 that power pump 34. Control module 24 can be integrated into power module 28 to control operation of components of spray module 12. Signal line 22 extends between spray gun 14 and control module 24 and provides a communicative link between spray gun 14 and control module 24. Control module 24 includes any one or more of circuitry, processors, memory, power regulators, and/or any other component for performing any of the control functions described herein.

Pump 34 extends from drive 32 to hopper 30. Pump 34 can be fixed to, and part of, power module 28. An inlet end of pump 34 is connected to hopper module 26 by coupling 52. Coupling 52 fixes the inlet end of pump 34 to the outlet of hopper 30. Coupling 52 can be of any configuration suitable for securing pump 34 relative to hopper 30. For example, coupling can be a worm gear clamp, among other options. Pump 34 draws material from hopper 30, places the material drawn from hopper 30 under pressure, and outputs the material to spray gun 14 through pump outlet 72. The material is pumped through spray hose 18 to spray gun 14. Triggering of spray gun 14 controls release of the material under pressure from spray gun 14 for spraying surfaces.

Figure 3:
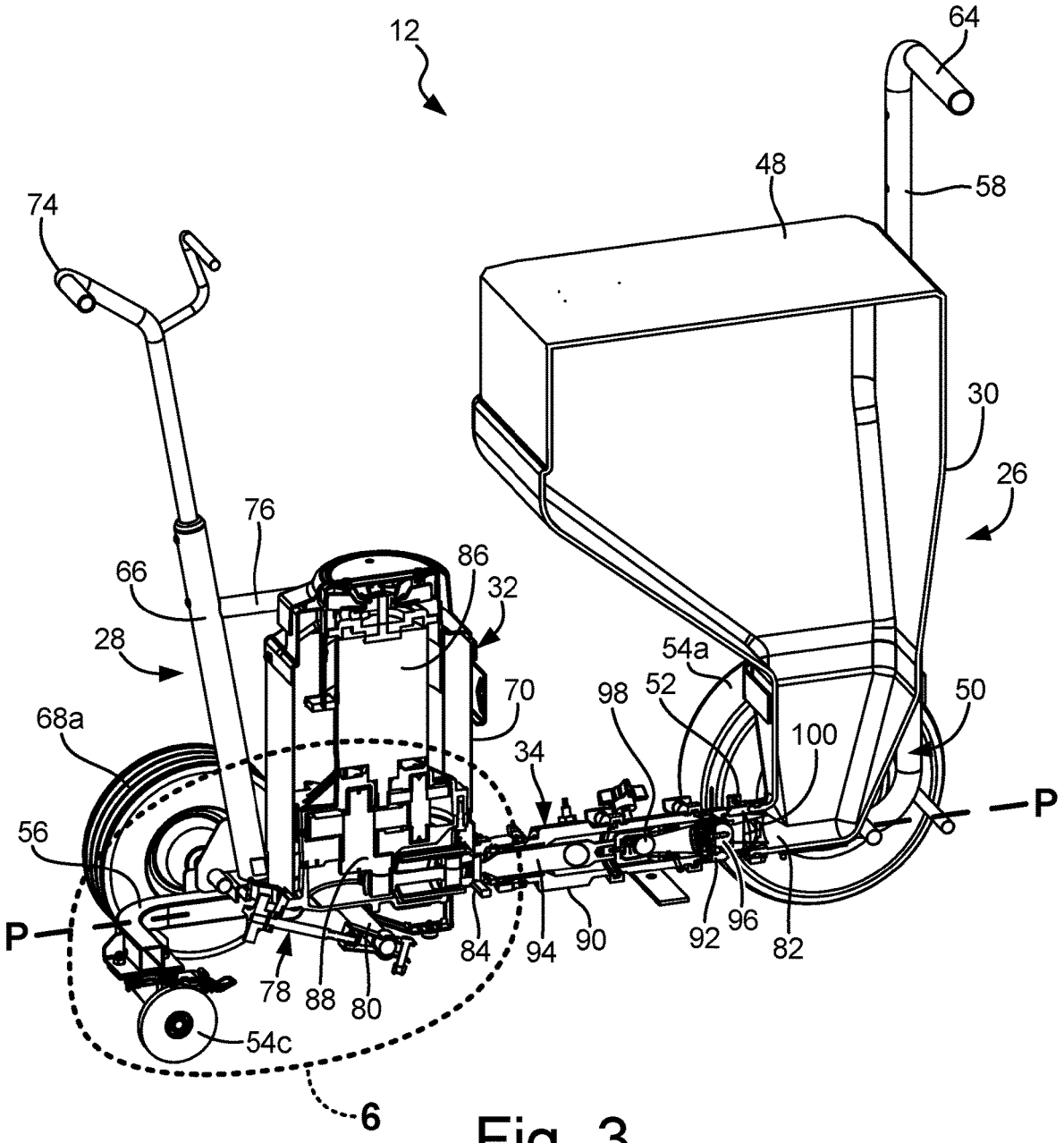
FIG. 3 is a cross-sectional view of a spray module taken along line 3-3 in FIG. 2.

FIG. 3 is a cross-sectional view of the spray module 12 taken along line 3-3 in FIG. 2. Spray module 12 includes hopper module 26 and power module 28. Hopper module 26 includes hopper 30, lid 48, hopper frame 50, coupling 52, and tie 78. Wheels 54*a* and 54*c* of hopper module 26 are also shown. Hopper frame 50 includes horizontal portion 56 and vertical portion 58. Cross-bar 80 of horizontal portion 56 is shown. Vertical portion 58 includes hopper module handle 64. Hopper 30 includes hopper outlet 82. Power module 28 includes drive 32, pump 34, power frame 66, wheels 68*a*, 68*b* (only wheel 68*a* is shown), and pump mount 84. Drive 32 includes drive housing 70, motor 86, and reciprocation mechanism 88. Cylinder 90, inlet housing 92, piston 94, inlet check valve 96, piston check valve 98, and pump inlet 100 of pump 34 are shown. Power frame 66 includes power module handle 74 and bracket 76.

Power module 28 is shown mounted on hopper module 26. Hopper 30 is supported by hopper frame 50. An interior space of hopper 30 is shown. Material is stored in the interior space of hopper 30 prior to spraying of the material. Lid 48 is disposed on hopper 30 and encloses the interior space of hopper 30. Hopper outlet 82 is disposed at a bottom of hopper 30 to receive the material from the interior space of hopper 30. Hopper outlet 82 is disposed at the bottom of hopper 30 such that gravity assists the flow of material to hopper outlet 82.

Drive 32 is mounted on power frame 66 of power module 28. Drive housing 70 is supported by power frame 66 and encloses various components of drive 32. Brackets 76 (only one of which is shown in FIG. 3) extend from power frame 66 and are disposed on opposite lateral sides of drive housing 70. Brackets 76 wrap around a front of drive housing 70. Brackets 76 secure drive housing 70 on power frame 66.

Motor 86 and reciprocation mechanism 88 are disposed in drive housing 70. Motor 86 is configured to power pump 34. Motor 86 can be of any type suitable for powering pump 34. For example, motor 86 can be a gas motor or an electric motor, among other options. In one example, motor 86 is an electric rotary motor (e.g., brushed or brushless) configured to convert electrical energy regulated by control module 24 (best seen in FIG. 1) into rotational motion. Reciprocation mechanism 88 is configured to receive the rotational output from motor 86 as an input and convert that input into a linear reciprocating output. Reciprocation mechanism 88 drives piston 94 of pump 34 in a linear reciprocating manner. Reciprocation mechanism 88 can be of any type suitable for converting a rotational input into a linear reciprocating output, such as a crank, scotch yoke, or wobble plate, among other options.

Pump 34 extends between drive 32 and hopper 30. A first end of pump 34 is mounted to hopper 30 at hopper outlet 82. Pump 34 is fluidly connected to hopper 30 at hopper outlet 82 such that pump 34 can draw material out of hopper 30 via hopper outlet 82. Coupling 52 is disposed around the end of pump 34 that extends into hopper outlet 82. Coupling 52 is configured as a removable attachment device. Coupling 52 is installed about the first end of pump 34 and hopper outlet 82 when power module 28 is mounted on hopper module 26. Coupling 52 mechanically secures pump 34 to hopper 30 to prevent undesired detachment during operation. Coupling 52 is loosened and/or removed when the user wants to dismount power module 28 from hopper module 26. Pump 34 can then be detached from hopper 30 by pulling power module 28 axially away from hopper 30.

Cylinder 90 is disposed between drive 32 and hopper 30 and supports various components of pump 34. Inlet housing 92 is mounted to an upstream end of cylinder 90, disposed closer to hopper 30. In some examples, inlet housing 92 is at least partially disposed within hopper outlet 82. In some examples, coupling 52 engages inlet housing 92 to secure pump 34 to hopper 30. Pump inlet 100 is disposed at an upstream end of inlet housing 92 and provides an opening for material from hopper 30 to enter pump 34. Piston 94 is at least partially disposed within cylinder. A first end of piston 94 extends out of cylinder 90 and is connected to reciprocation mechanism 88. Reciprocation mechanism 88 drives piston 94 is a reciprocating linear manner via the connection with the first end of piston 94. Piston 94 reciprocates within cylinder 90 to pump the material.

Inlet check valve 96 and piston check valve 98 control the flow of material through pump 34. Inlet check valve 96 is disposed within pump 34. Inlet check valve 96 is the check valve located furthest upstream within pump 34 (e.g., closest to hopper 30). Piston check valve 98 is disposed within piston 94. Piston check valve 98 is disposed within the second end of piston 94, located opposite the first, driven end of piston 94. As such, piston check valve 98 reciprocates within cylinder 90 with piston 94. Pump outlet 72 (best seen in FIG. 4) extends through cylinder 90 at a location downstream of piston check valve 98.

During operation, reciprocation mechanism 88 causes piston 94 to reciprocate along pump axis P-P through alternating suction and pumping strokes. During a suction stroke, piston 94 is pulled upstream towards drive 32. Pulling piston 94 towards drive 32 causes inlet check valve 96 to open and piston check valve 98 to close, thereby allowing flow downstream from hopper 30 and into cylinder 90 through inlet check valve 96. During a pumping stroke, piston 94 is pushed downstream within cylinder 90 towards hopper 30. Pushing piston 94 towards hopper 30 causes inlet check valve 96 to close and piston check valve 98 to open, thereby allowing flow downstream through piston check valve 98 and to pump outlet 72. While pump 34 is described as a piston pump, it is understood that pump 34 can be of any type suitable for pumping material under pressure from hopper 30 to spray gun 14 (best seen in FIGS. 9-10C). In the example shown, pump 34 is a double acting piston pump. As such, inlet check valve 96 and piston check valve 98 regulate flow from a generally upstream to downstream direction. More specifically, inlet check valve 96 and piston check valve 98 regulate flow from hopper outlet 82 to pump outlet 72 by allowing downstream flow but not allowing retrograde upstream flow as piston 94 reciprocates within cylinder 90 to drive the flow of material. Pump 34 can output material from pump outlet 72 during both the suction stroke and the pressure stroke.

The end of pump 34 opposite the end connected to hopper 30 is supported by power module 28. Pump 34 is mounted to power module 28 by pump mount 84, which can support pump 34 with respect to power frame 66 of power module 28. As discussed above, pump 34 can be disconnected from hopper module 26 by release of coupling 52. However, is intended that pump mount 84 is not so easily disconnected because pump mount 84 supports both a static connection and a dynamic connection between pump 34 and power module 28. The static connection is formed with cylinder 90 of pump 34, which must be kept stationary to ensure proper alignment on pump axis P-P. The dynamic connection is between drive 32 and piston 94. The dynamic connection causes reciprocation of piston 94 within and relative to cylinder 90.

Pump 34 is oriented horizontally. Horizontal portion 56 of hopper frame 50 is also oriented horizontally. As such, pump 34 can be disposed parallel to horizontal portion 56. Pump mount 84 supports pump 34 extending horizontally from drive housing 70 to hopper outlet 82. As such, pump mount 84 supports pump 34 in a cantilevered configuration with regard to drive 32 when power module 28 is dismounted from hopper module 26. As shown, pump 34 is orientated purely horizontally such that pump 34 is not orientated vertically. As such, pump axis P-P extends in a horizontal plane. Piston 94 reciprocates in a horizontal direction parallel with the ground surface and is not reciprocated in a vertical direction with respect to the ground surface. It is understood, however, that in various other embodiments, pump 34 can be orientated vertically or along other orientations. For example, pump 34 can be disposed such that pump axis P-P is at any angle between 0-degrees and +/−90-degrees relative to a horizontal axis.

Tie 78 is mounted to hopper module 26. Specifically, tie 78 is attached to cross-bar 80. Cross-bar 80 can extend between bars forming opposite lateral sides of horizontal portion 56 of hopper frame 50. Tie 78 is configured to secure and hold power module 28 on hopper module 26. Tie 78 can be actuated between a secured state, preventing axial movement of power module 28 relative to hopper module 26, and an unsecured state, where power module 28 can be pulled off of and separated from hopper module 26.

During operation, power module 28 draws material from hopper module 26 and drives the material to an applicator, such as spray gun 14. Motor 86 is activated, such as by control module 24, for example. Motor 86 generates a rotational output. Reciprocation mechanism 88 converts the rotational output from motor 86 into a linear reciprocating output of reciprocation mechanism 88. Reciprocation mechanism 88 drives piston 94 in a reciprocating manner along pump axis P-P. Piston 94 reciprocating within cylinder 90 draws the material out of hopper 30 through hopper outlet 82, drives the material downstream through inlet check valve 96 and piston check valve 98, and drive the material downstream out of cylinder 90 through pump outlet 72.

Coupling 52 mechanically secures pump 34 to hopper module 26. Pump mount 84 mechanically secures pump 34 to power module 28. With power module 28 disposed on and supported by hopper module 26, the user can maneuver spray module 12 to any desired location on the job site by pushing hopper module handle 64. Wheels 54*a*-54*c* support spray module 12 and allows the user to easily push spray module 12 to a new location. As discussed in more detail below, tie 78 can be placed in the unsecured state to allow power module 28 to be removed from hopper module 26. With power module 28 mounted on hopper module 26, pump 34 is mechanically and fluidly connected to hopper 30, and pump 34 is mechanically connected to drive 32 by both a static connection and a dynamic connection.

Figure 4:
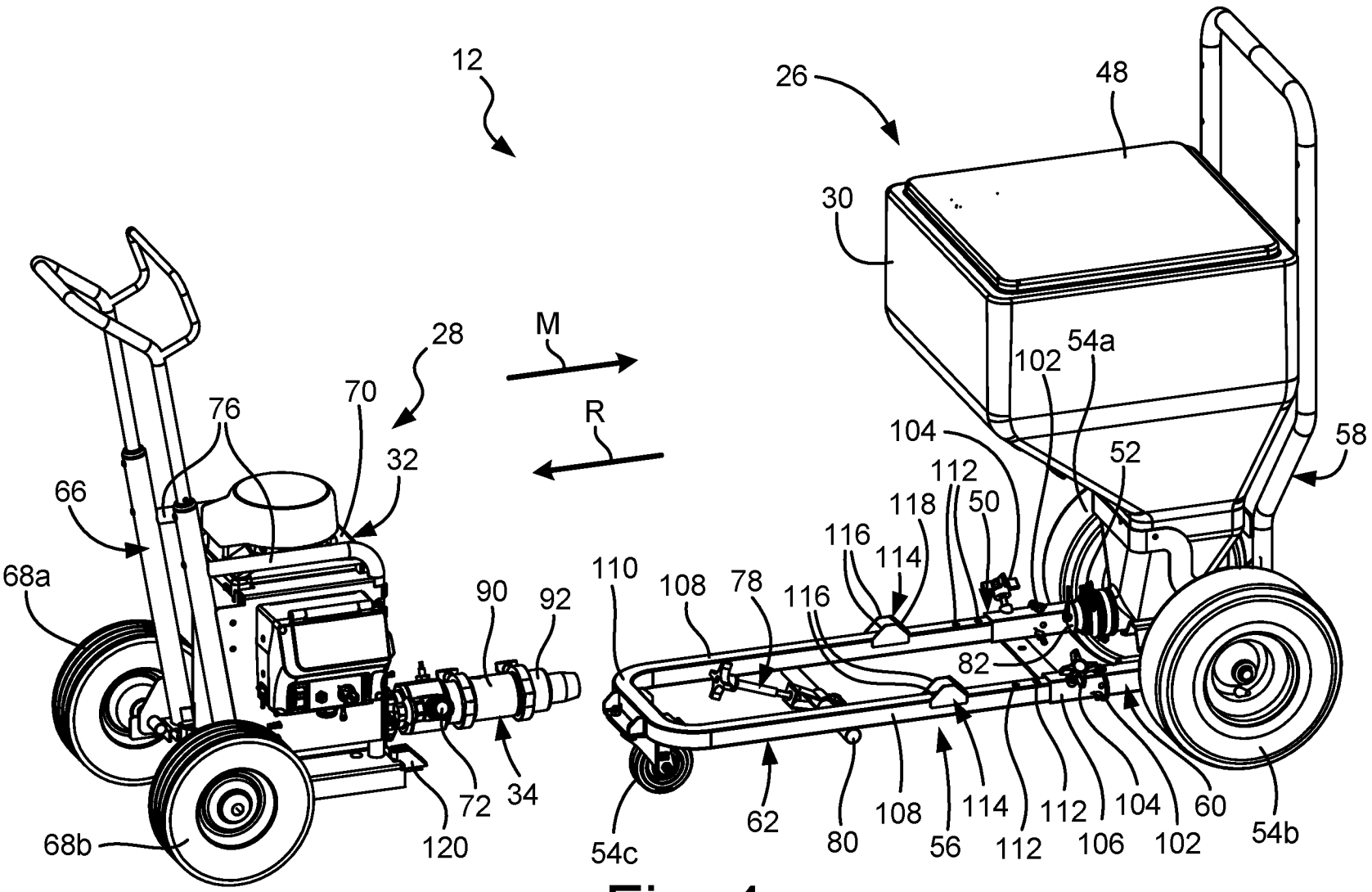
FIG. 4 is a partially exploded view of a spray module showing a power module dismounted from a hopper module.

FIG. 4 is a partially exploded view of spray module 12 showing power module 28 dismounted from hopper module 26. Hopper module 26 includes hopper 30, lid 48, hopper frame 50, coupling 52, wheels 54*a*-54*c*, tie 78, frame connectors 102, and clamps 104. Hopper outlet 82 of hopper 30 is shown. Hopper frame 50 includes horizontal portion 56 and vertical portion 58. Horizontal portion 56 includes fixed frame portion 60 and movable frame portion 62. Fixed frame portion 60 includes fixed frame arms 106. Movable frame portion 62 includes cross-bar 80, movable frame arms 108, and frame end 110. Each movable frame arm 108 includes movable arm holes 112 and shoes 114. Each shoe 114 includes side plates 116 and back plate 118. Power module 28 includes drive 32, pump 34, power frame 66, and wheels 68*a*, 68*b*. Drive housing 70 of drive 32 is shown. Cylinder 90, inlet housing 92, and pump outlet 72 of pump 34 are shown. Power frame 66 includes power module handle 74, brackets 76, and feet 120 (it is understood that the term foot 120 refers to the singular while the term feet 120 returns to the plural) (only one foot 120 is shown in FIG. 4).

Power module 28 is removably mountable on hopper module 26. To dismount power module 28, tie 78 is placed in an unsecured state and power module 28 is pulled in removal direction R relative to hopper module 26. To mount power module 28 to hopper module 26, power module 28 is pushed onto movable frame portion 62 in mounting direction M. With power module 28 removed, power module 28 and hopper module 26 can be separately maneuvered around a spray site. When power module 28 is mounted on horizontal portion 56 no part of power module 28, including wheels 68*a*, 68*b*, touches the ground surface. Rather, the whole of spray module 12 is supported by wheels 54*a*-54*c* of hopper module 26.

Hopper frame 50 supports the various components of hopper module 26. Hopper frame 50 also supports all components of power module 28 when power module 28 is mounted on hopper module 26. Hopper 30 is disposed on hopper frame 50. Lid 48 is disposed on hopper 30 and encloses the interior space of hopper 30. Hopper wheels 54*a*, 54*b* are disposed at a rear end of hopper module 26 proximate an intersection between vertical portion 58 and horizontal portion 56. Hopper module handle 64 is formed by a distal end of vertical portion 58. Horizontal portion 56 extends from vertical portion 58 and projects forward of hopper 30. Horizontal portion 56 is configured to support power module 28 when power module 28 is mounted on hopper module 26. Fixed frame portion of horizontal portion 56 is rigidly attached to the rest of hopper frame 50, including to hopper module handle 64. Horizontal potion 56 is horizontal with respect to the ground surface.

Fixed frame portion 60 extends from vertical portion 58 and is fixed relative to vertical portion 58. Fixed frame portion 60 includes fixed frame arms 106 disposed on opposite lateral sides of hopper module 26. Fixed frame arms 106 are hollow to receive movable frame arms 108 of movable frame portion 62. In some examples, fixed frame arms 106 are open only on the end that receives movable frame arms 108. Movable frame portion 62 extends from fixed frame portion 60. Movable frame arms 108 are disposed on opposite lateral sides of hopper module 26. Movable frame arms 108 extends into fixed frame arms 106 and are slidable within fixed frame arms 106. The distal ends of movable frame arms 108 are joined by frame end 110, which forms the distal end of movable frame portion 62. In the example shown, frame end 110 is a U-shaped bar, but it is understood can take any desired form suitable for extending between and connecting movable frame arms 108. Wheel 54*c* is mounted on frame end 110. In the example shown, movable frame arms 108 and frame end 110 are formed as a unitary assembly. For example, movable frame portion 62 can be formed from a single piece of bar stock. It is understood, however, that movable frame portion 62 can be formed from multiple parts joined in any desired manner, such as by welding, gluing, fastening, or by any other suitable joining manner.

The two parallel movable frame arms 108 of movable frame portion 62 fit within the hollow space of the two parallel fixed frame arms 106 of fixed frame portion 60. The two parallel movable frame arms 108 can move within the hollow spaces of the two parallel fixed frame arms 106 to extend or retract movable frame portion 62 relative to fixed frame portion 60. While movable frame arms 108 are shown as fitting within and moving within fixed frame arms 106, it is understood that movable frame arms 108 can have openings and be hollow and be sufficiently larger relative to fixed frame arms 106 such that fixed frame arms 106 extend into and are movable within movable frame arms 108 to extend or retract movable frame portion 62 relative to fixed frame portion 60. Movable frame arms 108 and fixed frame arms 106 can engage at a telescoping interface, with movable frame arms 108 disposed within fixed frame arms 106 or fixed frame arms 106 disposed within movable frame arms 108. While fixed frame arms 106 and movable frame arms 108 are shown as bars having square cross-sections, it is understood that circular, rectangular, and other cross-sectional shapes can instead be used. It is further understood that fixed frame arms 106 and movable frame arms 108 can have differing cross-sectional profiles.

Shoes 114 are disposed on each of movable frame arms 108. For each shoe 114, side plates 116 project vertically from opposite lateral sides of each movable frame arm 108. Back plate 118 extends between and connects side plates 116. Feet 120 project from power frame 66. Shoes 114 receive feet 120 between side plates 116 with power module 28 mounted on hopper module 26. Shoes 114 receiving feet 120 prevent power module 28 from rotating and/or otherwise shifting laterally with respect to hopper module 26. Shoes 114 also define the closest position of power module 28 to hopper module 26, thereby also defining the mounted position of power module 28 on hopper module 26. The axial distance between frame end 110 and shoes 114 is sized to receive drive 32. The axial distance between shoes 114 and hopper outlet 82 is adjustable to accommodate pumps 34 of various sizes.

Clamps 104 extend through fixed frame arms 106 and are configured to interface with movable frame arms 108 to further prevent relative movement between movable frame portion 62 and fixed frame portion 60. For example, clamps 104 can be threaded rods fit within threaded holes in fixed frame arms 106. Rotating the clamps 104 causes clamps 104 to extend into or out of the hollow space in fixed frame arms 106. Clamps 104 can exert a clamping force on movable frame arms 108 to further inhibit relative movement between movable frame portion 62 and fixed frame portion 60.

Movable frame portion 62 can be repositioned relative to fixed frame portion 60 to alter a length of horizontal portion 56. Changing the length of horizontal portion 56 allows a single hopper module 26 to accommodate and support power modules 28 having pumps 34 of differing lengths, as discussed further herein. To accommodate the different lengths of pumps 34, horizontal portion 56 is comprised of fixed frame portion 60 and movable frame portion 62. Fixed frame portion 60 is rigidly attached to the rest of hopper frame 50, such as the vertical portion 58 of hopper frame 50, hopper 30, and the axle of hopper wheels 54*a*, 54*b*. Movable frame portion 62 is movable relative to fixed frame portion 60. Movable frame portion 62 can be extended relative to fixed frame portion 60 to accommodate longer pumps 34 while movable frame portion 62 can be moved closer to or otherwise retracted relative to fixed frame portion 60 to accommodate shorter pumps 34. The position of power module 28 on movable frame portion 62 stays the same regardless of the degree of extension of movable frame portion 62 relative to fixed frame portion 60. For example, the position of power module 28 can be limited by the interface between shoes 114 and feet 120.

Movable arm holes 112 extend through movable frame arms 108 of movable frame portion 62. Movable arm holes 112 can be arrayed along the length of movable frame arms 108 of the movable frame portion 62. One or more complementary holes can also extend through fixed frame arms 106 of fixed frame portion 60. As such, fixed frame arms 106 can include holes that are spaced the same as movable arm holes 112 in movable frame portion 62. Frame connector 102 can be inserted through the holes of fixed frame portion 60 and movable arm holes 112 in movable frame portion 62 when the two holes are aligned. For example, frame connector 102 can be a pin that extends through the holes of fixed frame portion 60 and movable arm holes 112 of movable frame portion 62 to fix the position of movable frame portion 62 relative to fixed frame portion 60. In some examples, separate frame connectors 102 can be provided for each lateral set of fixed frame arm 106 and movable frame arm 108. For example, a first frame connector 102 can join a first one of the fixed frame arms 106 and a first one of the movable frame arms 108 and a second frame connector 102 can join a second one of the fixed frame arms 106 and a second one of the movable frame arms 108. The frame connectors 102 extending through and connecting fixed frame portion 60 and movable frame portion 62 prevents movement of movable frame portion 62 relative to the fixed frame portion 60. Frame connectors 102 can be removed from the holes in fixed frame arms 106 and movable arm holes 112 in movable frame arms 108 to allow relative movement between movable frame portion 62 and fixed frame portion 60.

The complementary holes spaced along fixed frame portion 60 and movable frame portion 62 are configured to align at relative positions corresponding to the appropriate spacing for pump inlet 100 (FIG. 3) on the end of pump 34 to interface with hopper outlet 82 of hopper 30. For example, a first hole of the fixed frame portion 60 can be aligned with a first hole of movable frame portion 62 and when these first holes are aligned (permitting frame connector 102 to be extended through the holes) the gap between drive housing 70 and hopper 30 is sized such that a first version of pump 34 (e.g., a short length version) fits between drive housing 70 and hopper 30 and such that pump inlet 100 on the end of that first pump 34 interfaces with hopper outlet 82. Coupling 52 mechanically secures pump 34 to hopper 30.

To accommodate a pump 34 of a second size frame connector 102 is removed and clamps 104 are loosened. Movable frame portion 62 can be pulled relative to fixed frame portion 60 to a second position to enlarge the gap formed between drive housing 70 and hopper 30. A second hole of fixed frame portion 60, or the same first hole in examples where fixed frame portion 60 includes a single hole, can be aligned with a second movable arm hole 112 of movable frame portion 62. With the second holes aligned, frame connector 102 can to be extended through the second holes to secure movable frame portion 62 at the second position. Clamps 104 can be tightened to further secure movable frame portion 62. With movable frame portion 62 in the second position, the gap between drive housing 70 and hopper 30 is sized such that a second version of pump 34 (e.g., a medium length version) can extend between drive housing 70 and hopper 30 such that pump inlet 100 on the end of pump 34 interfaces with hopper outlet 82. Coupling 52 can secure the end of pump 34 to hopper outlet 82 of hopper 30.

To accommodate a pump 34 of a third size, frame connector 102 is removed and clamps 104 are loosened. Movable frame portion 62 can be pulled relative to fixed frame portion 60 to a third position to further enlarge the gap formed between drive housing 70 and hopper 30. A third hole of fixed frame portion 60, or the same first hole in examples where fixed frame portion 60 includes a single hole, can be aligned with a third movable arm hole 112 of movable frame portion 62. With the third holes aligned, frame connector 102 can be extended through the holes to secure movable frame portion 62 at the third position. Clamps 104 can be tightened to further secure movable frame portion 62. With movable frame portion 62 in the third position, the gap between drive housing 70 and hopper 30 is sized such that a third version of pump 34 (e.g., a longer length version) can extend between drive housing 70 and hopper 30 and such that pump inlet 100 on the end of pump 34 interfaces with hopper outlet 82. Coupling 52 can secure the end of pump 34 to hopper outlet 82 of hopper 30.

The relative spacing of the holes along fixed frame portion 60 and movable frame portion 62 can correspond with different pumps 34 having different lengths, such that different combinations of alignment of the holes change the size of the gap between drive housing 70 and hopper 30 to accommodate pumps 34 having different lengths and align such pumps 34 with hopper outlet 82. While each of fixed frame portion 60 and movable frame portion 62 are described as including multiple holes, it is understood that only one of fixed frame portion 60 and movable frame portion 62 can include multiple holes. For example, a first hole 112 of movable frame portion 62 can be aligned with a first hole of fixed frame portion 60 with movable frame portion 62 in the first position. A second hole 112 of movable frame portion 62 can be aligned with the first hole of fixed frame portion 60 with movable frame portion 62 in the second position. A third hole 112 of movable frame portion 62 can be aligned with the first hole of fixed frame portion 60 with movable frame portion 62 in the third position. In some examples, movable frame portion 62 can include a single hole and fixed frame portion 60 can include multiple holes. For example, a first hole of fixed frame portion 60 can be aligned with a first hole 112 of movable frame portion 62 with movable frame portion 62 in the first position. A second hole of fixed frame portion 60 can be aligned with the first hole 112 of movable frame portion 62 with movable frame portion 62 in the second position. A third hole of fixed frame portion 60 can be aligned with the first hole 112 of movable frame portion 62 with movable frame portion 62 in the third position.

During operation, power module 28 can be completely separated from hopper module 26. With power module 28 mounted on hopper module 26, wheels 68*a*, 68*b* of power module 28 do not contact the ground surface. However, when power module 28 is dismounted from hopper module 26, wheels 68*a*, 68*b* contact the ground surface to support power module 28 on the ground surface. Power module 28 can then be maneuvered independent of hopper module 26 by the user, such as by the user grasping and manipulating power module handle 74. Likewise, hopper module 26 can be maneuvered independent of power module 28.

In typical applications, multiple layers of material coating are applied to a wall or other surface, with the user allowing each coating to dry before the next coating is applied. Therefore, a job can span several days while the cycle of spraying, waiting for drying, and then spraying again are repeated. A worker will typically visit several jobsites in a day to work on multiple projects in parallel to accommodate drying times. Hopper module 26 may be particularly heavy if it is filled with material and would be difficult to transport from jobsite to jobsite throughout the day if filled with material. Moreover, different types of materials are usually used at different jobsites depending on the specifications for the particular job, such that if hopper module 26 was reused several times throughout the day then hopper 30 would have to be cleaned and the fluid material remixed for each of several jobsites throughout the day, which is time and cost prohibitive. Therefore, a user may work with multiple hopper modules 26 stationed at the various job sites so that a particular hopper module 26 can stay with a job site from the beginning of a project until completion of the project over the span of several days.

Power module 28 is associated with greater costs and value compared to hopper module 26. For example, the power module 28 includes motor 86 (FIG. 3), reciprocation mechanism 88 (FIG. 3), and pump 34, each of which may be precision manufactured for high performance with difficult to pump aggregate material, whereas hopper module 26 may not include any moving parts except for wheels 54*a*-54*c* and adjustable frame components, such as movable frame portion 62. Therefore, a user may only have one or a few power modules 28 but may own a greater quantity of hopper modules 26. In this case, hopper modules 26 can be left at a job site while one or more power modules 28 can be transported with the user to different jobsites throughout the day. To accommodate such modularity, power modules 28 are easily disconnectable from hopper modules 26 for transport of power modules 28. Also, power modules 28 include wheels 68*a*, 68*b*, which further facilitate easy independent transport. When in use, however, power module 28 mounts on hopper frame 50 so hopper module 26 and power module 28 can move as one combined unit.

Being that power module 28 can be dismounted from hopper module 26 and that different power modules 28 can be combined with different hopper modules 26, flexibility is built into the interface to allow for variation in types. For example, different pumps 34 can be configured for different applications, such as high pressure or high flow applications, or high aggregate or low aggregate materials. In some cases, pumps 34 have different lengths. The different lengths of pumps 34 are accommodate by the modular nature of hopper frame 50. Movable frame portion 62 can be repositioned relative to fixed frame portion 60 to alter the size of the gap between drive housing 70 and hopper 30, thereby allowing one hopper module 26 to accommodate multiple power modules 28 having pumps 34 of varying lengths.

Figure 5:
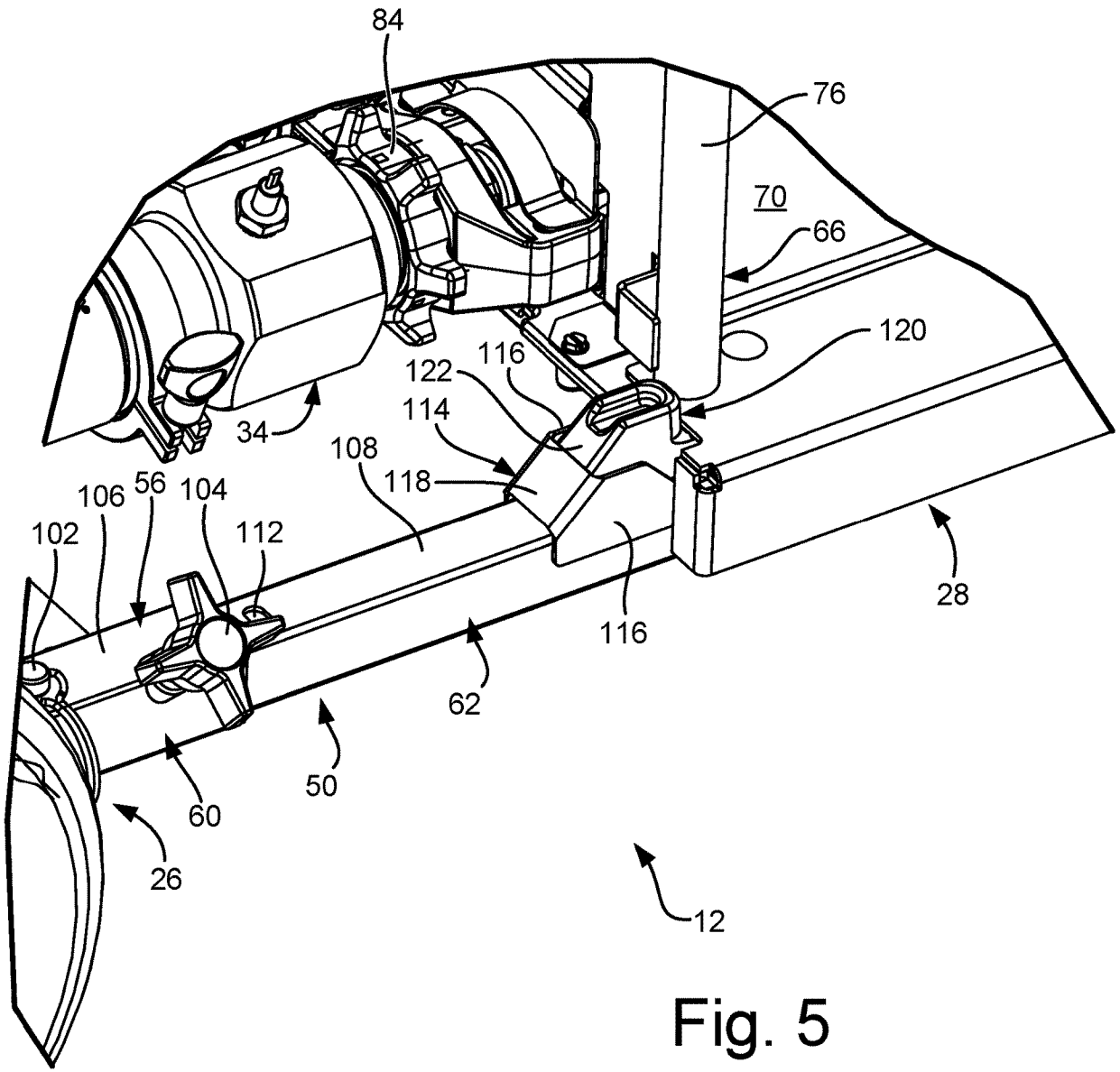
FIG. 5 is a detail isometric view of a portion of a spray module showing a mounting interface between a hopper module and a power module.

FIG. 5 is a detail isometric view of a portion of spray module 12 showing a mounting interface between hopper module 26 and power module 28. Hopper frame 50, frame connector 102, and clamp 104 of hopper module 26 are shown. Horizontal portion 56 of hopper frame 50 is shown. Horizontal portion 56 includes fixed frame portion 60 and movable frame portion 62. A movable frame arm 108 of movable frame portion 62 and a fixed frame arm 106 of fixed frame portion 60 are shown. Movable frame arm 108 includes movable arm hole 112 and shoe 114. Shoe 114 includes side plates 116 and back plate 118. Drive housing 70, pump 34, power frame 66 and pump mount 84 of power module 28 are shown. Bracket 76 and a foot 120 of power frame 66 are shown. Foot 120 includes sloped face 122.

Movable frame portion 62 extends from fixed frame portion 60. Movable frame portion 62 can be repositioned relative to fixed frame portion 60 to adjust a length of horizontal portion 56 of hopper frame 50. Movable arm holes 112 extends through movable frame arm 108. Movable arm holes 112 are configured to receive frame connector 102 when movable arm hole 112 is aligned with a hole through fixed frame arm 106. Frame connector 102 extends through complementary holes on fixed frame arm 106 and movable frame arm 108 to secure movable frame portion 62 to fixed frame portion 60. Clamp 104 extends through fixed frame arm 106 and can be tightened to engage an outer edge of movable frame arm 108 to further secure movable frame portion 62 relative to fixed frame portion 60.

Shoe 114 is fixed to movable frame arm 108. Side plates 116 project vertically from opposite lateral sides of movable frame arm 108. Back plate 118 spans between and is connected to each side plate 116. Back plate 118 is slanted. Shoe 114 defines a receiving area between side plates 116 and back plate 118. Foot 120 is fixed to power frame 66 of power module 28. Foot 120 includes sloped face 122.

Foot 120 is configured to slide into and be received by the receiving area of shoe 114. During mounting of power module 28 on hopper module 26, power module 28 slides in a first direction (e.g., mounting direction M (FIG. 4)) on movable frame portion 62 towards hopper 30 (best seen in FIGS. 3 and 4). Foot 120 slides into the receiving area defined by shoe 114. Power module 28 can be pulled in a second direction, opposite the first direction, (e.g., removal direction R (FIG. 4)) to dismount power module 28 from hopper module 26.

With power module 28 mounted on hopper module 26, foot 120 is disposed within the receiving area defined by shoe 114 between side plates 116. Side plates 116 prevent foot 120 from moving laterally with respect to the first direction and from rotating on movable frame portion 62. Back plate 118 is slanted to correspond to the slope of sloped face 122 of foot 120. Back plate 118 at least partially covers sloped face 122. As such, back plate 118 prevents foot from moving vertically upward relative to movable frame portion 62. Foot 120 interfacing with shoe 114 thereby prevents power module 28 from moving relative to hopper module 26 except for in the second direction, opposite the first direction.

While a foot 120-in-shoe 114 interface is shown, it is understood that power module 28 can be secured to hopper module 26 in any desired manner. For example, other connecting mechanisms can be used instead, such as a peg projecting from one of power frame 66 and hopper frame 50 being received in or otherwise interfacing with a hole of the other one of power frame 66 and hopper frame 50, among other options.

Figure 6:
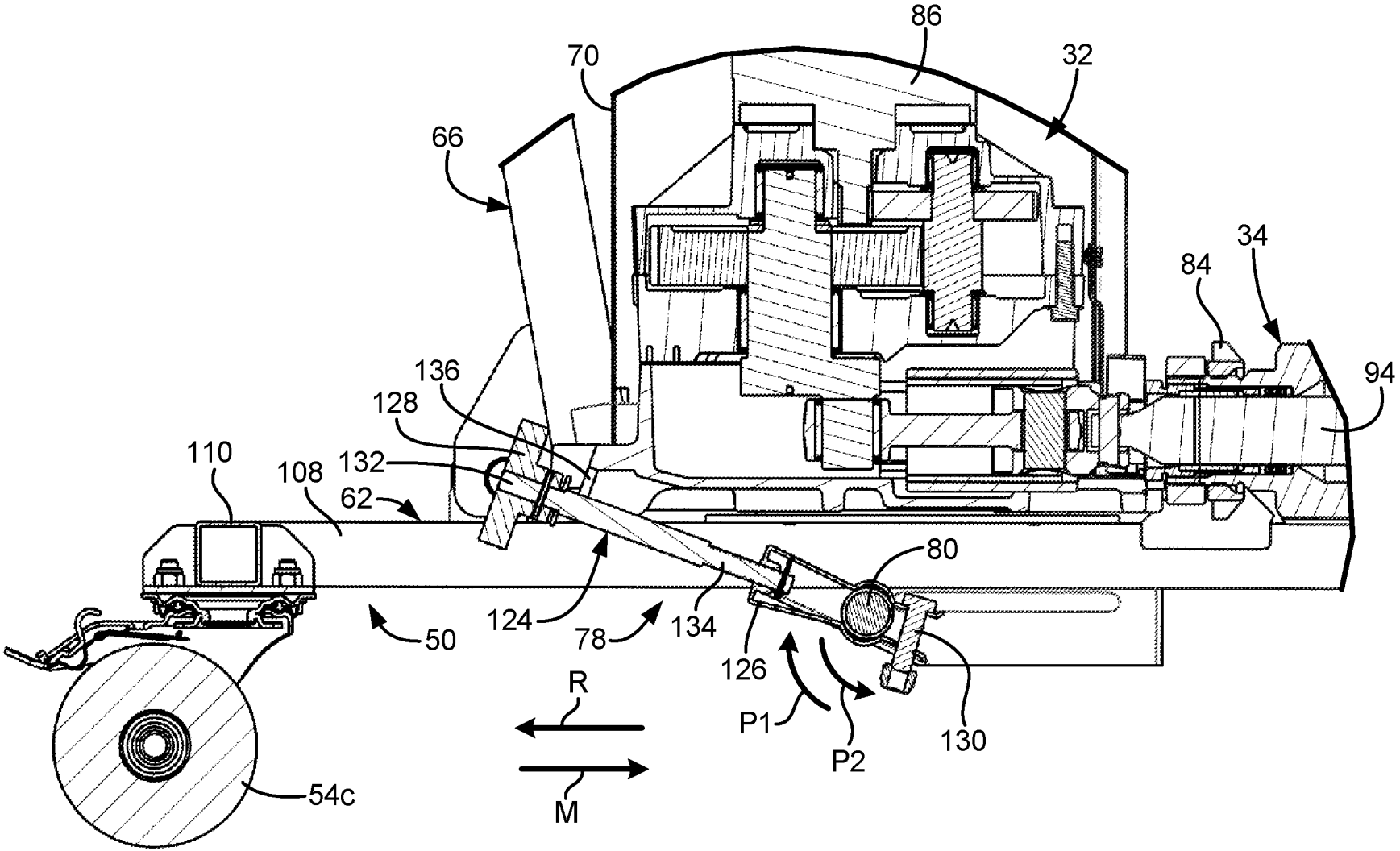
FIG. 6 is an enlarged view of detail 6 in FIG. 3.

FIG. 6 is an enlarged view of detail 6 in FIG. 3. Tie 78, wheel 54*c*, and a portion of hopper frame 50 of hopper module 26 (best seen in FIGS. 3 and 4) are shown. Movable frame portion 62 of hopper frame 50 is shown. Cross-bar 80, movable frame arm 108, and frame end 110 of movable frame portion 62 are shown. Tie 78 includes threaded rod 124, cinch 126, handle 128, and fastener 130. Threaded rod 124 includes first end 132 and second end 134. Drive 32, pump 34, a portion of power frame 66, and pump mount 84 of power module 28 (best seen in FIGS. 3 and 4) are shown. Drive housing 70, motor 86, and reciprocation mechanism 88 of drive 32 are shown. A portion of piston 94 of pump 34 is shown. Power frame 66 includes support plate 136.

Hopper frame 50 supports power module 28 when power module 28 is mounted to hopper module 26. As discussed above, foot 120 (best seen in FIG. 5) of power module 28 can be received in shoe 114 (best seen in FIG. 5) of hopper module 26 to inhibit lateral movement of power module 28 relative to hopper module 26 and to inhibit further axial movement of power module 28 towards hopper 30 (best seen in FIGS. 3 and 4) of hopper module 26. The foot 120 and shoe 114 connection allows power module 28 to slide in the removal direction R relative to hopper module 26 to dismount power module 28 from hopper module 26.

Tie 78 is configured to prevent undesired movement of power module 28 in removal direction R. Tie 78 anchors the back end of power module 28 on movable frame portion 62. As such, tie 78 prevents foot 120 from sliding out of shoe 114 in removal direction R. Tie 78 can be actuated between a secured state, preventing movement of power module 28 relative to hopper module 26 in the removal direction R, and an unsecured state, allowing movement of power module 28 relative to hopper module 26 in the removal direction R. Cross-bar 80 extends between opposite ones of movable frame arms 108. As such, cross-bar 80 is fixed to movable frame portion 62 and moves with movable frame portion 62.

Tie 78 is mounted to hopper module 26 at cross-bar 80. Cinch 126 engages cross-bar 80 and is secured around cross-bar 80 by fastener 130. Cinch 126 is mounted on cross-bar 80 such that cinch 126 can be pivoted on and relative to cross-bar 80. Cinch 126 mounting on cross-bar 80 anchors tie 78 to hopper module 26. Threaded rod 124 is attached to cinch 126. Second end 134 of threaded rod 124 includes threading configured to interface with threading on cinch 126. As such, rotating rod 124 relative to cinch 126 lengthens or shortens tie 78 to loosen or tighten tie 78 and either anchor or release power module 28 on hopper module 26. First end 132 of threaded rod 124 is disposed opposite second end 134. Handle 128 is mounted on first end 132 of threaded rod 124. Handle 128 is mounted to threaded rod 124 such that rotating handle 128 causes rotation of threaded rod 124. As such, the user can grasp handle 128 to cause the relative rotation between threaded rod 124 and cinch 126.

Support plate 136 spans between opposite lateral sides of power frame 66. Support plate 136 can be rigidly attached to, or otherwise a part of, power frame 66. An aperture, such as a clevis or U-shaped notch, is formed in support plate 136. The aperture is configured to receive threaded rod 124 when power module 28 is mounted on hopper module 26. With threaded rod 124 disposed in the aperture of support plate 136, tightening tie 78 pulls support plate 136 towards cross-bar 80, thereby securing power module 28 to hopper module 26. A back side of handle 128 interfaces with support plate 136 to push support plate 136 towards cross-bar 80 when tie 78 is tightened.

The user can tighten tie 78 to secure power module 28 to hopper module 26 and loosen tie 78 to unsecure power module 28 from hopper module 26. Tie 78 can pivot about cross-bar 80 to facilitate mounting and dismounting of power module 28. To mount power module 28, the user slides power module 28 onto hopper module 26 in mounting direction M until feet 120 are received in shoes 114. The user pivots tie 78 in direction P1 such that threaded rod 124 is disposed in the aperture of support plate 136. Threaded rod 124 is rotated, such as by the user grasping handle 128 and rotating threaded rod 124, to shorten the distance between cross-bar 80 and support plate 136. Shortening or otherwise tightening tie 78 closes the distance between cross-bar 80 of movable frame portion 62 and support plate 136 of power frame 66 of power module 28 to further anchor power module 28 on movable frame portion 62.

To dismount power module 28, threaded rod 124 is rotated, such as by the user grasping handle 128 and rotating threaded rod 124, to lengthen the distance between cross-bar 80 and support plate 136. Lengthening or otherwise loosening tie 78 extends the distance between cross-bar 80 of movable frame portion 62 and support plate 136 of power frame 66 of power module 28 to release power module 28 from movable frame portion 62. With tie 78 loosened, the user can pivot tie 78 in direction P2 such that tie 78 does not interfere with sliding of power module 28 in the removal direction R. The user can pull power module 28 in the removal direction R and off of hopper module 26 to dismount power module 28 from hopper module 26.

Figure 7B:
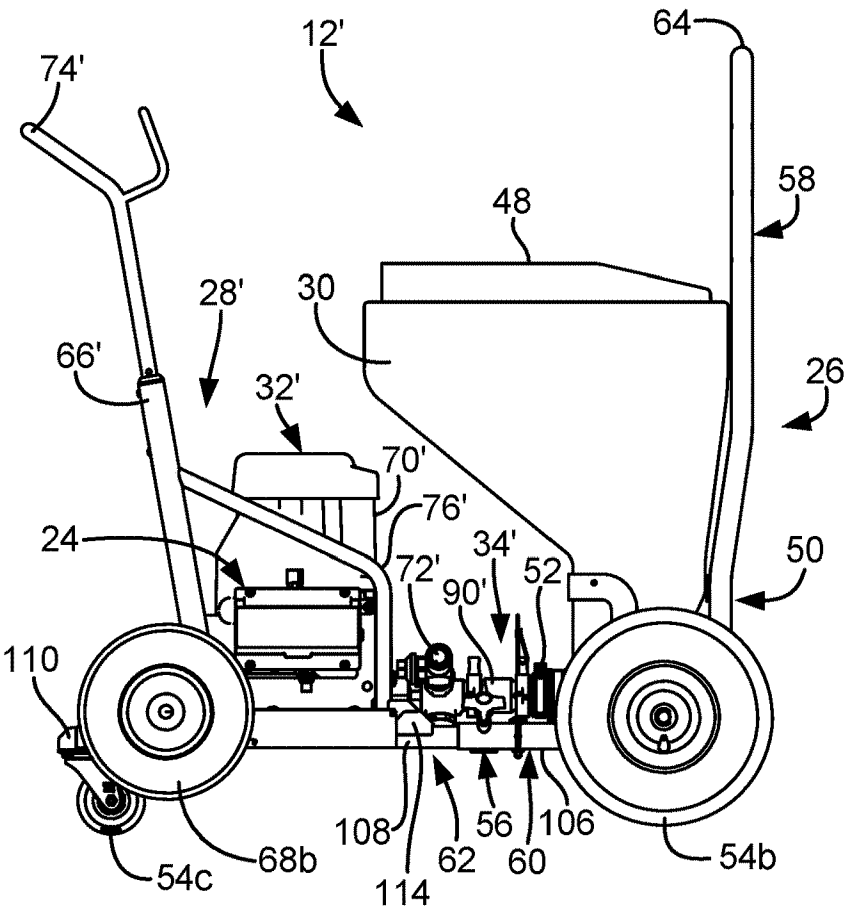
FIG. 7B is a side elevation view of a spray module with a second power module.
Figure 7A:
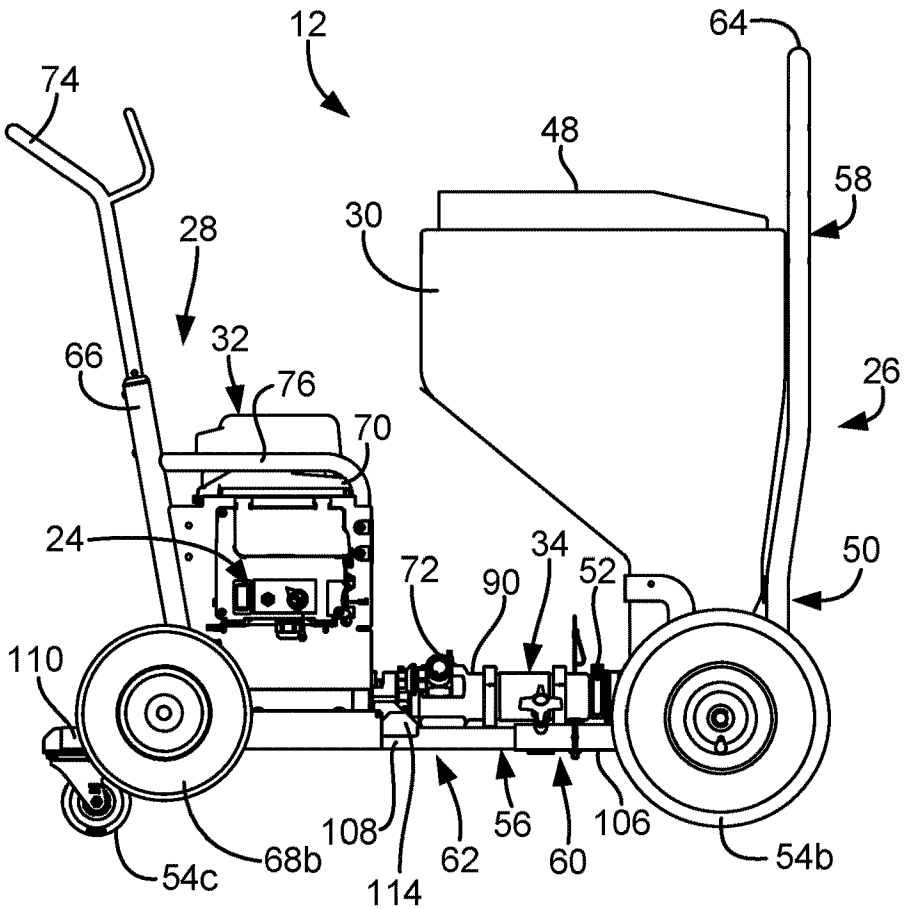
FIG. 7A is a side elevation view of a spray module with a first power module.

FIG. 7A is a side elevation view of first spray module 12. FIG. 7B is a side elevation view of second spray module 12'. FIGS. 7A and 7B will be discussed together. Each of spray module 12 and spray module 12' include hopper module 26. Hopper module 26 includes hopper 30, lid 48, hopper frame 50, coupling 52, and wheels 54*a*-54*c* (wheel 54*a* is shown in FIGS. 2-4). Hopper frame 50 includes horizontal portion 56 and vertical portion 58. Vertical portion 58 includes hopper module handle 64. Horizontal portion 56 includes fixed frame portion 60 and movable frame portion 62. One fixed frame arm 106 of fixed frame portion 60 is shown. One movable frame arm 108 and frame end 110 of movable frame portion 62 is show. Movable frame arm 108 includes shoe 114.

Spray module 12 further includes power module 28 (FIG. 7A). Power module 28 includes drive 32, pump 34, power frame 66, wheels 68*a*, 68*b* (wheel 68*a* shown in FIGS. 2-4), and control module 24. Drive housing 70 of drive 32 is shown. Cylinder 90 and pump outlet 72 of pump 34 are shown. Power frame 66 includes power module handle 74 and brackets 76.

Spray module 12' further includes power module 28' (FIG. 7B). Power module 28' includes drive 32', pump 34', power frame 66', wheels 68*a*, 68*b* (wheel 68*a* shown in FIGS. 2-4), and control module 24. Drive housing 70' of drive 32' is shown. Cylinder 90' and pump outlet 72' of pump 34' are shown. Power frame 66' includes power module handle 74' and brackets 76'.

Hopper 30 is disposed on and supported by hopper frame 50, and specifically by fixed frame portion 60 of hopper frame 50. Movable frame portion 62 extends from and is supported by fixed frame portion 60. Movable frame portion 62 supports power modules 28, 28'. Horizontal portion 56 extends from wheels 54*a*, 54*b* to wheel 54*c* (e.g., from the front wheels 54*a*, 54*b* to the back wheel 54*c*). Horizontal portion 56 is disposed horizontally with respect to the ground surface. When either power module 28, 28' is mounted on horizontal portion 56, no part of the power modules 28, 28', including wheels 68*a*, 68*b*, touch the ground. Rather, the whole of power module 28, 28' is supported by wheels 54*a*-54*c* of hopper module 26. As such, wheels 54*a*-54*c* of hopper module 26 support the full spray module 12, 12', including both hopper module 26 and power module 28, 28'.

Pump 34 has a first length. Pump 34' has a second length shorter than the first length. The length of horizontal portion 56 can be adjusted to accommodate pumps 34, 34' of different lengths. To adjust the length of horizontal portion 56, movable frame portion 62 is adjusted relative to fixed frame portion 60. While movable frame portion 62 can be adjusted to change the length of horizontal portion 56, the position of hopper 30 on hopper frame 50 does not change. Movable frame portion 62 can be extended relative to fixed frame portion 60 to accommodate the longer pump 34 while movable frame portion 62 can be moved closer, or otherwise retracted relative, to fixed frame portion 60 to accommodate the shorter pump 34'. Each power module 28, 28' is in the same position on movable frame portion 62 regardless of the degree of extension of movable frame portion 62 relative to fixed frame portion 60. For example, the mountings for power module 28, 28' on movable frame portion 62 are fixed in place. One such mounting is shoe 114 and foot 120, as discussed in more detail with regard to FIG. 5.

Spray modules 12, 12' provide significant advantages. A single hopper module 26 can accommodate multiple ones of power modules 28, 28'. Power modules 28, 28' can be dismounted from hopper module 26 and different power modules 28, 28' can be combined with different hopper modules 26. As such, flexibility is built into the interface to allow for variation in types. For example, different pumps 34, 34' may be configured for different applications, such as high pressure or high flow applications, or high aggregate or low aggregate materials. In some cases, pumps 34, 34' have different lengths. The different lengths of pumps 34, 34' are accommodated by the modular nature of hopper frame 50. Movable frame portion 62 can be repositioned relative to fixed frame portion 60 to alter the size of the gap between motor housing 70, 70' and hopper 30, thereby allowing one hopper module 26 to accommodate multiple power modules 28, 28' having pumps 34, 34' of varying lengths.

Figure 8A:
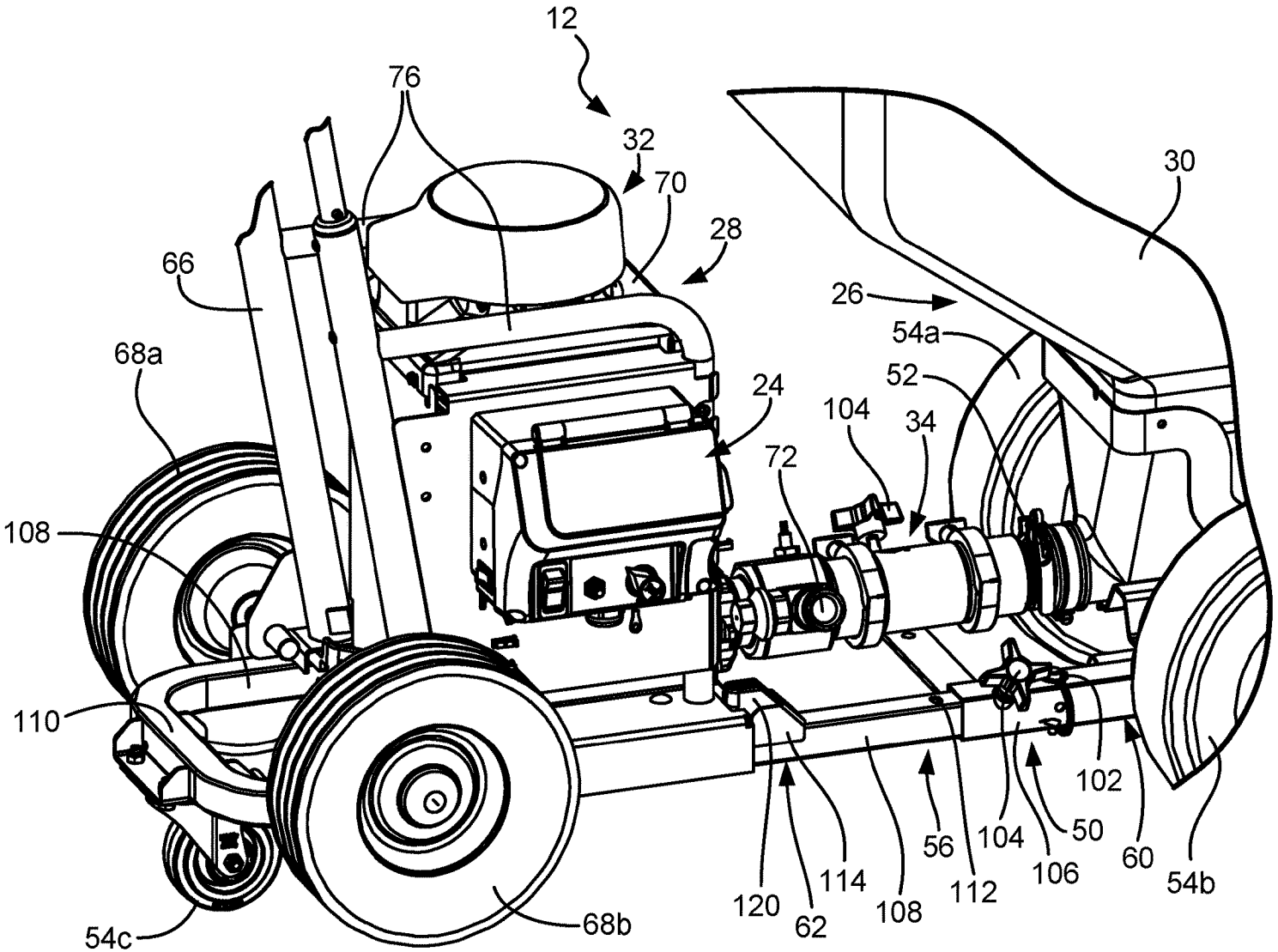
FIG. 8A is a detailed view of part of the spray module shown in FIG. 7A.
Figure 8B:
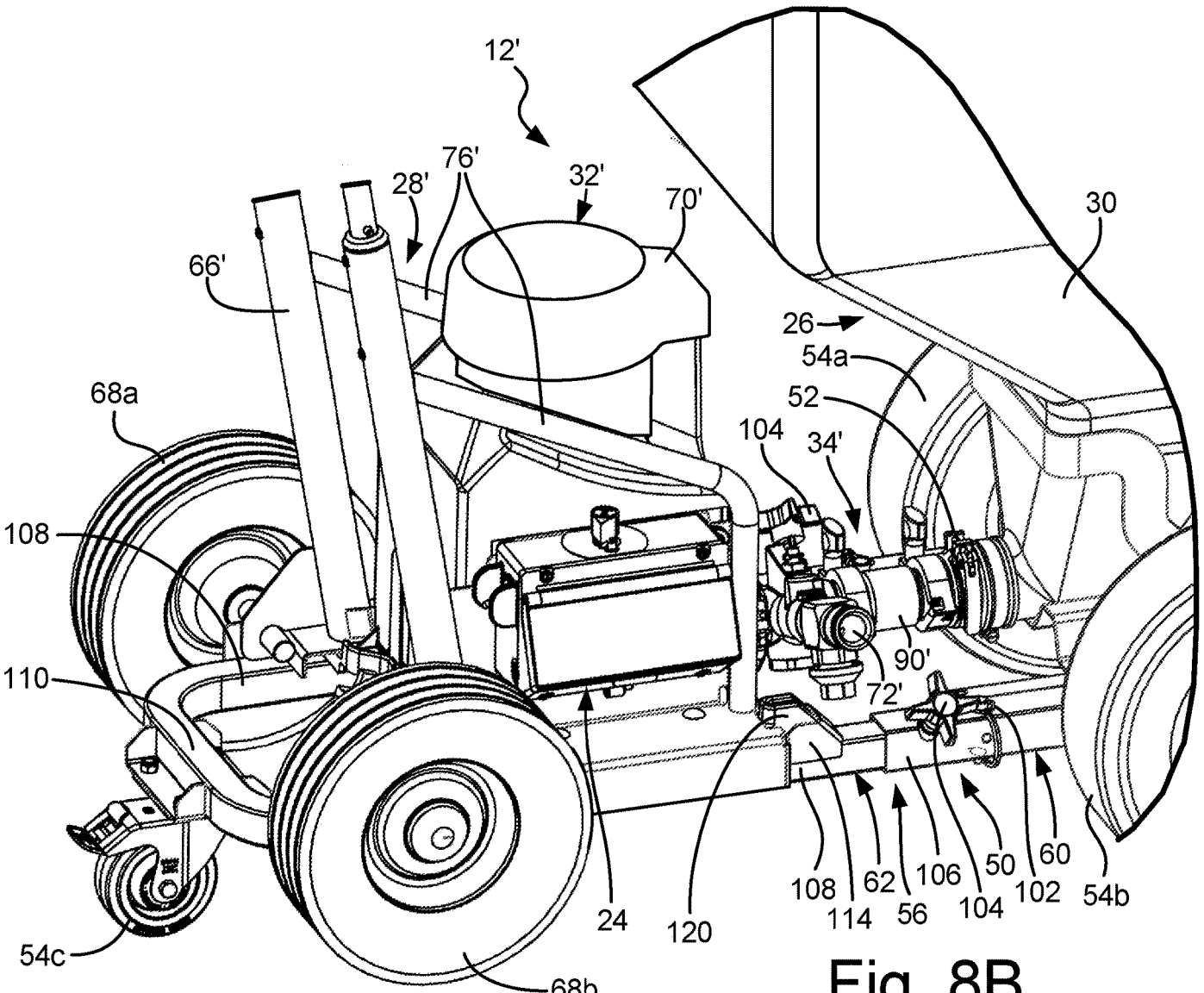
FIG. 8B is a detailed view of part of the spray module shown in FIG. 7B.

FIG. 8A is a detailed view of a part of the first spray module 12 shown in FIG. 7A. FIG. 8B is a detailed view of a part of the second spray module 12' shown in FIG. 7B. FIGS. 8A and 8B will be discussed together. Spray module 12 and spray module 12' each include hopper module 26. Hopper 30, hopper frame 50, coupling 52, wheels 54*a*-54*c*, frame connectors 102 (only one of which is shown), and clamps 104 of hopper module 26 are shown. Horizontal portion 56 of hopper frame 50 is shown. Horizontal portion 56 includes fixed frame portion 60 and movable frame portion 62. Fixed frame portion 60 includes fixed frame arms 106 (only one of which is shown). Movable frame portion 62 includes movable frame arms 108 and frame end 110. Each movable frame arm 108 includes movable arm holes 112 (shown in FIG. 8A) and shoe 114 (only one of which shown).

Spray module 12 further includes power module 28. Power module 28 includes drive 32, pump 34, power frame 66, wheels 68*a*, 68*b*, and control module 24. Drive housing 70 of drive 32 is shown. Cylinder 90 and pump outlet 72 of pump 34 are shown. Brackets 76 and feet 120 (only one foot 120 of feet 120 is shown) of power frame 66 are shown.

Spray module 12' further includes power module 28'. Power module 28' includes drive 32', pump 34', power frame 66', wheels 68*a*, 68*b*, and control module 24. Drive housing 70' of drive 32' is shown. Cylinder 90' and pump outlet 72' of pump 34' are shown. Brackets 76' and feet 120 (only one foot 120 of feet 120 is shown) of power frame 66' are shown.

Movable frame arms 108 are configured to engage fixed frame arms 106 and are movable relative to fixed frame arms 106 to adjust a length of horizontal portion 56. Movable frame arms 108 include movable arm holes 112 (visible in FIG. 8A) that are arrayed along the length of movable frame arms 108. Movable arm holes 112 are configured to receive frame connector 102 extending through fixed frame portion 60 and movable frame portion 62 to fix the position of movable frame portion 62 relative to fixed frame portion 60. For example, frame connector 102 can be a pin that extends through movable arm holes 112 in movable frame arm 108 and corresponding holes in fixed frame arm 106. Frame connector 102 prevents relative movement of movable frame portion 62 relative to fixed frame portion 60. Frame connector 102 can be removed from fixed frame portion 60 and movable frame portion 62 to allow relative movement between movable frame portion 62 and fixed frame portion 60 such that the length of horizontal portion 56 can be adjusted to facilitate mounting of different power modules 28, 28' on hopper module 26.

Movable arm holes 112 can be spaced along movable frame portion 62 to align with holes through fixed frame arms 106 at relative positions corresponding to different lengths of horizontal portion 56. The different lengths of horizontal portion 56 provide the appropriate spacing to accommodate pumps 34, 34' of different lengths and ensure that pump inlets 100 (best seen in FIG. 3) of the pumps 34, 34' are properly aligned with hopper 30 to mount to hopper 30.

Power module 28 including pump 34 having a first, longer length is shown in FIG. 8A. Power module 28' including pump 34' having a second, shorter length is shown in FIG. 8B. While on a job site, the user can adjust the length of horizontal portion 56 of hopper module 26 such that hopper module 26 can support and interface with power modules 28, 28' having pumps 34, 34' of different lengths. For example, the user can swap out power modules 28, 28' having pumps 34, 34' of different lengths and displacements for different applications, such as high pressure or high flow applications, or high aggregate or low aggregate materials.

An example of mounting power module 28 and changing to power module 28' is discussed in more detail. The user wheels power module 28 into alignment with hopper module 26. The user can pull movable frame portion 62 away from fixed frame portion 60 to lengthen horizontal portion 56 of hopper frame 50 based on the length of pump 34. Frame connectors 102 are inserted through holes in fixed frame arms 106 and movable arm holes 112 in movable frame arms 108 secure movable frame portion 62 to fixed frame portion 60, thereby fixing the length of horizontal portion 56. Clamps 104 can be rotated to further secure movable frame portion 62 to fixed frame portion 60.

The user pushes power module 28 onto movable frame portion 62 until feet 120 are disposed in and engaged with shoes 114. Tie 78 (best seen in FIG. 6) is tightened to secure power module 28 on hopper module 26. With feet 120 engaging shoes 114, pump inlet 100 engages hopper 30, forming the fluid connection between pump 34 and hopper 30. The user secures coupling 52 to pump 34, thereby making the mechanical connection between pump 34 and hopper 30. Spray module 12 is thus ready to spray. Hopper module 26 fully supports power module 28 via wheels 54*a*-54*c*. As such, the user can reposition spray module 12 at any desired location on the job site by wheeling hopper module 26, with power module 28 mounted, to the desired location.

To dismount power module 28, the user removes coupling 52. Tie 78 is loosened. Power module 28 can be pulled away from hopper 30 and off of horizontal portion 56 of hopper frame 50.

To facilitate mounting of power module 28', the user rotates clamps 104 and removes frame connectors 102 such that movable frame portion 62 is no longer fixed to fixed frame portion 60. The user can then push movable frame portion 62 towards hopper 30, reducing the length of horizontal portion 56 of hopper frame 50. When movable frame portion 62 is in the desired position to accommodate power module 28', the user inserts frame connectors 102 and tightens clamps 104 to fix movable frame portion 62 and the new position (shown in FIG. 8B).

The user pushes power module 28' onto movable frame portion 62 until feet 120 are disposed in and engage shoes 114. Tie 78 is tightened to secure power module 28' on hopper module 26. With feet 120 engaging shoes 114, the pump inlet of pump 34' engages hopper 30, forming the fluid connection between pump 34' and hopper 30. The user secures coupling 52 to pump 34', thereby making the mechanical connection between pump 34' and hopper 30. Spray module 12' is thus ready to spray.

To dismount power module 28', the user removes coupling 52. Tie 78 is loosened. Power module 28' can be pulled away from hopper 30 and off of horizontal portion 56 of hopper frame 50.

Figure 9:
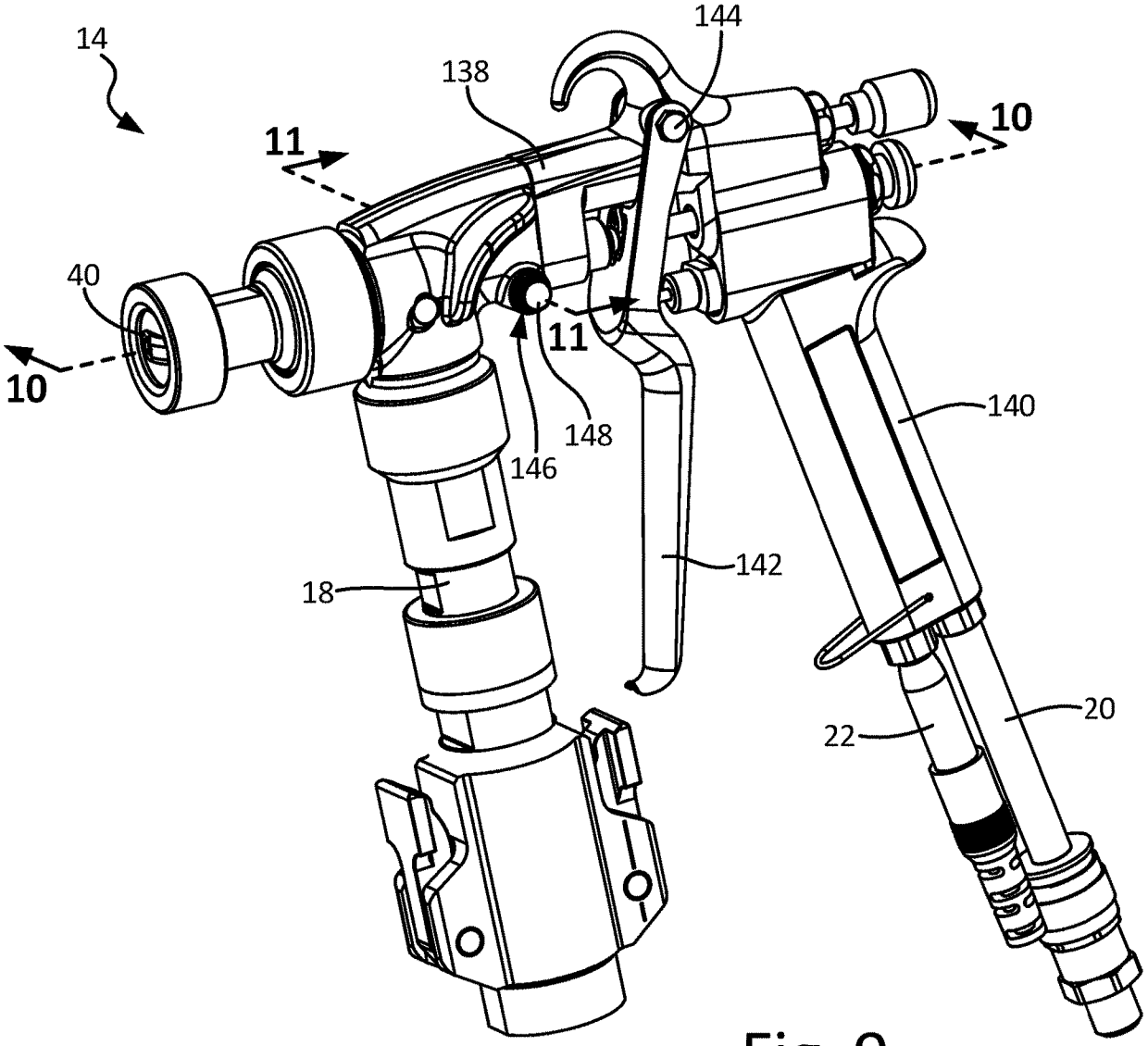
FIG. 9 is an isometric view of a spray gun.

FIG. 9 is a perspective view of spray gun 14. Spray gun 14 includes nozzle 40, gun body 138, handle 140, trigger 36, pivot 144, and detent mechanism 146. Button 148 of detent mechanism 146 is shown. Spray hose 18, air hose 20, and signal line 22 of a spray system, such as spray system 10 (FIGS. 1 and 2), are shown.

Gun body 138 encloses various components of spray gun 14. Gun body 138 can be formed from metal, such as aluminum. Handle 140 projects from gun body 138. In some examples, handle 140 is integrally formed with gun body 138 such that handle 140 and gun body 138 form a unitary part. It is understood, however, that handle 140 can be formed separate from gun body 138 and attached to gun body 138. Handle 140 is configured to be gripped by one hand of the user while that same gripping hand actuates trigger 36. Trigger 36 is mounted to gun body 138 at pivot 144. Actuating trigger 36 causes trigger 36 to rotate about pivot 144 to cause spraying by spray gun 14. Nozzle 40 is disposed at a spray outlet of spray gun 14 and is configured to eject material as a material spray.

Detent mechanism 146 is at least partially disposed within gun body 138. In the example shown, button 148 projects out of a lateral side of gun body 138. Detent mechanism 146 can be actuated by the user, such as by pushing button 148, to perform a release action that will be further discussed herein. As shown, button 148 is exposed on the exterior of gun body 138. In some examples, button 148 is exposed on only one lateral side (left or right side) of gun body 138. In other examples, detent mechanism 146 can include buttons or other components exposed on both lateral sides and/or on one or both of the top and bottom sides of gun body 138. Button 148 projecting from gun body 138 provides the user with easy access for actuating detent mechanism 146.

Spray hose 18 extends to gun body 138 and is configured to provide material to spray gun 14 for spraying by spray gun 14. Spray hose 18 receives material under pressure output by a pump, such as pump 34 (shown in FIGS. 1-7A and 8A) and pump 34' (shown in FIGS. 7B and 8B). Air hose 20 and signal line 22 extend to handle 140 and are mounted to handle 140. Air hose 20 supplies compressed air to spray gun 14 for generating the material spray. Air hose 20 receives the compressed air from a compressed air source, such as compressed air source 16 (FIGS. 1 and 2). The compressed air hose 20 attaches to the bottom of handle 140. Also attached to the bottom of handle 140 is signal line 22. As further described herein, signal line 22 includes a cord having an inner conductor for conveying a control signal from spray gun 14 to control module 24 (best seen in FIG. 1). Each of spray hose 18, air hose 20, and signal line 22 can be disconnected from spray gun 14.

Figure 10A:
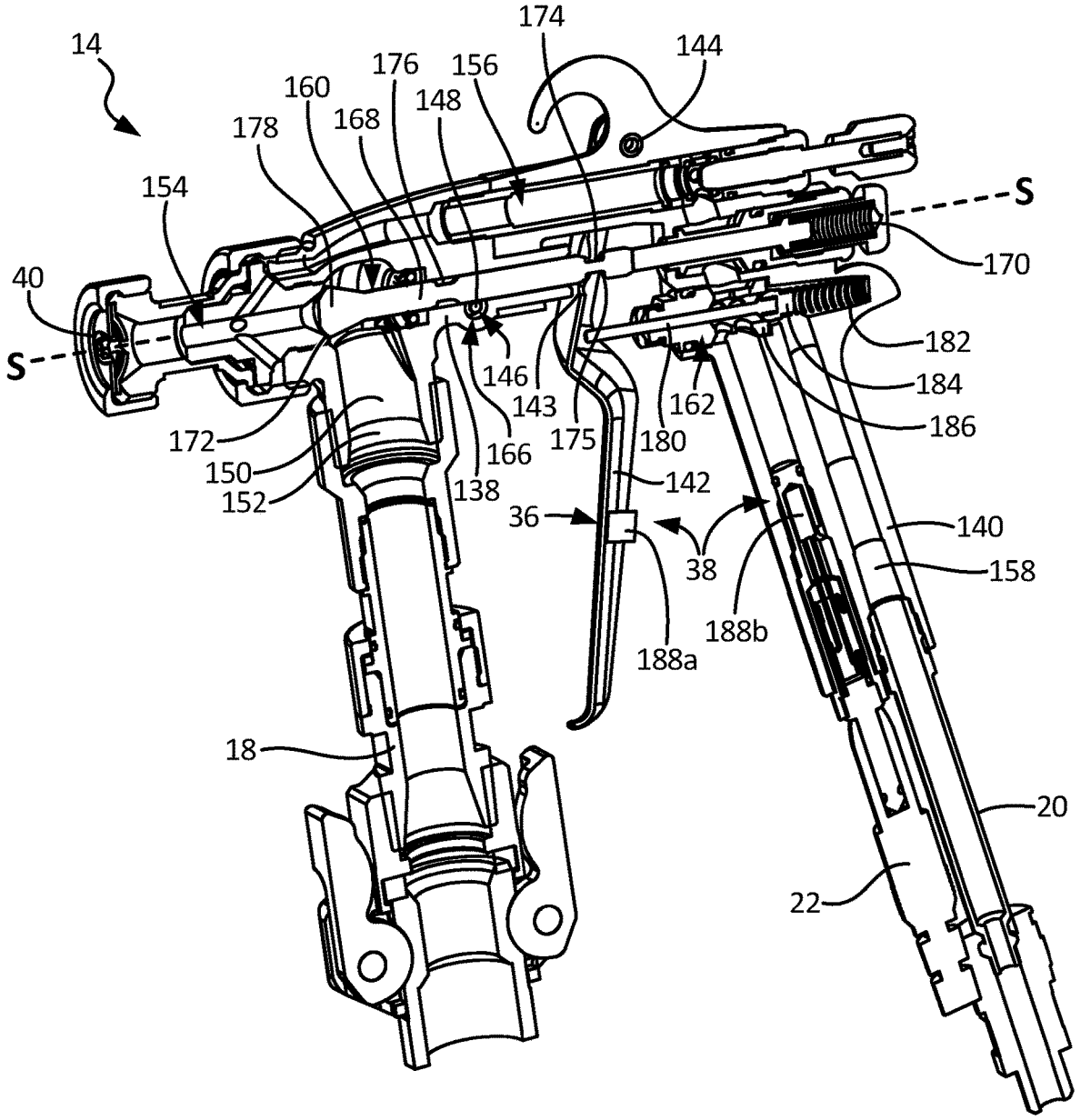
FIG. 10A is a cross-sectional view of a spray gun taken along line 10-10 in FIG. 9 and showing the spray gun in a non-actuated state.
Figure 10B:
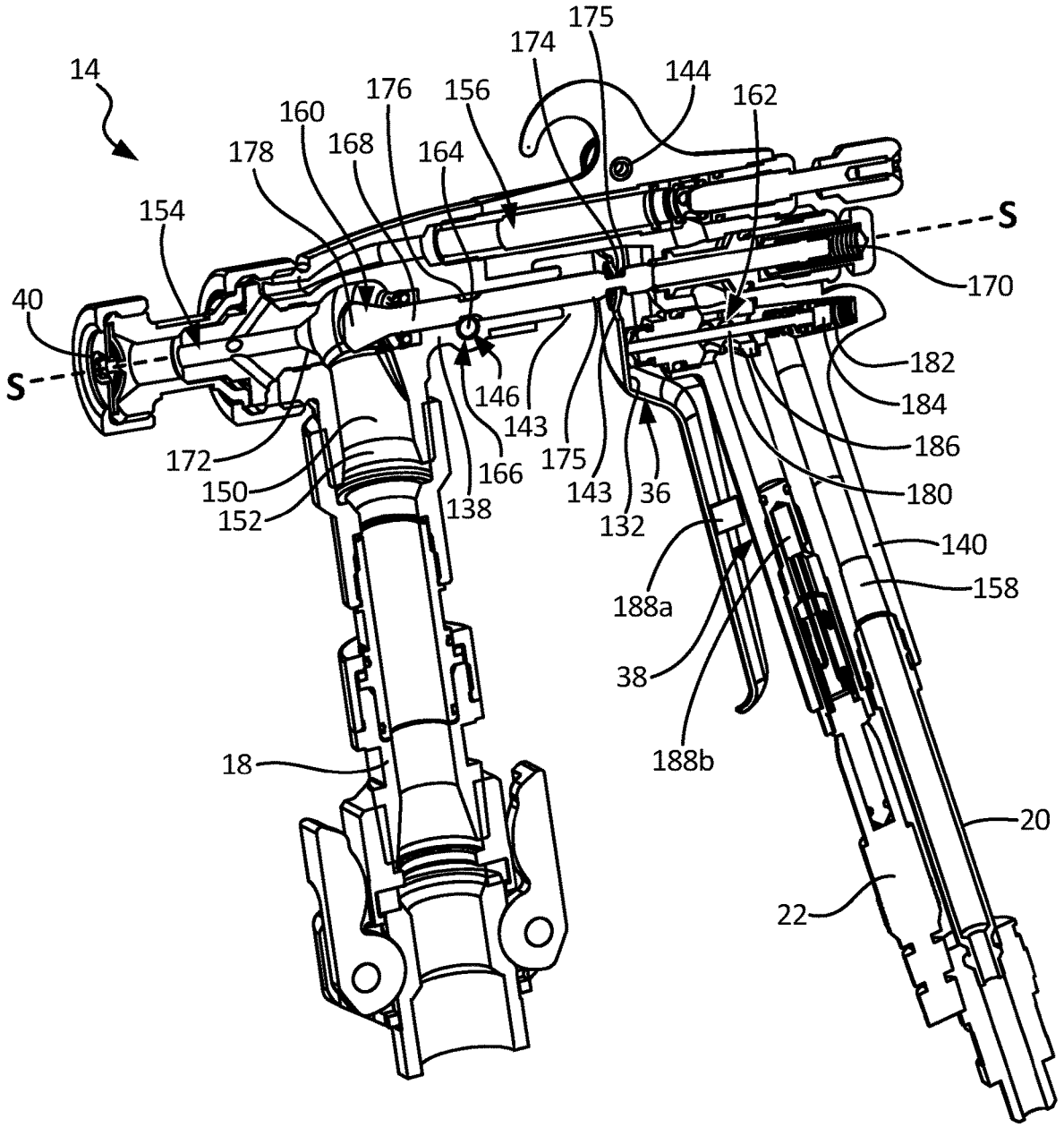
FIG. 10B is a cross-sectional view of a spray gun taken along line 10-10 in FIG. 9 and showing the spray gun in an actuated state.
Figure 10C:
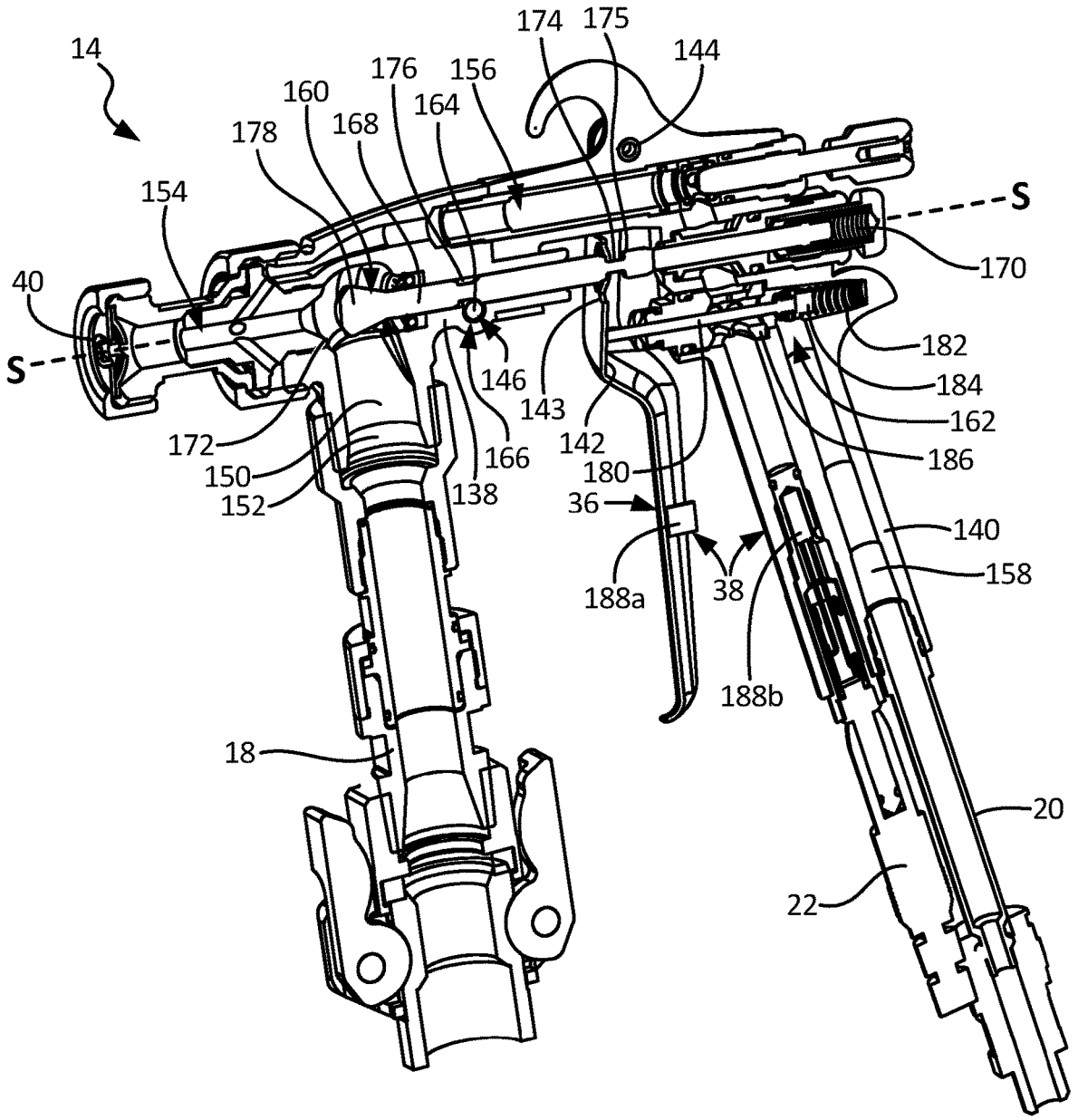
FIG. 10C is a cross-sectional view of a spray gun taken along line 10-10 in FIG. 9 and showing the spray gun in a detent state.

FIG. 10A is a cross-sectional view of spray gun 14 showing spray gun 14 in a non-actuated state. FIG. 10B is a cross-sectional view of spray gun 14 showing spray gun 14 in an actuated state. FIG. 10C is a cross-sectional view of spray gun 14 showing spray gun 14 in a detent state. FIGS. 10A-10C will be discussed together. Spray gun 14 includes trigger 36, sensor 38, nozzle 40, gun body 138, handle 140, pivot 144, detent mechanism 146, material pathway 150, material inlet 152, mix chamber 154, air pathway 156, air inlet 158, material flow valve 160, and air flow valve 162. A portion of button (FIG. 10A), ball 164 (FIGS. 10B and 10C), and passage 166 of detent mechanism 146 are shown. Trigger 36 includes back side 142 and aperture 143. Material flow valve 160 includes needle 168, material valve spring 170, and material valve seat 172. Needle 168 includes neck 174, groove 176, and valve head 178. Neck 174 includes back side 175. Air flow valve 162 includes pin 180, air valve spring 182, valve member 184, and air valve seat 186. Sensor 38 includes first transducer component 188*a* and second transducer component 188*b*. Spray hose 18, air hose 20, and signal line 22 of a spray system, such as spray system 10 (FIGS. 1 and 2) are shown.

Spray gun 14 is configured to receive material from spray hose 18 and compressed air from air hose 20. The material and compressed air mix within gun body 138 and are ejected as a material spray through nozzle 40. The flows of material and compressed air into and through gun body 138 are respectively controlled by material flow valve 160 and air flow valve 162. Trigger 36 is pivotably mounted to gun body 138 at pivot 144. Actuation of trigger 36 controls actuation of material flow valve 160 and air flow valve 162.

Sensor 38 is configured to sense the actuation state of trigger. In the example shown, first transducer component 188*a* is disposed on trigger 36 and second transducer component 188*b* is disposed in handle 140. While first and second transducer components 188*a*, 188*b* are located on trigger 36 and handle 140, respectively, it is understood that the first and second transducer components 188*a*, 188*b* (or other transducer components) can be located elsewhere on spray gun 14 or on other components of the material spray system. First and second transducer components 188*a*, 188*b* can form a proximity sensor, a movement sensor, a position sensor, or other type of sensor. In the example shown, one of first transducer component 188*a* and second transducer component 188*b* can be a magnet while the other of first transducer component 188*a* and second transducer component 188*b* can be a magnetic reed switch sensitive to the magnetic field generated by the magnet. For example, first transducer component 188*a* can be a magnet mounted on trigger 36 and second transducer component 188*b* can be a magnetic field sensor mounted in handle 140. While the magnet of first transducer component 188*a* is located on trigger 36 and the magnetic field sensor of second transducer component 188*b* is located in handle 140, it is understood that the locations can be reversed such that the magnet can be in handle 140 while the magnetic field sensor can be mounted on trigger 36.

Material pathway 150 extends through gun body 138 from material inlet 152 to mix chamber 154. Material flow valve 160 is mounted to gun body 138. Material flow valve 160 is configured to control the flow of material from material inlet 152 to mix chamber 154. As such, material flow valve 160 regulates the flow of material received from spray hose 18 through material pathway 150 to mix chamber 154. Closure of material flow valve 160 blocks the flow of material while opening of material flow valve 160 permits the flow of material. Opening and closing of material flow valve 160 is based on the state of actuation of trigger 36.

Needle 168 is at least partially disposed in gun body 138. Needle 168 is an elongated component, such as a rod. A first end of needle 168 includes valve head 178. Valve head 178 can be formed as part of needle 168, or valve head 178 can be separate from and attached to and therefore move with needle 168. Valve head 178 is configured to interface with material valve seat 172 to seal and block material from flowing along material pathway 150 to mix chamber 154 and out of nozzle 40. Material valve spring 170 interfaces with needle 168 and is configured to bias needle 168 towards the closed position shown in FIG. 10A. Neck 174 is formed on a portion of needle 168 disposed outside of gun body 138. Trigger 36 engages neck 174. An aperture 143 (e.g., notch) in trigger 36 wraps around and engages neck 174 of needle 168 such that pulling trigger 36 causes trigger 36 to engage back side 175 of neck 174 and pull needle 168 rearward to disengage valve head 178 from material valve seat 172, thereby opening material flow valve 160. Back side 175 of neck 174 represents a radially-extending portion of needle 168 disposed on a side of neck 174 opposite valve head 178. Groove 176 is formed on a portion of needle 168 between valve head 178 and neck 174. Groove 176 is a portion of needle 168 having a reduced diameter relative to the portions of needle 168 on either side of groove 176.

Detent mechanism 146 is at least partially disposed in gun body 138. Passage 166 extends into gun body 138. Passage 166 is disposed transverse to spray axis S-S of spray gun 14. Ball 164 is disposed within passage 166. Ball 164 is configured to engage groove 176 with spray gun 14 in each of the actuated state shown in FIG. 10B and the detent state shown in FIG. 10C. Ball 164 engaging groove 176 prevents forward movement of needle 168 when trigger 36 is released. As such, detent mechanism 146 holds spray gun 14 in the detent state when trigger 36 is released from the actuated state. Detent mechanism 146 thereby prevents spray gun 14 from immediately returning to the non-actuated state from the actuated state.

Air pathway 156 extends through gun body 138 from air inlet 158 to mix chamber 154. Air flow valve 162 is mounted to gun body 138. Air flow valve 162 is configured to control the flow of air from air inlet 158 to mix chamber 154. As such, air flow valve 162 regulates the flow of compressed air through air pathway 156 to mix chamber 154. Closure of air flow valve 162 blocks the flow of air, while opening of air flow valve 162 permits the flow of air. Opening and closing of air flow valve 162 is based on the state of actuation of trigger 36.

Pin 180 is at least partially disposed in gun body 138. Pin 180 is an elongated component such as a rod. In the example shown, pin 180 projects forward out of handle 140 towards trigger 36. Valve member 184 is attached to a second end of pin 180 opposite the end of pin 180 projecting out of gun body 138. Pin 180 can also be referred to as an air valve needle. Air valve seat 186 is disposed in air flow valve 162. Valve member 184 is configured to interface with air valve seat 186 to seal and block air from flowing along air pathway 156 to mix chamber 154 and out of nozzle 40 when air flow valve 162 is closed. Air valve spring 182 interfaces with valve member 184 and is configured to bias valve member 184 towards the closed position shown in FIG. 10A.

Pulling of trigger 36 rearward causes back side 142 of trigger 36 to impact the first end of pin 180 such that trigger 36 can push pin 180 rearward to cause valve member 184 to disengage from air valve seat 186, due to the connection of valve member 184 and pin 180, thereby opening air flow valve 162. Rearward movement of pin 180 unseats valve member 184 from air valve seat 186 to open air flow valve 162 and allow air to flow downstream through air flow valve 162. Once trigger 36 is released, the air valve spring 182 can push air flow valve 162 towards a closed state.

FIG. 10A shows trigger 36 in an non-actuated or released state. In this state, the hand of the user is not squeezing trigger 36, moving it closer to handle 140, or otherwise applying force to trigger 36. The not-actuated state corresponds to a non-spray state of spray gun 14 in which material is not being sprayed from nozzle 40. FIG. 10B shows trigger 36 in a fully actuated state. In the fully actuated state, trigger 36 has moved as close to handle 140 as possible. This fully actuated state corresponds to a spray state in which material is sprayed from nozzle 40 as long as trigger 36 remains in the actuated state and material and air continue to be supplied to the spray gun 14. FIG. 10C shows trigger 36 in a detent state. In the detent state, the user has released trigger 36, but due to detent mechanism 146, discussed further herein, trigger 36 does not fully release to the non-actuated state shown in FIG. 10A until another action is performed by the user.

During operation, spray gun 14 is initially in the non-spray state shown in FIG. 10A. In the non-spray state, each of material flow valve 160 and air flow valve 162 are closed. Valve head 178 engages material valve seat 172 closing material passage 166 and preventing material from flowing to mix chamber 154 from material inlet 152. Valve member 184 engages air valve seat 186 closing air passage 166 and preventing air from flowing to mix chamber 154 from air inlet 158.

In the example shown, spraying of material from nozzle 40 requires both a flow of material from the spray hose 18 and a flow of pressurized air from the air hose 20. The compressed air and the material mix in mix chamber 154. The compressed air accelerates and atomizes the fluid material moving through nozzle 40 into a spray pattern.

To initiate spraying, the user pulls trigger 36, placing spray gun 14 in the spray state shown in FIG. 10B. Pulling trigger 36 causes trigger 36 to actuate each of material flow valve 160 and air flow valve 162 to respective open states. Needle 168 shifts rearward and groove 176 passes over detent mechanism 146. Groove 176 passing over detent mechanism 146 allows ball 164 to shift such that ball 164 is disposed within groove 176. Valve head 178 disengages from material valve seat 172 to allow material to flow from material inlet 152 to mix chamber 154 and out through nozzle 40. Valve member 184 disengages from air valve seat 186, allowing air to flow from air inlet 158 to mix chamber 154 and out through nozzle 40. The material and air mix in mix chamber 154 to form the material spray ejected through nozzle 40.

After spraying is complete, the user releases trigger 36. Release of trigger 36 from the actuated state allows needle 168 to be pushed forward by material valve spring 170, thereby urging valve head 178 towards engagement with material valve seat 172. Valve head 178 engaging material valve seat 172 prevents the material from flowing through material pathway 150 to mix chamber 154. Needle 168 also pushes trigger 36 towards the state shown in FIG. 10A, due to trigger 36 engaging neck 174.

However, as further discussed herein, despite the urging of material valve spring 170, needle 168 is prevented from being forced fully forward by material valve spring 170 by detent mechanism 146. More specifically, upon release of trigger 36, material valve spring 170 forces needle 168, and thereby trigger 36 due to the engagement of trigger 36 with neck 174, to move forward until spray gun 14 is in the detent state shown in FIG. 10C. Detent mechanism 146 inhibits further forward movement of needle 168 and trigger 36 due to ball 164 being disposed within groove 176.

In the detent state shown in FIG. 10C, a detent, formed by detent mechanism 146, prevents needle 168, and thereby trigger 36, from moving forward through the detent state. Detent mechanism 146 is a catch that allows needle 168 to move forward relative to the actuated state shown in FIG. 10B but does not allow needle 168 to move all the way forward to the non-actuated state shown in FIG. 10A without intervention by the user. Thus, while spraying in the actuated state shown in FIG. 10B, the user can release trigger 36 when the user desires to stop spraying. Releasing trigger 36 allows material valve spring 170 to push needle 168 forward, which also causes trigger 36 to pivot forward. However, needle 168, and trigger 36, are stopped at the detent state shown in FIG. 10C.

Trigger 36 does not automatically fully release from the detent state and instead catches at a position between the non-actuated state and the actuated state. In the detent state, trigger 36 is not fully actuated but material flow valve 160 is open, insomuch that valve head 178 does not engage material valve seat 172 thereby allowing material from material inlet 152 to continue to flow through material pathway 150 through material flow valve 160 and into mix chamber 154 and out nozzle 40. Detent mechanism 146 stops forward movement of trigger 36 at a point where back side 142 of trigger 36 is still engaged with pin 180. Trigger 36 maintains pin 180 in such a position that that valve member 184 is disengaged from air valve seat 186. Air flow valve 162 is thus held open by trigger 36, allowing compressed air to flow through air flow valve 162 and through air passage 166 in gun body 138 to mix chamber 154. As such, with trigger 36 in the detent state, compressed air from the compressed air source can continue to flow through air hose 20 into gun body 138 and through air passage 166 to mix chamber 154. Specifically, the compressed air flows through a portion of air pathway 156 in handle 140, through air flow valve 162, through a portion of air pathway 156 in gun body 138, to mix chamber 154, and out through nozzle 40. Air flow valve 162 remains open so long as trigger 36 is in the detent state.

Figure 11A:
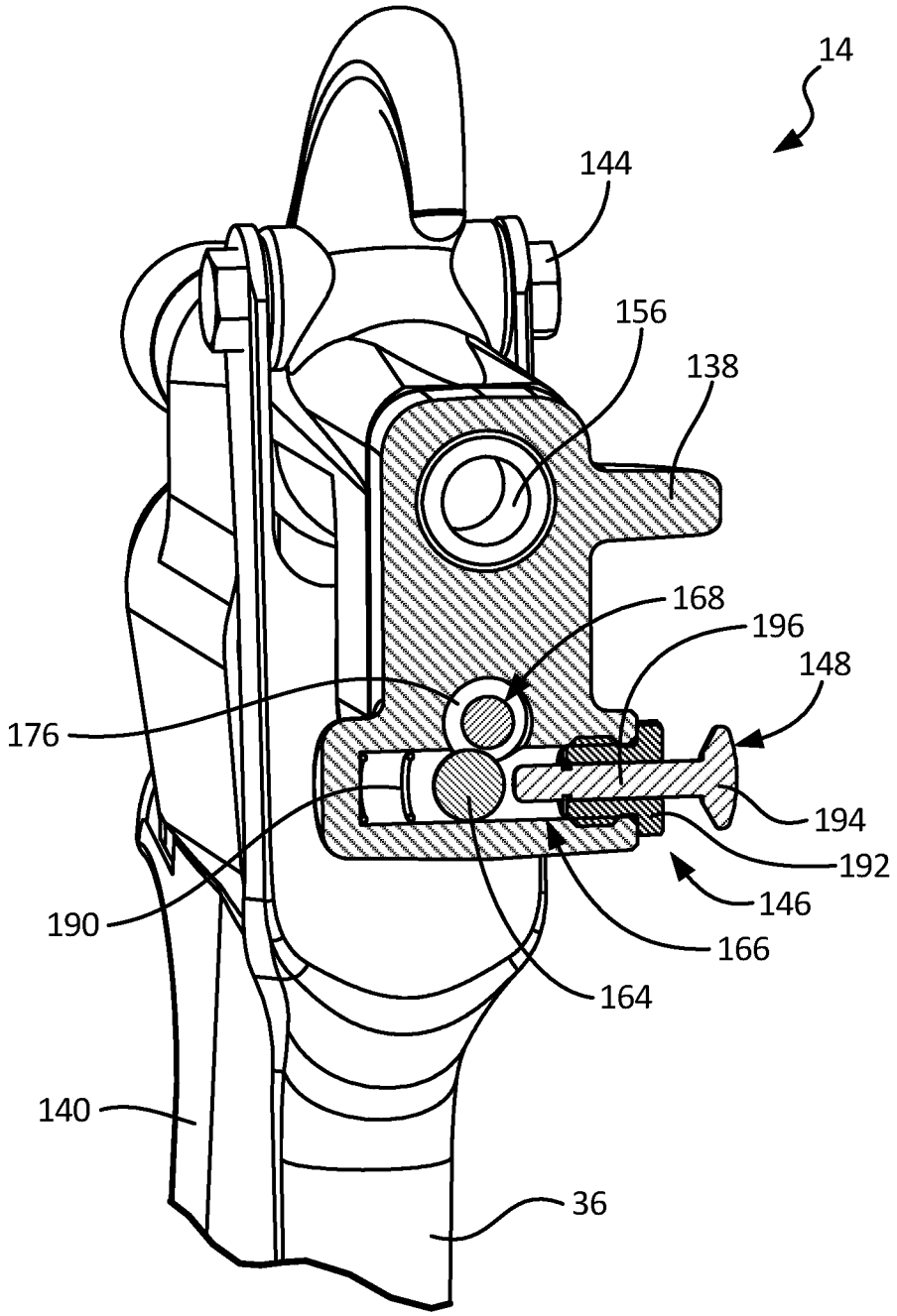
FIG. 11A is a cross-sectional view of a spray gun taken along line 11-11 in FIG. 9 and showing a detent mechanism in a first, engaged state.
Figure 11B:
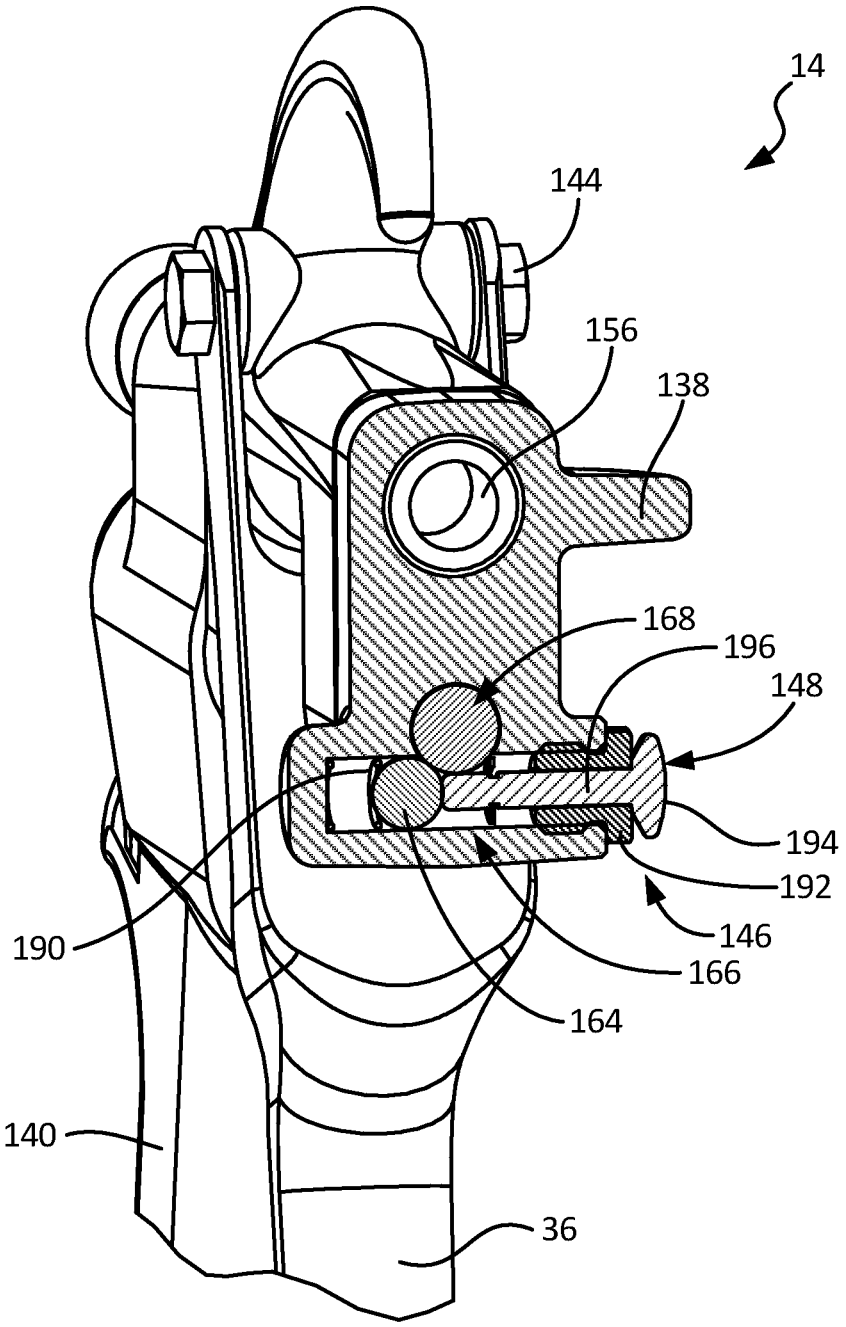
FIG. 11B is a cross-sectional view of a spray gun taken along line 11-11 in FIG. 9 and showing a detent mechanism in a second, release state.

To exit the detent state, the user actuates detent mechanism 146 from the engaged state (FIG. 11A) to a release state (FIG. 11B). Actuating detent mechanism 146 is done by a different mechanical action than releasing trigger 36. With detent mechanism 146 in the release state, needle 168 and trigger 36 can move forward, as pushed by material valve spring 170, until valve head 178 engages material valve seat 172. Valve head 178 engaging material valve seat 172 closes material flow valve 160 thereby preventing material from passing through material flow valve 160 and stopping further spraying of material. With trigger 36 moving forward, pin 180 can likewise move forward to close air flow valve 162. Air valve spring 182 pushes pin 180 forward to engage valve member 184 with air valve seat 186, thereby closing air flow valve 162 and stopping further compressed air flow through air flow valve 162.

During operation, control circuitry 42 (FIG. 1) controls activation of the driving component, such as motor 86 (FIGS. 3 and 6) of drive 32 (FIG. 1), that powers the pump, such as pump 34 (FIG. 1) to drive material to spray gun 14 such that the pump is operating during certain times but is not operating at other times. Sensor 38 is configured to sense the state of trigger 36 and provide a signal to control circuitry 42 based on the sensed state of trigger 36. With trigger 36 in the non-actuated state, shown in FIG. 10A, the second transducer component 188*b* may not send the signal indicating proximity of the first transducer component 188*a* to control circuitry 42 or may send a signal indicating lack of proximity of the first transducer component 188*a* the second transducer component 188*b* to control circuitry 42. With trigger 36 in the actuated state, shown in FIG. 10B, the first transducer component 188*a* is close enough to the second transducer component 188*b* that second transducer component 188*b* senses first transducer component 188*a* and generates the spray signal indicating the proximity of the first transducer component 188*a*. For example, second transducer component 188*b* can sense the presence of a magnetic field generated by first transducer component 188*a*. Second transducer component 188*b* can communicate the spray signal through a series of conductors of the signal line 22 to control circuitry 42. Control circuitry 42 is configured to recognize the actuation signal as indicating that trigger 36 is in the actuated state. Based on the signal, the control circuitry 42 can regulate power delivery to the motor.

When trigger 36 is shifted to the detent position, first transducer component 188*a* is far enough away from second transducer component 188*b* that second transducer component 188*b* no longer generates the signal indicating proximity of first transducer component 188*a*. With trigger 36 in the detent state, the second transducer component 188*b* does not send a signal indicative of the proximity of the first transducer component 188*a* or otherwise sends a signal indicating that trigger 36 is not in the actuated state. As such, control circuitry 42 deactivates or other reduces power to drive 32 such that drive 32 does not power pump 34.

Generally, second transducer component 188*b* outputs a signal and based on the signal control circuitry 42 powers or does not power drive 32. For example, drive 32 is powered when trigger 36 is in the actuated state, but drive 32 is not powered when trigger 36 is in the detent state or non-actuated state.

It is advantageous to control activation of drive 32 on and off at particular times, as further explained herein. It is advantageous to not operate drive 32 when trigger 36 is in the non-actuated state because the non-actuated state of trigger 36 typically corresponds with the user not wanting to spray material. Therefore, there is power, noise, and wear avoidance by not operating drive 32 when trigger 36 is not actuated. It is also advantageous to not power drive 32 when trigger 36 is in the detent state. In the detent state, the user is typically either in the process of stopping spraying for some time or is pausing between spray cycles and will soon pull trigger 36 back into the actuated state from the detent state.

Stopping motor 86, and thereby pump 34, from operating when trigger 36 is in the detent state can help avoid a packout condition from occurring in spray gun 14. A packout condition occurs when the aggregate within the spray material collects at bottlenecks, valves, ridges, or other flow obstructions through the material pathway 150 or otherwise within the gun body 138. The collection of some aggregate can lead to further collection of other aggregate, thereby creating an obstruction. Further flow of the material can sometimes break up the collection of aggregate, however a deadhead condition, where pump 34 is running but spray gun 14 is not spraying, can compact and entrench the collection of aggregate. Deadhead conditions occur when pressure builds within the material pathway due to the downstream blockage. Such downstream blockage is typically caused by closure of material flow valve 160. For example, the closure of material flow valve 160 can abruptly stop the flow of material while motor 86 continues to power pump 34, leading to a spike in pressure. The spike in pressure compresses the collection of aggregate in material pathway 150 and squeezes the fluid out of the collection of aggregate, forming the collection of aggregate into an even more compact mass that is less likely to be dislodged with the restoration of material flow. Therefore, each opening and closing of material flow valve 160 can exacerbate the problem in a snowball effect increasing the mass of the blockage until material pathway 150 becomes entirely packed out and flow is blocked. Even if motor 86 is turned off before closure of material flow valve 160 (e.g., by control circuitry 42 based on the signal, or lack thereof, by second transducer component 188*b*), pump 34 may have enough inertia to continue through another portion of a stroke, increasing the pressure in material pathway 150. Even if pump 34 stops pumping before closure of material flow valve 160, the material already flowing within spray hose 18 may include sufficient inertia to spike the fluid pressure in material pathway 150 and exacerbate the packout condition. As further explained herein, the detent position of trigger 36 helps alleviate the development and exacerbation of packout conditions.

When trigger 36 is in the detent position, first transducer component 188*a* is far enough away from second transducer component 188*b* that second transducer component 188*b* does not send a signal causing control circuitry 42 to power motor 86. Therefore, with trigger 36 in the detent position, motor 86 is deactivated. Also while trigger 36 is in the detent position, material flow valve 160 is maintained in an open position, allowing material in spray hose 18 and in material pathway 150 to flow downstream past material flow valve 160 and into mix chamber 154. As motor 86 has been deactivated and is no longer running, pump 34 will stop pumping within a short amount of time, such as one or two seconds, from when trigger 36 first enters the detent position. With pump 34 deactivated, the material within spray hose 18 and material pathway 150 will stop flowing, and the material pressure in spray hose 18 and material pathway 150 will be relieved (e.g., to ambient pressure) as the material can continue to flow through the open material flow valve 160 to mix chamber 154 and out through nozzle 40. Material flow valve 160 being open in the detent position thereby facilitates relieving of the pressure. Also with trigger 36 in the detent position, air flow valve 162 remains open, allowing the supply of air to continue to flow from air hose 20 through air pathway 156 and into mix chamber 154. The air flow continues to accelerate and atomize any material in mix chamber 154 out through nozzle 40. As such, with trigger 36 in the detent position, the flow of air continues to flow and spray any material that passes by material flow valve 160 out through nozzle 40. The pressure in spray hose 18 will continue to drop, and eventually no more material will flow past material flow valve 160 due to motor 86 being deactivated and the pressure being alleviated. The compressed air will continue to flow through mix chamber 154 and nozzle 40, even after the material flow stops, ensuring that no material is left in the mix chamber 154 to dry and solidify.

Spray gun 14 provides significant advantages. As described herein, the stroke of trigger 36 from the non-actuated state to the actuated state, and then release of trigger 36 from the actuated state to the detent state, and then release of trigger 36 from the detent state to the non-actuated state controls activation and deactivation of motor 86, the opening and closing of material flow valve 160, and the opening and closing of air flow valve 162. When the user actuates trigger 36 from the non-actuated state to the actuated state, material flow valve 160 is opened before second transducer component 188*b* senses first transducer component 188*a* and generates the activation signal to turn on motor 86. Opening material flow valve 160 before motor 86 is activated ensures that material flow valve 160 does not block the flow of material when motor 86 activates pump 34 and pump 34 starts pumping. As such, opening material flow valve 160 before activating motor 86 avoids any spikes in material pressure on startup. Also during trigger 36 actuation, air flow valve 162 is actuated to an open position before second transducer component 188*b* senses first transducer component 188*a* and generates the activation signal to turn on motor 86. Opening air flow valve 162 before activating motor 86 ensures that compressed air begins flowing through mix chamber 154 before spray material is pumped into mix chamber 154. Opening air flow valve 162 before activating motor 86 thereby avoids a mass of material from accumulating in the mix chamber 154 before the airflow can atomize and blast the mass of material out of nozzle 40, which accumulation would result in an undesirable ejection of too much material on startup. In some examples, on actuation of trigger 36, air flow valve 162 opens before material flow valve 160, and therefore also closes after the material flow valve 160 closes on release of trigger 36. The sequenced opening and closing of air flow valve 162 and material flow valve 160 thereby also avoids development of a packout condition.

FIG. 11A is a cross-sectional view of spray gun 14 taken along line 11-11 in FIG. 9 and showing detent mechanism 146 in a first, engaged state. FIG. 11B is a cross-sectional view of spray gun 14 taken along line 11-11 in FIG. 9 and showing detent mechanism 146 in a second, release state. FIGS. 11A and 11B will be discussed together. Trigger 36, gun body 138, handle 140, pivot 144, detent mechanism 146, and air pathway 156 of spray gun 14 are shown. Needle 168 of material flow valve 160 (FIGS. 10A-10C) is shown. Groove 176 of needle 168 is shown. Detent mechanism 146 includes button 148, ball 164, passage 166, spring 190, and nut 192. Button 148 includes button head 194 and button shaft 196.

Detent mechanism 146 is mounted to spray gun 14 and is configured to control trigger 36 transitioning from the detent state to the non-actuated state. Trigger 36 is shown in the detent state in FIG. 11A. Detent mechanism 146 maintains trigger 36 in the detent state when detent mechanism 146 is in the engaged state shown in FIG. 11A. Needle 168 and trigger 36 are in the state shown in FIG. 11A when trigger 36 is in one of the detent sate and the actuated state. Trigger 36 is in the non-actuated state in FIG. 11B. Detent mechanism 146 allows trigger 36 to return to the non-actuated state when detent mechanism 146 is in the release state shown in FIG. 11B.

Passage 166 is formed in gun body 138. Passage 166 extends laterally through gun body 138 relative to spray axis S-S (FIGS. 10A-10C). It is understood, however, that passage 166 can be disposed at any desired orientation transverse to spray axis S-S. Nut 192 is secured to the open end of passage 166 and retains various components of detent mechanism 146 within passage 166. Nut 192 can be secured to the open end of passage 166 in any desired manner, such as by interfaced threading, press-fitting, welding, gluing, a bayonet connection, or any other connection type suitable for securing nut 192 in passage 166. Ball 164 is disposed in passage 166 and is configured to engage needle 168 with trigger 36 in the detent state and/or actuated state to maintain trigger 36 in the detent state. Detent mechanism 146 prevents trigger 36 from automatically transitioning from the detent state to the non-actuated state. Spring 190 is disposed in passage 166. A first end of spring 190 engages the closed end of passage 166 while a second end of spring 190 interfaces with ball 164. Spring 190 is configured to push ball 164 towards button 148. While passage 166 is described as having a closed end and an open end, it is understood that passage 166 can have two open ends that can be enclosed with separate components, such as by two separate nuts 192.

Button 148 extends at least partially into passage 166. Button shaft 196 extends through nut 192 into passage 166. A distal end of button shaft 196 is configured to interface with ball 164. Button head 194 is disposed outside of passage 166 where button head 194 is accessible by the hand of a user. The user can depress button 148, via button head 194, to cause button 148 to engage ball 164 and drive ball 164 from the position shown in FIG. 11A to the position shown in FIG. 11B.

Groove 176 of needle 168 has a smaller diameter than the remaining body of needle 168. In the state shown in FIG. 11B, the diameter of the portion of needle 168 along passage 166 is wide enough to keep ball 164 at the position shown in FIG. 11B. In this state, groove 176 in needle 168 is disposed forward of ball 164, as shown in FIG. 10A. As trigger 36 is actuated from the non-actuated state to the actuated state, needle 168, and thus groove 176 in needle 168, moves rearward due to actuation of trigger 36. Ball 164 falls into groove 176 as groove 176 passes over ball 164. For example, spring 190 can push ball 164 into groove 176 and can maintain ball 164 within groove 176. Groove 176 is axially long enough such that ball 164 permits needle 168 to move back and forth between the detent state and the actuated state. However, the rear edge of groove 176 catches on ball 164 when trigger 36 is released from the actuated state and needle 168 moves forward. Ball 164 engages the rear edge of groove 176 to stop forward movement of needle 168 when the position of needle 168 reaches that associated with the detent state, shown in FIG. 10C. Ball 164 being within groove 176 prevents needle 168 from being pushed forward beyond the detent state by material valve spring 170 (FIGS. 10A-10C), such as to the non-actuated state.

Ball 164 maintains trigger 36 and needle 168 in the detent state until ball 164 is displaced from groove 176 by button 148. The user pushes on button head 194, thereby depressing button 148 within passage 166 and causing button shaft 196 to engage ball 164. The user pushing on button 148 overcomes the force of spring 190 and pushes ball 164 through passage 166 and out of groove 176. Removal of ball 164 from groove 176 allows material valve spring 170 to push needle 168 forward until valve head 178 (FIGS. 10A-10C) engages valve seat 172 (FIGS. 10A-10C), thereby stopping further material flow.

Actuating detent mechanism 146 includes a different motion than releasing trigger 36. Therefore, to fully return material flow valve 160 to the closed position associated with the trigger 36 non-actuated state from the open position associated with the trigger 36 actuated state, the user must first release trigger 36, which causes trigger 36 and needle 168 to move into the detent position (FIG. 10C) from the actuated position. Both material flow valve 160 and air flow valve 162 (FIGS. 10A-10C) are open with trigger 36 in the detent state. The user then actuates button 148 to cause ball 164 to disengage from groove 176. Ball 164 disengaging from groove 176 allows trigger 36 and needle 168 to move into the non-actuated state (FIG. 10A), which closes both material flow valve 160 and air flow valve 162.

Figure 12:
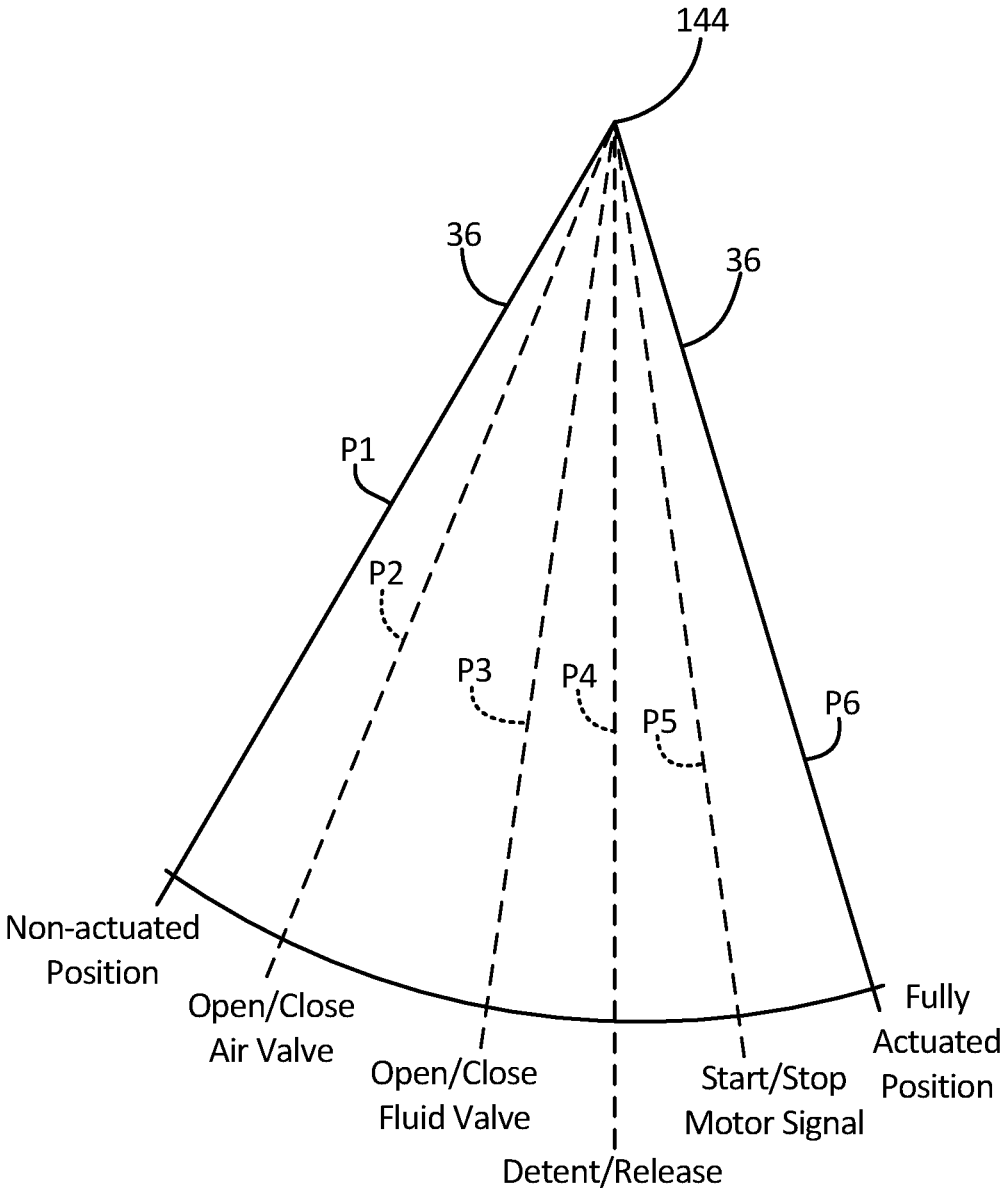
FIG. 12 is a schematic diagram showing trigger actuation states.

FIG. 12 is a schematic showing different trigger 36 pull ranges. In particular, FIG. 12 shows the sequence of opening and closing of valves, such as material flow valve 160 (FIGS. 10A-10C) and air flow valve 162 (FIGS. 10A-10C) and the starting and stopping of the spray signal through the range of actuation of trigger 36.

As shown, trigger 36 moves through an angular rotation about pivot 144. As shown, trigger 36 can be kept in a non-actuated position P1, such as by one or both of material valve spring 170 (FIGS. 10A-10C) and air valve spring 182 (FIGS. 10A-10C). Trigger 36 can then be pulled (e.g., by a user's finger) and travel an angular distance (rightward in this view) before reaching position P2, where air flow valve 162 shifts to an open state such that compressed air can flow through spray gun 14 (best seen in FIGS. 9-10C) to nozzle 40 (FIGS. 1 and 9-10C). Further travel of trigger 36 through an angular distance to position P3 opens material flow valve 160. Further pulling of trigger 36 through an angular distance to position P4 causes detent mechanism 146 (best seen in FIGS. 11A and 11B) to engage with groove 176 (FIGS. 10A-11A) of needle 168 (best seen in FIGS. 10A-10C). Detent mechanism 146 engages with trigger 36 but allows trigger 36 to continue to be pulled through an addition angular distance from the position P4 (e.g., rightward in this view) and only stops motion on release of the trigger 36 (e.g., leftward in this view). As such, detent mechanism 146 prevents trigger 36 from moving automatically beyond position P4 to any of positions P1-P3.

Returning to the initial actuation of trigger 36, trigger 36 is further pulled through an angular distance and reaches position P5 at which a sensor, such as sensor 38 (FIGS. 1 and 10A-10C) (e.g., first and second transducer components 188*a*, 188*b* (FIGS. 10A-10C)) generates and sends the activation signal to control circuitry 42 (FIG. 1) to activate a driving mechanism, such as drive 32 (best seen in FIGS. 2 and 3) and cause motor 86 (FIGS. 3 and 6) to turn on and/or power a pump, such as pump 34 (FIGS. 1-7A and 8A). From position P5, trigger 36 can further be pulled through an angular distance until trigger 36 reaches a fully actuated position P6, in which case air flow, material flow, and motor 86 are all engaged to spray material. The user can maintain trigger in the fully actuated position P6 to spray material on the surface.

After spraying, trigger 36 can be released and travel an angular distance (leftward in this view) from the position P6 and through to the non-actuated position P1 to fully stop spraying. Initially, trigger 36 travels an angular distance to and past position P5, such that sensor 38 (FIGS. 1 and 10A-10C) no longer generates and/or sends the spray signal to control circuitry 42 to cause motor 86 to power pump 34. Trigger 36 passing position P5 and proceeding to position P4 causes deactivation of pump 34 such that pump 34 stops operating. Trigger 36 is maintained in the detent position P4 by detent mechanism 146 and until detent mechanism 146 is released by the user.

The user actuates detent mechanism 146 to a release state, allowing trigger 36 to move past the detent position P4 and proceed to the non-actuated position P1. As trigger 36 moves from the detent position P4 to the non-actuated position P1, trigger 36 initially passes through position P3 such that material flow valve 160 closes, as discussed herein. With material flow valve 160 closed, the material is prevented from flowing downstream through spray gun 14 and being sprayed out through nozzle 40. However, air flow valve 162 remains open with trigger 36 in position P3. As such, air continues to flow through spray gun 14 and blows any residual material out of spray gun 14 while material flow valve 160 is closed. Trigger 36 can be further released through an angular distance until reaching position P2, where air flow valve 162 returns to a closed position. With trigger 36 passing position P2, both air flow valve 162 and material flow valve 160 are closed. Further release of trigger through an angular distance allows trigger 36 to return to the non-actuated position P1.

Trigger 36 can then be pulled again from non-actuated position P1 to actuated position P6, released from actuated position P6 to detent position P4, and released from detent position P4 and returned to non-actuated position P1, repeating the process. During either pull (proceeding from non-actuated position P1 towards actuated position P6) or release (proceeding from actuated position P6 towards non-actuated position P1) of trigger 36, trigger 36 can be stopped (e.g., by the user holding trigger 36 to maintain position) at any desired position P1-P6 along the angular range shown. As such, the particular valves and the motor may be open/closed or on/off, respectively, based on the angular position of trigger 36. The user can maintain trigger 36 in the desired position for a desired time period, then the pull or release of trigger 36 can be resumed.

Figure 13A:
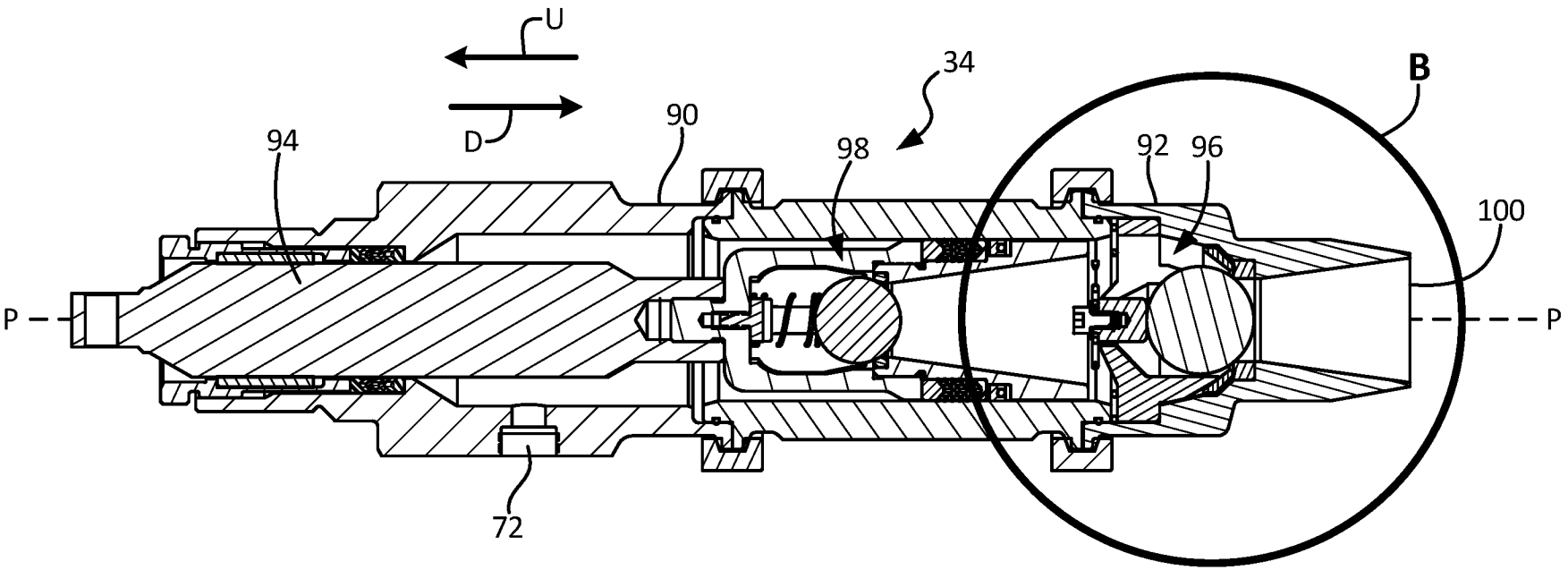
FIG. 13A is a cross-sectional view of a pump.
Figure 13B:
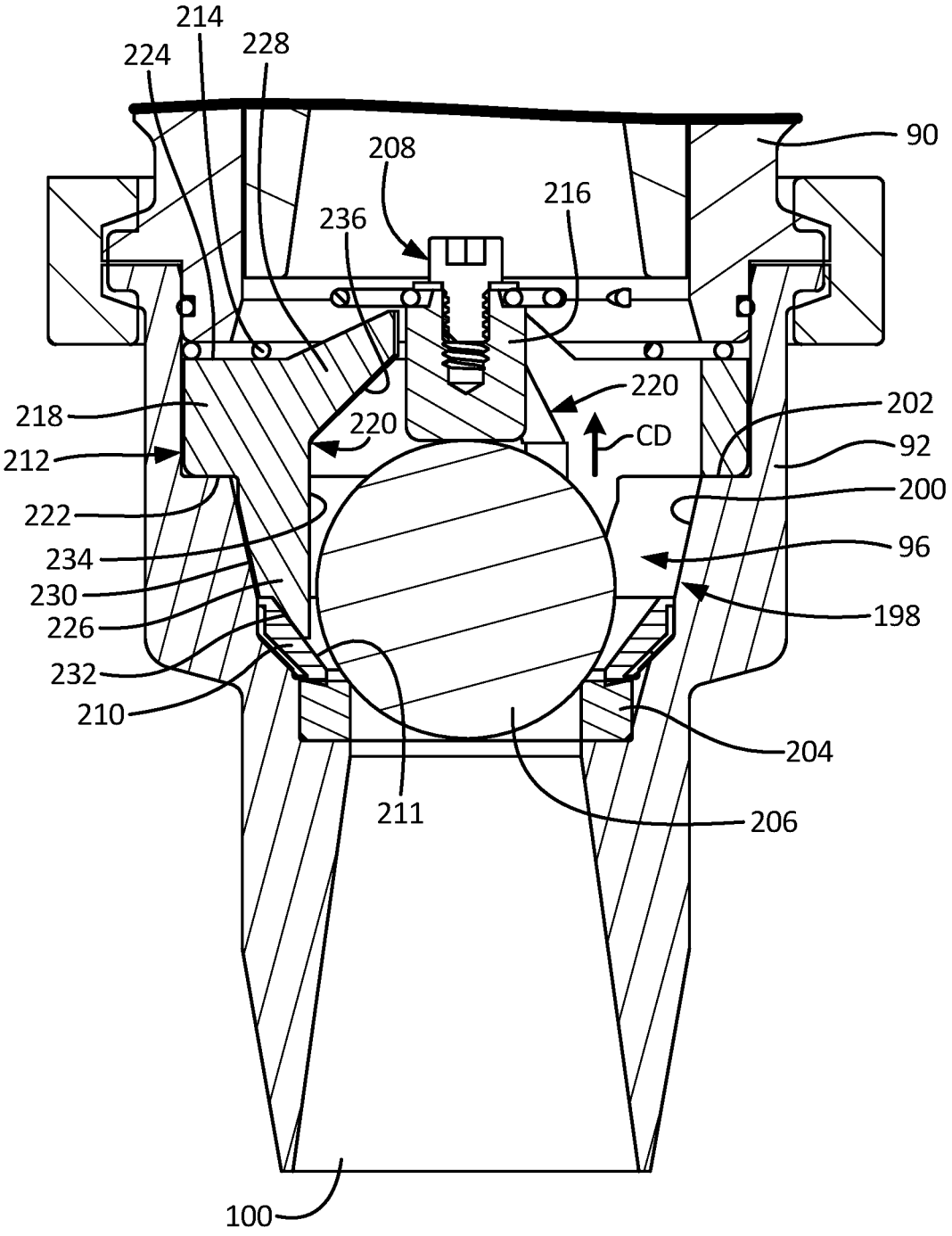
FIG. 13B is an enlarged cross-sectional view of detail B in FIG. 13A.

FIG. 13A is a cross-sectional view of pump 34. FIG. 13B is a detail cross-sectional view of detail B in FIG. 13A. FIGS. 13A and 13B will be discussed together. Pump 34 includes pump outlet 72, cylinder 90, inlet housing 92, piston 94, inlet check valve 96, piston check valve 98, pump inlet 100. Inlet housing 92 includes channel 198, angled channel surface 200, and ledge 202. Inlet check valve 96 includes check seat 204, check ball 206, ball return 208, ring 210, and ball guide 212. Ball return 208 includes return spring 214 and return member 216. Ring 210 includes angled ring surface 211. Ball guide 212 includes outer ring portion 218, and guides 220. Outer ring portion 218 includes lower ring surface 222 and upper ring surface 224. Guides 220 includes legs 226 and arms 228. Each leg 226 includes upper outer angled surface 230, lower outer angled surface 232, and inner guide surface 234. Each arm 228 includes inner stop surface 236.

Piston 94 is disposed within and configured to reciprocate within cylinder 90. Inlet housing 92 is mounted to cylinder 90. Inlet check valve 96 is contained within inlet housing 92. Piston check valve 98 is disposed within piston 94 such that piston check valve 98 reciprocates with piston 94.

The material flows through pump inlet 100 and into inlet housing 92 on the upstroke of piston 94, where piston 94 is drawn in direction U, while piston check valve 98 is closed and inlet check valve 96 is open. On the upstroke, the material flows past inlet check valve 96 into a chamber within cylinder 90. On the down stroke, when the piston 94 reverses direction and is driven in direction D, piston check valve 98 opens and inlet check valve 96 closes. The downward motion of piston 94 forces material out from the chamber in cylinder 90 through pump outlet 72. Piston 94 is driven in a reciprocating manner in directions U and D to pump material. Aspects of inlet check valve 96 will further be discussed herein.

As best seen in FIG. 13B, inlet check valve 96 is contained within inlet housing 92. Inlet housing 92 is a cylindrical piece of metal with circular openings on opposite ends, with the upstream opening forming pump inlet 100 and the downstream opening in fluid communication with the cylinder 90. Channel 198 extends between the openings, and material flows through channel 198 during pumping. Inlet check valve 96 controls material flow through channel 198 from the upstream opening to the downstream opening. A channel direction CD is indicated in FIG. 13B to represent the intended direction of material flow past inlet check valve 96 within channel 198 and through inlet housing 92. Generally, material flows along longitudinal pump axis P-P from the upstream side of inlet housing 92 to the downstream side of inlet housing 92. Channel 198, as defined by inlet housing 92, is generally circular/cylindrical, although the inner diameter of channel 198 changes along channel direction CD. Inlet housing 92 is symmetric about longitudinal pump axis P-P, such that each structural feature of inlet housing 92 shown can be understood to be circular about longitudinal pump axis P-P. It is understood, however, that the diameter of channel 198 and/or inlet housing 92 can change along the longitudinal pump axis P-P (e.g., generally widening in the channel direction CD).

Check seat 204 of inlet check valve 96 is supported by inlet housing 92. Check seat 204 can be a ring, among other shapes. Check seat 204 can be formed from ceramic, metal, or other materials. Check ball 206 is disposed in channel 198 and can be formed from ceramic, metal, rubber, or other materials. Check ball 206 is configured to annularly engage check seat 204 to prevent retrograde material flow (i.e. upstream, in a direction opposite channel direction CD). Ball return 208 is disposed on a downstream side of check ball 206. Return spring 214 is secured between ball guide 212 and cylinder 90. Return member 216 engages return spring 214, and return spring 214is configured to bias return member 216 in the upstream direction. Return member 216 is configured to engage check ball 206 to return check ball 206 to a seated position on check seat 204. Ball return 208 thereby engages check ball 206 while bracing itself against cylinder 90. Ball return 208 is flexible to allow check ball 206 to disengage from check seat 204 when material is being pulled in through pump inlet 100 and uses the spring force of return spring 214 to assist in re-engaging check ball 206 with check seat 204 to close inlet check valve 96 on the down stroke of piston 94, thereby preventing retrograde material flow.

Ring 210 is disposed within inlet housing 92 along channel 198. Ring 210 rests within, and against, the inner surface of inlet housing 92. As shown, ring 210 contacts check seat 204 and ball guide 212. Ring 210 can be formed from metal and/or rubber, among other options. In particular, ring 210 can include an outer ring portion formed from metal on which an inner ring portion, facing check ball 206, formed of rubber is molded. As such, ring 210 can be formed from multiple materials. The inner surface of ring 210 defines angled ring surface 211, which widens in the channel direction CD. As such, an upstream end of ring 210 can have a first diameter smaller than a second diameter of a downstream end of ring 210.

The portion of channel 198 downstream from ring 210 is defined by angled channel surface 200, which can be formed by a portion of inlet housing 92. As shown, angled channel surface 200 widens downstream along channel direction CD. The portion of channel 198 downstream from angled channel surface 200 forms ledge 202. Ledge 202 is formed by a portion of inlet housing 92. Ball guide 212 is supported by inlet housing 92 and rests on ledge 202. More specifically, lower ring surface 222 of outer ring portion 218 of ball guide 212 rests on the surface of inlet housing 92 that defines ledge 202.

Ball guide 212 is fully contained within inlet housing 92. Upper ring surface 224 of outer ring portion 218 of ball guide 212 is retained in inlet housing 92 by cylinder 90. In the example shown, upper ring surface 224 engages return spring 214 of ball return 208 while ball return 208 is further braced downstream by the upstream end of cylinder 90. Ball guide 212 sits within and extends along channel 198. Ball guide 212 is configured to limit movement of check ball 206 in channel direction CD and laterally relative to channel direction CD. In particular, ball guide 212 includes three inwardly projecting guides 220 to guide check ball 206 and limit travel of check ball 206. Each guide 220 includes leg 226 on an upstream side of outer ring portion 218 and arm 228 on the downstream side of outer ring portion 218. Each guide 220 limits the downstream travel of check ball 206 via arm 228 and lateral movement of check ball 206 via leg 226.

Upper outer angled surfaces 230 of legs 226 interface with angled channel surface 200 of inlet housing 92. As such, upper outer angled surfaces 230 of legs 226 fit against, and are complementary to, angled channel surface 200. Lower outer angled surfaces 232 of legs 226 interface with angled ring surface 211 of ring 210. As such, lower outer angled surface 232 of legs 226 fit against, and are complementary to, angled ring surface 211. In some examples, pump 34 may not include a ring 210. Instead, an angled surface similar to angled ring surface 211 can be formed by inlet housing 92. In such an example, lower outer angled surface 232 can be configured to fit against and along such angled surface formed by inlet housing 92. Inner guide surfaces 234 of legs 226 face check ball 206 and limit lateral movement of check ball 206. Arms 228 extend towards longitudinal pump axis P-P and inner stop surfaces 236 of arms 228 face check ball 206. Inner stop surfaces 236 are configured to engage check ball 206 to limit downstream travel of check ball 206.

Inlet check valve 96 provides significant advantages. Inlet check valve 96, including the shape of inlet housing 92 and of ball guide 212, assists in avoiding packout conditions. Packout conditions can occur when aggregate material in the fluid is allowed to accumulate on surfaces, typically flat surfaces. Therefore, many of the surfaces along channel 198 are angled relative to longitudinal pump axis P-P, minimizing exposed flat surfaces. Ring 210 includes angled ring surface 211 to inhibit accumulation of aggregate material on ring 210. Angled channel surface 200 of inlet housing 92 is likewise angled relative to longitudinal pump axis P-P to inhibit aggregate accumulation on inlet housing 92. As further shown herein, inwardly projecting guides 220 include several features that inhibit accumulation of aggregate material either on ball guide 212 itself or on other surfaces along channel 198. For example, legs 226 of ball guide 212 extend below outer ring portion 218 so that only the guiding surfaces of legs 226 extend below outer ring portion 218. Furthermore, upper outer angled surfaces 230 of legs 226 are angled relative to the longitudinal pump axis P-P to fit against, and be complementary to, angled channel surface 200 (e.g., by having the same pitch). Legs 226 also cover and engage portions of ring 210 to hold ring 210 in place instead of having an annular part engaging ring 210. Lower outer angled surfaces 232 are angled surfaces that are angled relative to longitudinal pump axis P-P to fit against, and be complementary to, angled ring surface 211 (e.g., by having the same pitch).

Figure 14:
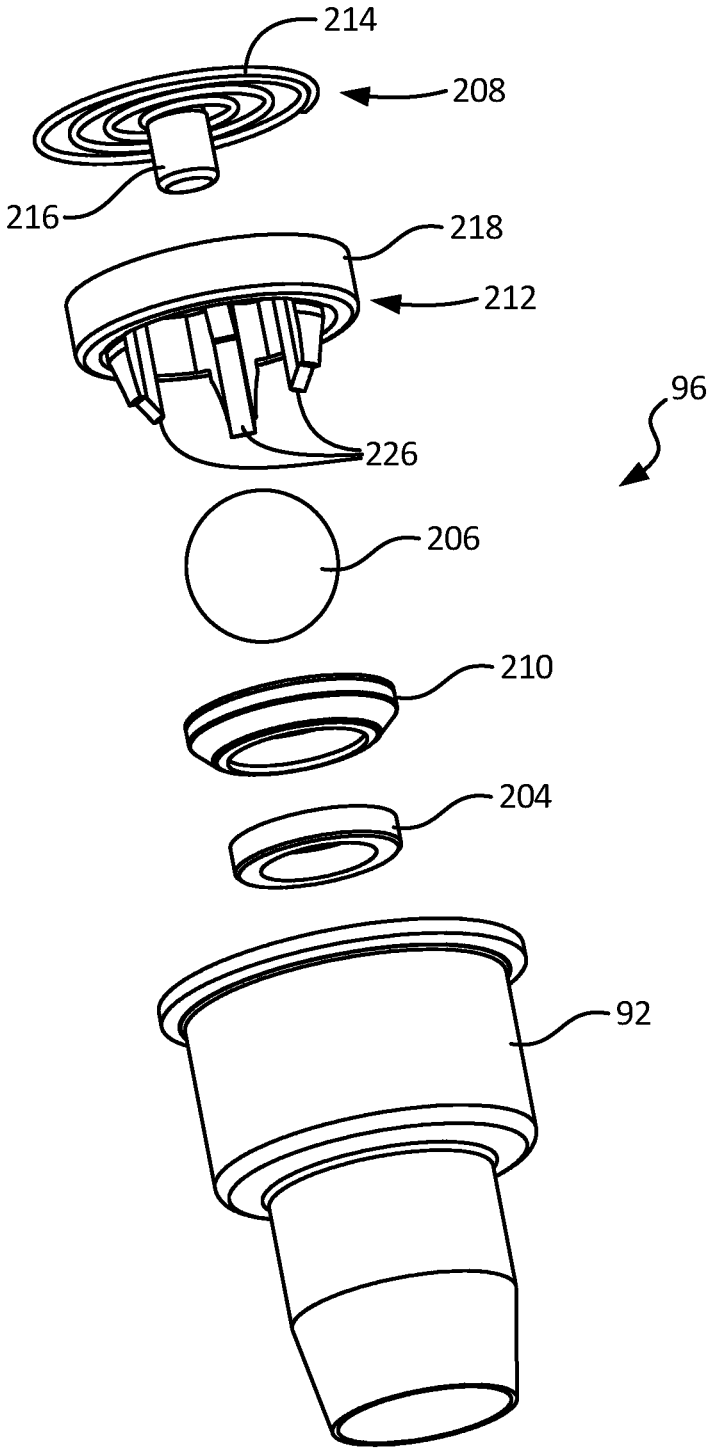
FIG. 14 is an exploded view of an inlet check valve.

FIG. 14 is an exploded view of inlet check valve 96. Inlet housing 92 of pump 34 (best seen in FIG. 13A) is shown. Inlet check valve 96 includes check seat 204, check ball 206, ball return 208, ring 210, and ball guide 212. Ball return 208 includes return spring 214 and return member 216. Legs 226 and outer ring portion 218 of ball guide 212 are shown.

As shown, ball return 208 includes return member 216 surrounded by return spring 214. Return spring 214 is a metallic coil. Ball guide 212 includes three legs 226 extending downward from outer ring portion 218 of ball guide 212. While three legs 226 are shown, a greater or lesser number of legs 226 can be provided as part of ball guide 212, such as two or four legs 226, for example. In the example shown, ring 210 and check seat 204 are annular. Check ball 206 is disposed between check seat 204 and ball guide 212.

Figure 15A:
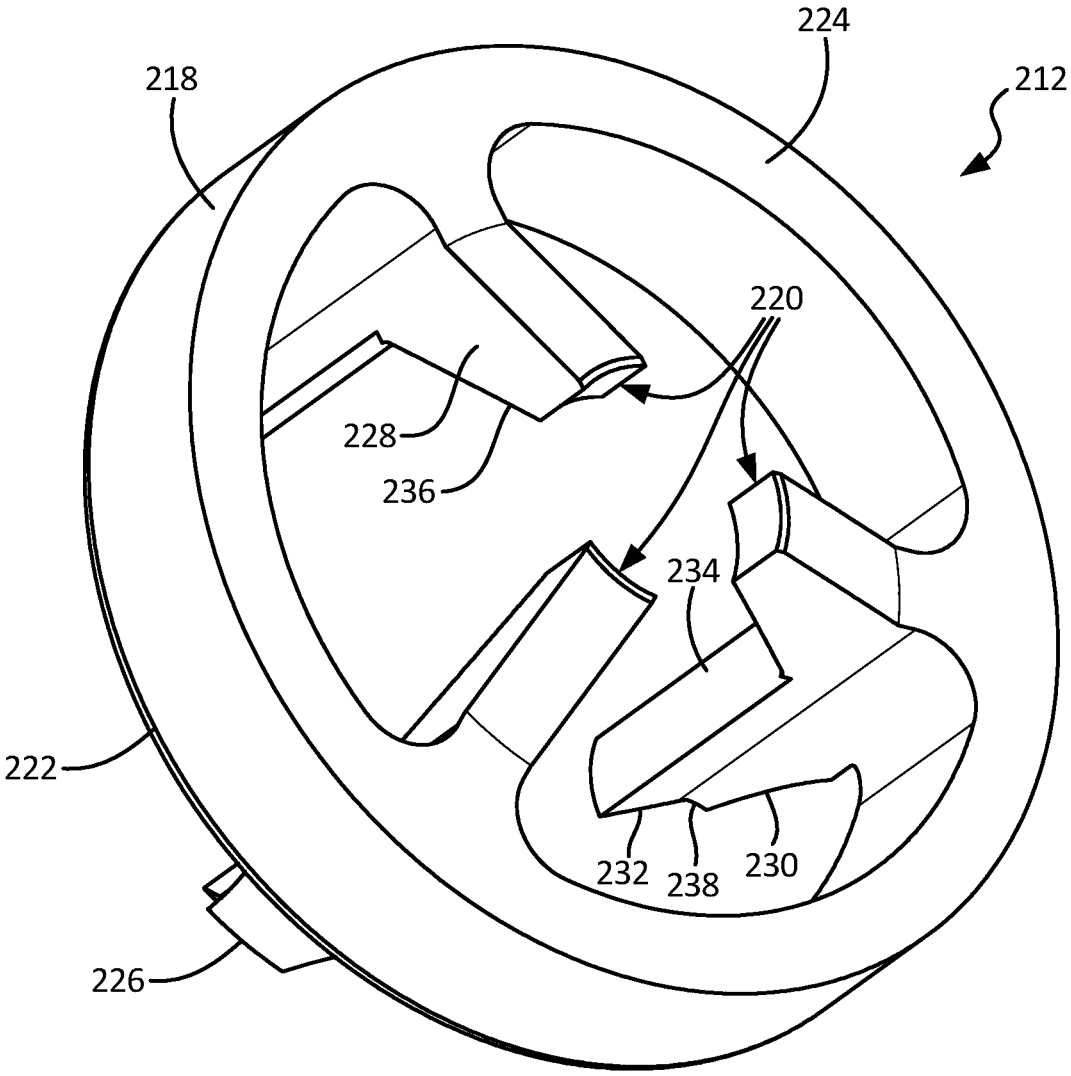
FIG. 15A is a top isometric view of a ball guide.
Figure 15B:
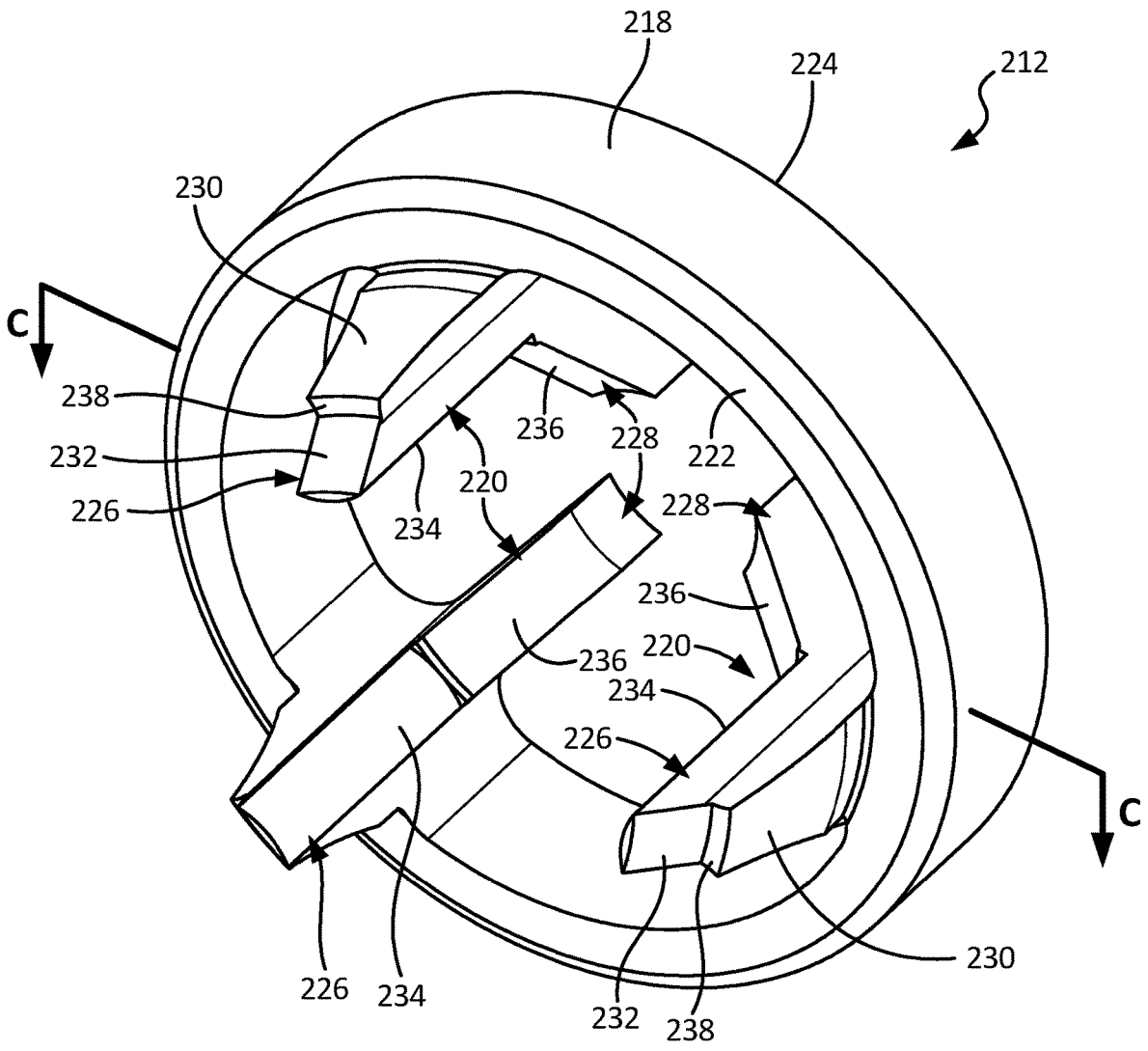
FIG. 15B is a bottom isometric view of a ball guide.
Figure 15C:
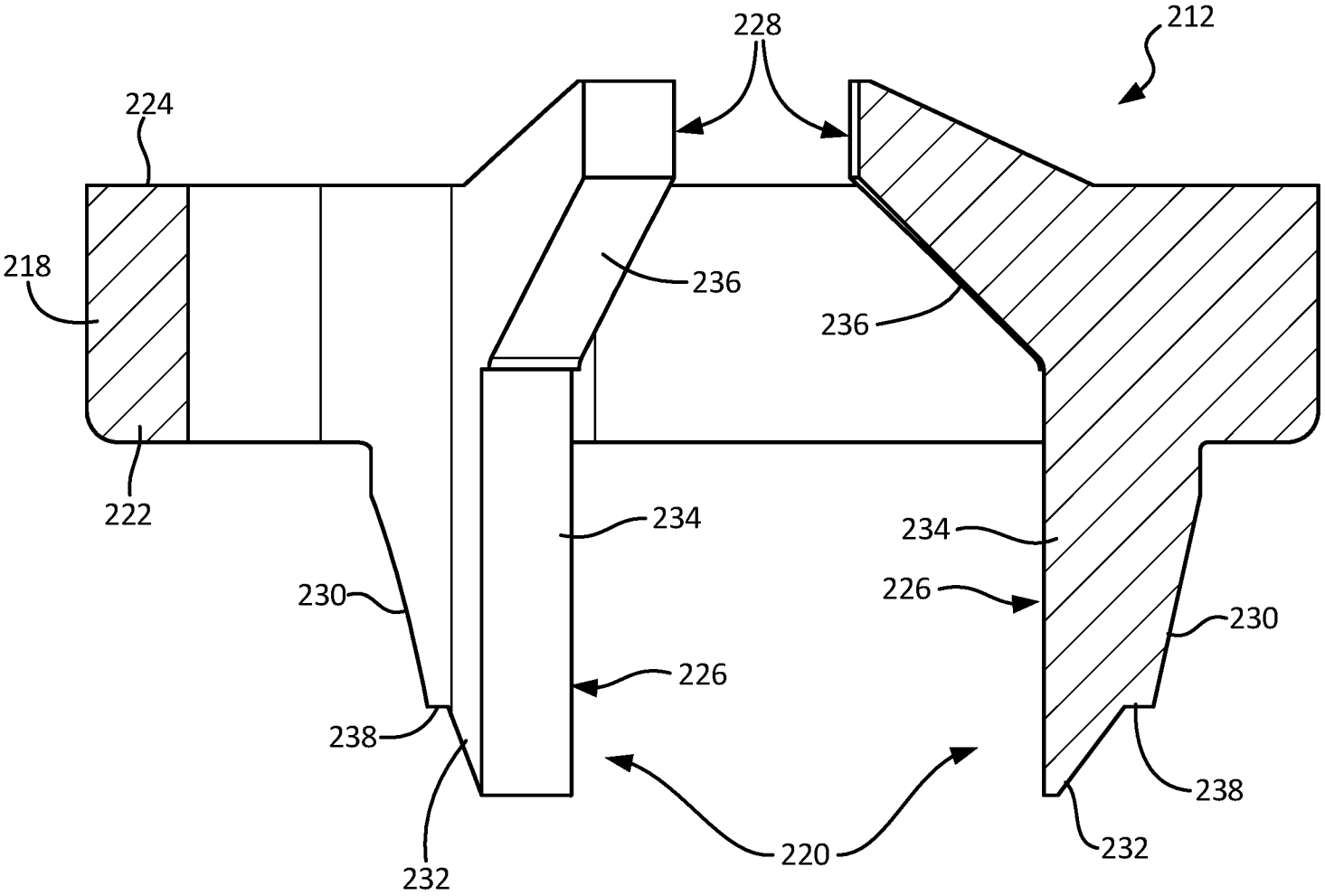
FIG. 15C is a cross-sectional view of a ball guide taken along line C-C in FIG. 15B.

FIG. 15A is a top isometric view of ball guide 212. FIG. 15B is a bottom isometric view of ball guide 212. FIG. 15C is a cross-sectional view of ball guide 212 taken along line C-C in FIG. 15B. FIGS. 15A-15C will be discussed together. Ball guide 212 includes outer ring portion 218 and guides 220. Outer ring portion 218 includes lower ring surface 222 and upper ring surface 224. Guides 220 includes legs 226 and arms 228. Each leg 226 includes upper outer angled surface 230, lower outer angled surface 232, inner guide surface 234, and corner 238. Each arm 228 includes inner stop surface 236.

Outer ring portion 218 is annular and arms 228 and legs 226 extend from outer ring portion 218. Arms 228 extend above outer ring portion 218. Legs 226 extend below outer ring portion 218. Other than the connection to outer ring portion 218, legs 226 and arms 228 are not supported by any other ring or cylindrical structure. Each of arms 228 and legs 226 project outward (e.g. at least partially along longitudinal pump axis P-P (FIG. 13A)) from outer ring portion 218 such that each of arms 228 and legs 226 have free ends that do not contact or connect with any other portions of ball guide 212. For example, arms 228 extend inward from outer ring portion 218 towards the pump axis P-P and do not connect with one another (except indirectly by being attached to the same outer ring portion 218). Likewise, legs 226 extend inward from outer ring portion 218 towards the pump axis P-P and do not connect with one another (except indirectly by being attached to the same outer ring portion 218).

Inner guide surfaces 234 are inward facing and extend along legs 226. Inner guide surfaces 234 are configured to guide check ball 206 (best seen in FIG. 13B) as check ball 206 moves up and down during pumping, preventing check ball 206 from moving laterally offset from longitudinal pump axis P-P, which would otherwise inhibit reseating of check ball 206 on check seat 204 (best seen in FIG. 13B). Inner guide surfaces 234 extend parallel along longitudinal pump axis P-P. Lower outer angled surfaces 232 of legs 226 are disposed on a laterally opposite side of legs 226 from inner guide surface 234. Lower outer angled surfaces 232 fit against and along angled ring surface 211 (FIG. 13B). For example, lower outer angled surfaces 232 have the same pitch as angled ring surface 211 so that the surfaces extend parallel with each other to facilitate engagement. In some examples, there is no space between lower outer angled surface 232 and angled ring surface 211 (or a substitute angled surface such as a channel surface of the inlet housing 92) so that aggregate and other debris cannot be caught between the surfaces.

Each leg 226 further includes upper outer angled surface 230. Upper outer angled surface 230 is configured to fit against and along angled channel surface 200 (FIG. 13B). For example, upper outer angled surface 230 has the same pitch as angled channel surface 200 so that upper outer angled surface 230 and angled channel surface 200 extend parallel with each other. In some examples, there is no space between upper outer angled surface 230 and angled channel surface 200 so that aggregate and other debris cannot be caught between the surfaces. It is noted that arms 228 and legs 226 have some thickness to them in the circumferential direction and are not merely wires. Corner 238 transitions between different pitches of lower outer angled surface 232 and the upper outer angled surface 230.

Arms 228 each include inner stop surface 236. Inner stop surfaces 236 are configured to engage check ball 206 to prevent further upward, downstream movement of check ball 206 along longitudinal pump axis P-P. Such inner stop surfaces 236 prevent check ball 206 from moving too far away from check seat 204 during pumping such that check ball 206 can quickly move into place on check seat 204 when piston 94 (best seen in FIG. 13A) transitions from the upward suction stroke to the downward pumping stroke. Inner stop surface 236, as with arm 228, is angled relative to longitudinal pump axis P-P. Arms 228 extend above upper ring surface 224 of outer ring portion 218. Likewise, at least part of inner stop surface 236 extends above upper ring surface 224 of outer ring portion 218 such that a portion of check ball 206 can extend beyond (i.e. above) outer ring portion 218. If outer ring portion 218 was moved upward relative to arms 228 such that arms 228 did not extend above outer ring portion 218, then outer ring portion 218 would either have to be longer, which increases a surface area of outer ring portion 218 and risks aggregate accumulation, and/or legs 226 would have to be longer, which increases the difficulty of manufacturing and reduces the strength of legs 226. As such, arms 228 extending above outer ring portion 218 facilitates a compact and balanced structure of ball guide 212.

FIG. 16A is a first side elevation view of ball guide 212. FIG. 16B is a second side elevation view of ball guide 212. FIG. 16C is a top elevation view of ball guide 212. FIG. 16D is a third side elevation view of ball guide 212. FIG. 16E is a bottom elevation view of ball guide 212. Ball guide 212 includes outer ring portion 218 and guides 220. Outer ring portion 218 includes lower ring surface 222 and upper ring surface 224. Guides 220 includes legs 226 and arms 228. As shown in FIGS. 16A-16E, guides 220 are evenly arrayed about the inner circumference of outer ring portion 218.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. Any single feature, or any combination of features from one embodiment show herein, may be utilized in a different embodiment independent from the other features shown in the embodiment herein. Accordingly, the scope of the invention(s) and any claims thereto are not limited to the particular to the embodiments and/or combinations of the features shown herein, but rather can include any combination of one, two, or more features shown herein.

The invention claimed is:

1. A spray gun for a material sprayer configured to spray material output by a pump to the spray gun, the spray gun comprising:

a gun body having a material pathway extending through the gun body to provide material to a spray nozzle and an air pathway extending through the gun body to provide air to the spray nozzle;

a trigger pivotably mounted to the gun body and configured to mechanically actuate a fluid flow valve controlling flow of material through the material pathway between a first open state and a first closed state and configured to mechanically actuate an air flow valve controlling flow of air through an air pathway in the gun body to the spray nozzle between a second open state and a second closed state, wherein the trigger is configured to shift in a first direction from a first position associated with a non-actuated state in which the fluid flow valve is in the first closed state and the air valve is in the second closed state to a first intermediate state, the fluid flow valve being in the first open state with the trigger in the first intermediate state and the air flow valve being in the second open state with the trigger in the first intermediate state, and then to a second position associated with an actuated state, the fluid flow valve being in the first open state and the air flow valve being in the second open state with the trigger in the actuated state, and wherein the trigger is configured to shift in a second direction, opposite the first direction, from the second position associated with the actuated state, to the first intermediate state, and then to the first position associated with the non-actuated state;

a sensor associated with the trigger and configured to sense the trigger moving into the actuated state from the first intermediate state, wherein the sensor is configured to cause activation of the pump based on the sensor sensing the trigger in the actuated state; and a detent configured to arrest movement of the trigger in the second direction at the first intermediate position on release of the trigger from the actuated state such that release of the trigger from the actuated state allows the trigger to shift in the second direction from the second position associated with the actuated state to the first intermediate position but does not cause the trigger to automatically return to the first position associated with the non-actuated state.

2. The spray gun of claim 1, wherein:

the fluid flow valve includes a material valve needle disposed at least partially within the gun body, the material valve needle including:

a valve head disposed at a first end of the material valve needle;

a neck formed on a portion of the material valve needle and interfacing with the trigger; and a groove formed in the material valve needle between the valve head and the neck; and the detent is configured to engage the groove to prevent movement of the trigger in the second direction, opposite the first direction, and hold the trigger in the detent position.

3. The spray gun of claim 1, wherein the detent is at least partially disposed in a passage in the gun body, the passage extending transverse to a spray axis of the spray gun.

4. The spray gun of claim 3, wherein the detent includes a ball disposed in the passage.

5. The spray gun of claim 4, wherein the detent further comprises:

a button partially disposed in the passage and projecting out of the gun body; and a spring disposed in the passage on an opposite side of the ball from the button;

wherein the ball is configured to engage a groove of a material valve needle of the material flow valve to maintain the trigger in the detent position.

6. The spray gun of claim 1, wherein the detent is actuatable between an engaged state and a release state, wherein the detent maintains the trigger in the detent position when the detent mechanism is in the engaged state.

7. A spray gun for a material sprayer configured to spray material output by a pump to the spray gun, the spray gun comprising:

a gun body having a material pathway extending through the gun body to provide material to a spray nozzle and an air pathway extending through the gun body to provide air to the spray nozzle;

a trigger pivotably mounted to the gun body and configured to actuate a fluid flow valve controlling flow of material through the material pathway between a first open state and a first closed state, wherein the trigger is configured to shift in a first direction from a non-actuated state to a first intermediate state, the fluid flow valve being in the first open state with the trigger in the first intermediate state, and then to an actuated state, and wherein the trigger is configured to shift in a second direction, opposite the first direction, from the actuated state, to the first intermediate state, and then to the non-actuated state;

a sensor associated with the trigger and configured to sense the trigger being in the actuated state, wherein the sensor is configured to cause activation of the pump based on the sensor sensing the trigger in the actuated state; and a detent configured to arrest movement of the trigger in the second direction at a detent position intermediate the actuated state and the non-actuated state on release of the trigger from the actuated state such that release of the trigger from the actuated state does not cause the trigger to automatically return to the non-actuated state;

wherein the sensor does not sense the trigger being in the actuated state with the trigger in the detent state such that the pump is deactivated with the trigger in the detent state.

8. A spray gun for a material sprayer configured to spray material output by a pump to the spray gun, the spray gun comprising:

a gun body having a material pathway extending through the gun body to provide material to a spray nozzle and an air pathway extending through the gun body to provide air to the spray nozzle;

a trigger pivotably mounted to the gun body and configured to mechanically actuate a fluid flow valve between a first open state and a first closed state, wherein the trigger is configured to shift in a first direction from a non-actuated state to a first intermediate state, and then to an actuated state, and wherein the trigger is configured to shift in a second direction, opposite the first direction, from the actuated state, to the first intermediate state, and then to the non-actuated state;

a sensor associated with the trigger and configured to sense the trigger being in the actuated state, wherein the sensor is configured to cause activation of the pump based on the sensor sensing the trigger in the actuated state; and a detent configured to arrest movement of the trigger in the second direction at a detent position disposed intermediate a first position associated with the actuated state and a second position associated with the non-actuated state on release of the trigger from the actuated state;

wherein the fluid flow valve opens prior to the sensor sensing the trigger being in the actuated state and the fluid flow valve closes after the sensor stops sensing the trigger being in the actuated state.

9. The spray gun of claim 8, wherein the fluid flow valve is a material flow valve configured to control flow of the spray material.

10. The spray gun of claim 8, further comprising:

an air flow valve disposed at least partially in the gun body and configured to control flow of air through an air pathway in the gun body to the spray nozzle;

wherein the trigger is disposed relative to the fluid flow valve and the air flow valve such that actuating the trigger through the pull range causes the trigger to actuate the air flow valve open prior to actuating the fluid flow valve open.

11. A spray gun for a material sprayer configured to spray material output by a pump to the spray gun, the spray gun comprising:

a gun body having a material pathway extending through the gun body to provide material to a spray nozzle and an air pathway extending through the gun body to provide air to the spray nozzle;

a trigger pivotably mounted to the gun body and configured to actuate a fluid flow valve between a first open state and a first closed state, wherein the trigger is configured to shift in a first direction from a non-actuated state to a first intermediate state, and then to an actuated state, and wherein the trigger is configured to shift in a second direction, opposite the first direction, from the actuated state, to the first intermediate state, and then to the non-actuated state;

a sensor associated with the trigger and configured to sense the trigger being in the actuated state, wherein the sensor is configured to cause activation of the pump based on the sensor sensing the trigger in the actuated state; and a detent configured to arrest movement of the trigger in the second direction at a detent position intermediate the actuated state and the non-actuated state on release of the trigger from the actuated state;

wherein the sensor is configured to generate a spray signal causing activation of the pump based on the trigger being in the actuated state, and wherein shifting the trigger in the second direction, opposite the first direction, from the actuated state to the detent position causes the sensor to stop generating the spray signal.

* * * * *